US011445294B2

(12) United States Patent
Koschak et al.

(10) Patent No.: US 11,445,294 B2
(45) Date of Patent: Sep. 13, 2022

(54) STEERABLE SPEAKER ARRAY, SYSTEM, AND METHOD FOR THE SAME

(71) Applicant: Shure Acquisition Holdings, Inc., Niles, IL (US)

(72) Inventors: Matthew David Koschak, Deerfield, IL (US); Brent Robert Shumard, Mount Prospect, IL (US); David Grant Cason, Palatine, IL (US); Kenneth James Platz, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/882,110

(22) Filed: May 22, 2020

(65) Prior Publication Data

US 2020/0374624 A1 Nov. 26, 2020

Related U.S. Application Data

(60) Provisional application No. 62/960,502, filed on Jan. 13, 2020, provisional application No. 62/851,819, filed on May 23, 2019.

(51) Int. Cl.
*H04R 1/40* (2006.01)
*G10K 11/178* (2006.01)

(52) U.S. Cl.
CPC ..... *H04R 1/403* (2013.01); *G10K 11/178* (2013.01); *H04R 1/406* (2013.01); *G10K 2210/505* (2013.01)

(58) Field of Classification Search
CPC ..... H04R 1/403; H04R 1/406; G10K 11/178; G10K 2210/028; G10K 2210/505
(Continued)

(56) References Cited

U.S. PATENT DOCUMENTS 1,535,408 A 4/1925 Fricke
1,540,788 A 6/1925 Mcclure
(Continued)

FOREIGN PATENT DOCUMENTS

CA 2359771 4/2003
CA 2475283 1/2005
(Continued)

OTHER PUBLICATIONS

"Vsa 2050 II Digitally Steerable Column Speaker," Web page https://www.rcf.it/en_US/products/product-detail/vsa-2050-ii/972389, 15 pages, Dec. 24, 2018.
(Continued)

*Primary Examiner* — William A Jerez Lora
(74) *Attorney, Agent, or Firm* — Neal, Gerber & Eisenberg LLP

(57) ABSTRACT

A steerable speaker array is provided, comprising a plurality of drivers arranged in a concentric, nested configuration formed by arranging the drivers in a plurality of concentric groups and placing the groups at different radial distances from a central point of the configuration. Each group is formed by a subset of the plurality of drivers being positioned at predetermined intervals from each other along a perimeter of the group. Also, the concentric groups are harmonically nested and rotationally offset from each other. An audio system is also provided comprising at least one steerable speaker array and a beamforming system configured to receive one or more input audio signals from an audio source, generate a separate audio output signal for each driver of the speaker array based on at least one of the input signals, and provide the audio output signals to the corresponding drivers to produce a beamformed audio output.

27 Claims, 9 Drawing Sheets

(58) Field of Classification Search
USPC ..... 381/66, 124, 300, 335, 356
See application file for complete search history.

(56) References Cited

U.S. PATENT DOCUMENTS

| | | | |
|---|---|---|---|
| 1,965,830 | A | 7/1934 | Hammer |
| 2,075,588 | A | 3/1937 | Meyers |
| 2,113,219 | A | 4/1938 | Olson |
| 2,164,655 | A | 7/1939 | Kleerup |
| D122,771 | S | 10/1940 | Doner |
| 2,233,412 | A | 3/1941 | Hill |
| 2,268,529 | A | 12/1941 | Stiles |
| 2,343,037 | A | 2/1944 | William |
| 2,377,449 | A | 6/1945 | Prevette |
| 2,481,250 | A | 9/1949 | Schneider |
| 2,521,603 | A | 9/1950 | Prew |
| 2,533,565 | A | 12/1950 | Eichelman |
| 2,539,671 | A | 1/1951 | Olson |
| 2,777,232 | A | 1/1957 | Kulicke |
| 2,828,508 | A | 4/1958 | Labarre |
| 2,840,181 | A | 6/1958 | Wildman |
| 2,882,633 | A | 4/1959 | Howell |
| 2,912,605 | A | 11/1959 | Tibbetts |
| 2,938,113 | A | 5/1960 | Schnell |
| 2,950,556 | A | 8/1960 | Larios |
| 3,019,854 | A | 2/1962 | OBryant |
| 3,132,713 | A | 5/1964 | Seeler |
| 3,143,182 | A | 8/1964 | Sears |
| 3,160,225 | A | 12/1964 | Sechrist |
| 3,161,975 | A | 12/1964 | McMillan |
| 3,205,601 | A | 9/1965 | Gawne |
| 3,239,973 | A | 3/1966 | Hannes |
| 3,240,883 | A | 3/1966 | Seeler |
| 3,310,901 | A | 3/1967 | Sarkisian |
| 3,321,170 | A | 5/1967 | Vye |
| 3,509,290 | A | 4/1970 | Mochida |
| 3,573,399 | A | 4/1971 | Schroeder |
| 3,657,490 | A | 4/1972 | Scheiber |
| 3,696,885 | A | 10/1972 | Grieg |
| 3,755,625 | A | 8/1973 | Maston |
| 3,828,508 | A | 8/1974 | Moeller |
| 3,857,191 | A | 12/1974 | Sadorus |
| 3,895,194 | A | 7/1975 | Fraim |
| 3,906,431 | A | 9/1975 | Clearwaters |
| D237,103 | S | 10/1975 | Fisher |
| 3,936,606 | A | 2/1976 | Wanke |
| 3,938,617 | A | 2/1976 | Forbes |
| 3,941,638 | A | 3/1976 | Horky |
| 3,992,584 | A | 11/1976 | Dugan |
| 4,007,461 | A | 2/1977 | Luedtke |
| 4,008,408 | A | 2/1977 | Kodama |
| 4,029,170 | A | 6/1977 | Phillips |
| 4,032,725 | A | 6/1977 | McGee |
| 4,070,547 | A | 1/1978 | Dellar |
| 4,072,821 | A | 2/1978 | Bauer |
| 4,096,353 | A | 6/1978 | Bauer |
| 4,127,156 | A | 11/1978 | Brandt |
| 4,131,760 | A | 12/1978 | Christensen |
| 4,169,219 | A | 9/1979 | Beard |
| 4,184,048 | A | 1/1980 | Alcaide |
| 4,198,705 | A | 4/1980 | Massa |
| D255,234 | S | 6/1980 | Wellward |
| D256,015 | S | 7/1980 | Doherty |
| 4,212,133 | A | 7/1980 | Lufkin |
| 4,237,339 | A | 12/1980 | Bunting |
| 4,244,096 | A | 1/1981 | Kashichi |
| 4,244,906 | A | 1/1981 | Heinemann |
| 4,254,417 | A | 3/1981 | Speiser |
| 4,275,694 | A | 6/1981 | Nagaishi |
| 4,296,280 | A | 10/1981 | Richie |
| 4,305,141 | A | 12/1981 | Massa |
| 4,308,425 | A | 12/1981 | Momose |
| 4,311,874 | A | 1/1982 | Wallace, Jr. |
| 4,330,691 | A | 5/1982 | Gordon |
| 4,334,740 | A | 6/1982 | Wray |
| 4,365,449 | A | 12/1982 | Liautaud |
| 4,373,191 | A | 2/1983 | Fette |
| 4,393,631 | A | 7/1983 | Krent |
| 4,414,433 | A | 11/1983 | Horie |
| 4,429,850 | A | 2/1984 | Weber |
| 4,436,966 | A | 3/1984 | Botros |
| 4,449,238 | A | 5/1984 | Lee |
| 4,466,117 | A | 8/1984 | Rudolf |
| 4,485,484 | A | 11/1984 | Flanagan |
| 4,489,442 | A | 12/1984 | Anderson |
| 4,518,826 | A | 5/1985 | Caudill |
| 4,521,908 | A | 6/1985 | Miyaji |
| 4,566,557 | A | 1/1986 | Lemaitre |
| 4,593,404 | A | 6/1986 | Bolin |
| 4,594,478 | A | 6/1986 | Gumb |
| D285,067 | S | 8/1986 | Delbuck |
| 4,625,827 | A | 12/1986 | Bartlett |
| 4,653,102 | A | 3/1987 | Hansen |
| 4,658,425 | A | 4/1987 | Julstrom |
| 4,669,108 | A | 5/1987 | Deinzer |
| 4,675,906 | A | 6/1987 | Sessler |
| 4,693,174 | A | 9/1987 | Anderson |
| 4,696,043 | A | 9/1987 | Iwahara |
| 4,712,231 | A | 12/1987 | Julstrom |
| 4,741,038 | A | 4/1988 | Elko |
| 4,752,961 | A | 6/1988 | Kahn |
| 4,805,730 | A | 2/1989 | O'Neill |
| 4,815,132 | A | 3/1989 | Minami |
| 4,860,366 | A | 8/1989 | Fukushi |
| 4,862,507 | A | 8/1989 | Woodard |
| 4,866,868 | A | 9/1989 | Kass |
| 4,881,135 | A | 11/1989 | Heilweil |
| 4,888,807 | A | 12/1989 | Reichel |
| 4,903,247 | A | 2/1990 | Van Gerwen |
| 4,923,032 | A | 5/1990 | Nuernberger |
| 4,928,312 | A | 5/1990 | Hill |
| 4,969,197 | A | 11/1990 | Takaya |
| 5,000,286 | A | 3/1991 | Crawford |
| 5,038,935 | A | 8/1991 | Wenkman |
| 5,058,170 | A | 10/1991 | Kanamori |
| 5,088,574 | A | 2/1992 | Kertesz, III |
| D324,780 | S | 3/1992 | Sebesta |
| 5,121,426 | A | 6/1992 | Baumhauer |
| D329,239 | S | 9/1992 | Hahn |
| 5,189,701 | A | 2/1993 | Jain |
| 5,204,907 | A | 4/1993 | Staple |
| 5,214,709 | A | 5/1993 | Ribic |
| D340,718 | S | 10/1993 | Leger |
| 5,289,544 | A | 2/1994 | Franklin |
| D345,346 | S | 3/1994 | Alfonso |
| D345,379 | S | 3/1994 | Chan |
| 5,297,210 | A | 3/1994 | Julstrom |
| 5,322,979 | A | 6/1994 | Cassity |
| 5,323,459 | A | 6/1994 | Hirano |
| 5,329,593 | A | 7/1994 | Lazzeroni |
| 5,335,011 | A | 8/1994 | Addeo |
| 5,353,279 | A | 10/1994 | Koyama |
| 5,359,374 | A | 10/1994 | Schwartz |
| 5,371,789 | A | 12/1994 | Hirano |
| 5,383,293 | A | 1/1995 | Royal |
| 5,384,843 | A | 1/1995 | Masuda |
| 5,396,554 | A | 3/1995 | Hirano |
| 5,400,413 | A | 3/1995 | Kindel |
| D363,045 | S | 10/1995 | Phillips |
| 5,473,701 | A | 12/1995 | Cezanne |
| 5,509,634 | A | 4/1996 | Gebka |
| 5,513,265 | A | 4/1996 | Hirano |
| 5,525,765 | A | 6/1996 | Freiheit |
| 5,550,924 | A | 8/1996 | Helf |
| 5,550,925 | A | 8/1996 | Hori |
| 5,555,447 | A | 9/1996 | Kotzin |
| 5,574,793 | A | 11/1996 | Hirschhorn |
| 5,602,962 | A | 2/1997 | Kellermann |
| 5,633,936 | A | 5/1997 | Oh |
| 5,645,257 | A | 7/1997 | Ward |
| D382,118 | S | 8/1997 | Ferrero |
| 5,657,393 | A | 8/1997 | Crow |
| 5,661,813 | A | 8/1997 | Shimauchi |
| 5,673,327 | A | 9/1997 | Julstrom |

(56) References Cited

U.S. PATENT DOCUMENTS 5,687,229 A 11/1997 Sih
5,706,344 A 1/1998 Finn
5,715,319 A 2/1998 Chu
5,717,171 A 2/1998 Miller
D392,977 S 3/1998 Kim
D394,061 S 5/1998 Fink
5,761,318 A 6/1998 Shimauchi
5,766,702 A 6/1998 Lin
5,787,183 A 7/1998 Chu
5,796,819 A 8/1998 Romesburg
5,848,146 A 12/1998 Slattery
5,870,482 A 2/1999 Loeppert
5,878,147 A 3/1999 Killion
5,888,412 A 3/1999 Sooriakumar
5,888,439 A 3/1999 Miller
D416,315 S 11/1999 Nanjo
5,978,211 A 11/1999 Hong
5,991,277 A 11/1999 Maeng
6,035,962 A 3/2000 Lin
6,039,457 A 3/2000 O'Neal
6,041,127 A 3/2000 Elko
6,049,607 A 4/2000 Marash
D424,538 S 5/2000 Hayashi
6,069,961 A 5/2000 Nakazawa
6,125,179 A 9/2000 Wu
D432,518 S 10/2000 Muto
6,128,395 A * 10/2000 De Vries ..... H04R 1/403 381/182
6,137,887 A 10/2000 Anderson
6,144,746 A 11/2000 Azima
6,151,399 A 11/2000 Killion
6,173,059 B1 1/2001 Huang
6,198,831 B1 3/2001 Azima
6,205,224 B1 3/2001 Underbrink
6,215,881 B1 4/2001 Azima
6,266,427 B1 7/2001 Mathur
6,285,770 B1 9/2001 Azima
6,301,357 B1 10/2001 Romesburg
6,329,908 B1 12/2001 Frecska
6,332,029 B1 12/2001 Azima
D453,016 S 1/2002 Nevill
6,386,315 B1 5/2002 Roy
6,393,129 B1 5/2002 Conrad
6,424,635 B1 7/2002 Song
6,442,272 B1 8/2002 Osovets
6,449,593 B1 9/2002 Valve
6,481,173 B1 11/2002 Roy
6,488,367 B1 12/2002 Debesis
D469,090 S 1/2003 Tsuji
6,505,057 B1 1/2003 Finn
6,507,659 B1 1/2003 Iredale
6,510,919 B1 1/2003 Roy
6,526,147 B1 2/2003 Rung
6,556,682 B1 4/2003 Gilloire
6,592,237 B1 7/2003 Pledger
6,622,030 B1 9/2003 Romesburg
D480,923 S 10/2003 Neubourg
6,633,647 B1 10/2003 Markow
6,665,971 B2 12/2003 Lowry
6,694,028 B1 2/2004 Matsuo
6,704,422 B1 3/2004 Jensen
D489,707 S 5/2004 Kobayashi
6,731,334 B1 5/2004 Maeng
6,741,720 B1 5/2004 Myatt
6,757,393 B1 6/2004 Spitzer
6,768,795 B2 7/2004 Jimen
6,868,377 B1 3/2005 Laroche
6,885,750 B2 4/2005 Egelmeers
6,885,986 B1 4/2005 Gigi
D504,889 S 5/2005 Andre
6,889,183 B1 5/2005 Gunduzhan
6,895,093 B1 5/2005 Ali
6,931,123 B1 8/2005 Hughes
6,944,312 B2 9/2005 Mason
D510,729 S 10/2005 Chen
6,968,064 B1 11/2005 Ning
6,990,193 B2 1/2006 Beaucoup
6,993,126 B1 1/2006 Kyrylenko
6,993,145 B2 1/2006 Combest
7,003,099 B1 2/2006 Zhang
7,013,267 B1 3/2006 Huart
7,031,269 B2 4/2006 Lee
7,035,398 B2 4/2006 Matsuo
7,035,415 B2 4/2006 Belt
7,050,576 B2 5/2006 Zhang
7,054,451 B2 5/2006 Janse
D526,643 S 8/2006 Ishizaki
D527,372 S 8/2006 Allen
7,092,516 B2 8/2006 Furuta
7,092,882 B2 8/2006 Arrowood
7,098,865 B2 * 8/2006 Christensen ..... H01Q 3/26 343/893
7,106,876 B2 9/2006 Santiago
7,120,269 B2 10/2006 Lowell
7,130,309 B2 10/2006 Boaz
D533,177 S 12/2006 Andre
7,149,320 B2 12/2006 Haykin
7,161,534 B2 1/2007 Tsai
7,187,765 B2 3/2007 Popovic
7,203,308 B2 4/2007 Kubota
D542,543 S 5/2007 Bruce
7,212,628 B2 5/2007 Mirjana
D546,318 S 7/2007 Yoon
D546,814 S 7/2007 Takita
D547,748 S 7/2007 Tsuge
7,239,714 B2 7/2007 de Blok
D549,673 S 8/2007 Niitsu
7,269,263 B2 9/2007 Dedieu
D552,570 S 10/2007 Niitsu
D559,553 S 1/2008 Mischel
7,333,476 B2 2/2008 LeBlanc
D566,685 S 4/2008 Koller
7,359,504 B1 4/2008 Reuss
7,366,310 B2 4/2008 Stinson
7,387,151 B1 6/2008 Payne
7,412,376 B2 8/2008 Florencio
7,415,117 B2 8/2008 Tashev
D578,509 S 10/2008 Thomas
D581,510 S 11/2008 Albano
D582,391 S 12/2008 Morimoto
D587,709 S 3/2009 Niitsu
D589,605 S 3/2009 Reedy
7,503,616 B2 3/2009 Linhard
7,515,719 B2 * 4/2009 Hooley ..... F41H 13/0081 381/18
7,536,769 B2 5/2009 Pedersen
D595,402 S 6/2009 Miyake
D595,736 S 7/2009 Son
7,558,381 B1 7/2009 Ali
7,565,949 B2 7/2009 Tojo
D601,585 S 10/2009 Andre
7,651,390 B1 1/2010 Profeta
7,660,428 B2 2/2010 Rodman
7,667,728 B2 2/2010 Kenoyer
7,672,445 B1 3/2010 Zhang
D613,338 S 4/2010 Marukos
7,701,110 B2 4/2010 Fukuda
7,702,116 B2 4/2010 Stone
D614,871 S 5/2010 Tang
7,724,891 B2 5/2010 Beaucoup
D617,441 S 6/2010 Koury
7,747,001 B2 6/2010 Kellermann
7,756,278 B2 7/2010 Moorer
7,783,063 B2 8/2010 Pocino
7,787,328 B2 8/2010 Chu
7,830,862 B2 11/2010 James
7,831,035 B2 11/2010 Stokes
7,831,036 B2 11/2010 Beaucoup
7,856,097 B2 12/2010 Tokuda
7,881,486 B1 2/2011 Killion
7,894,421 B2 2/2011 Kwan
D636,188 S 4/2011 Kim
7,925,006 B2 4/2011 Hirai
7,925,007 B2 4/2011 Stokes

(56) References Cited

U.S. PATENT DOCUMENTS 7,936,886 B2 * 5/2011 Kim ..... H04S 7/301 381/59
7,970,123 B2 6/2011 Beaucoup
7,970,151 B2 6/2011 Oxford
D642,385 S 8/2011 Lee
D643,015 S 8/2011 Kim
7,991,167 B2 8/2011 Oxford
7,995,768 B2 8/2011 Miki
8,000,481 B2 8/2011 Nishikawa
8,005,238 B2 8/2011 Tashev
8,019,091 B2 9/2011 Burnett
8,041,054 B2 10/2011 Yeldener
8,059,843 B2 11/2011 Hung
8,064,629 B2 11/2011 Jiang
8,085,947 B2 12/2011 Haulick
8,085,949 B2 12/2011 Kim
8,095,120 B1 1/2012 Blair
8,098,842 B2 1/2012 Florencio
8,098,844 B2 1/2012 Elko
8,103,030 B2 1/2012 Barthel
8,109,360 B2 2/2012 Stewart, Jr.
8,112,272 B2 2/2012 Nagahama
8,116,500 B2 2/2012 Oxford
8,121,834 B2 2/2012 Rosec
D655,271 S 3/2012 Park
D656,473 S 3/2012 Laube
8,130,969 B2 3/2012 Buck
8,130,977 B2 3/2012 Chu
8,135,143 B2 3/2012 Ishibashi
8,144,886 B2 3/2012 Ishibashi
D658,153 S 4/2012 Woo
8,155,331 B2 4/2012 Nakadai
8,170,882 B2 5/2012 Davis
8,175,291 B2 5/2012 Chan
8,175,871 B2 5/2012 Wang
8,184,801 B1 5/2012 Hamalainen
8,189,765 B2 5/2012 Nishikawa
8,189,810 B2 5/2012 Wolff
8,194,863 B2 * 6/2012 Takumai ..... H04S 3/00 381/27
8,199,927 B1 6/2012 Raftery
8,204,198 B2 6/2012 Adeney
8,204,248 B2 6/2012 Haulick
8,208,664 B2 6/2012 Iwasaki
8,213,596 B2 7/2012 Beaucoup
8,213,634 B1 7/2012 Daniel
8,219,387 B2 7/2012 Cutler
8,229,134 B2 7/2012 Duraiswami
8,233,352 B2 7/2012 Beaucoup
8,243,951 B2 8/2012 Ishibashi
8,244,536 B2 8/2012 Arun
8,249,273 B2 8/2012 Inoda
8,259,959 B2 9/2012 Marton
8,275,120 B2 9/2012 Stokes, III
8,280,728 B2 10/2012 Chen
8,284,949 B2 10/2012 Farhang
8,284,952 B2 10/2012 Reining
8,286,749 B2 10/2012 Stewart
8,290,142 B1 10/2012 Lambert
8,291,670 B2 10/2012 Gard
8,297,402 B2 10/2012 Stewart
8,315,380 B2 11/2012 Liu
8,331,582 B2 12/2012 Steele
8,345,898 B2 1/2013 Reining
8,355,521 B2 1/2013 Larson
8,370,140 B2 2/2013 Vitte
8,379,823 B2 2/2013 Ratmanski
8,385,557 B2 2/2013 Tashev
D678,329 S 3/2013 Lee
8,395,653 B2 3/2013 Feng
8,403,107 B2 3/2013 Stewart
8,406,436 B2 3/2013 Craven
8,428,661 B2 4/2013 Chen
8,433,061 B2 4/2013 Cutler
D682,266 S 5/2013 Wu
8,437,490 B2 5/2013 Marton
8,443,930 B2 5/2013 Stewart, Jr.
8,447,590 B2 5/2013 Ishibashi
8,472,639 B2 6/2013 Reining
8,472,640 B2 6/2013 Marton
D685,346 S 7/2013 Szymanski
D686,182 S 7/2013 Ashiwa
8,479,871 B2 7/2013 Stewart
8,483,398 B2 7/2013 Fozunbal
8,498,423 B2 7/2013 Thaden
D687,432 S 8/2013 Duan
8,503,653 B2 8/2013 Ahuja
8,515,089 B2 8/2013 Nicholson
8,515,109 B2 8/2013 Dittberner
8,526,633 B2 9/2013 Ukai
8,553,904 B2 10/2013 Said
8,559,611 B2 10/2013 Ratmanski
D693,328 S 11/2013 Goetzen
8,583,481 B2 11/2013 Viveiros
8,599,194 B2 12/2013 Lewis
8,600,443 B2 12/2013 Kawaguchi
8,605,890 B2 12/2013 Zhang
8,620,650 B2 12/2013 Walters
8,631,897 B2 1/2014 Stewart
8,634,569 B2 1/2014 Lu
8,638,951 B2 1/2014 Zurek
D699,712 S 2/2014 Bourne
8,644,477 B2 2/2014 Gilbert
8,654,955 B1 2/2014 Lambert
8,654,990 B2 2/2014 Faller
8,660,274 B2 2/2014 Wolff
8,660,275 B2 2/2014 Buck
8,670,581 B2 3/2014 Harman
8,672,087 B2 3/2014 Stewart
8,675,890 B2 3/2014 Schmidt
8,675,899 B2 3/2014 Jung
8,676,728 B1 3/2014 Velusamy
8,682,675 B2 3/2014 Togami
8,724,829 B2 5/2014 Visser
8,730,156 B2 5/2014 Weising
8,744,069 B2 6/2014 Cutler
8,744,101 B1 6/2014 Burns
8,755,536 B2 6/2014 Chen
8,811,601 B2 8/2014 Mohammad
8,818,002 B2 8/2014 Tashev
8,824,693 B2 9/2014 Per
8,842,851 B2 9/2014 Beaucoup
8,855,326 B2 10/2014 Derkx
8,855,327 B2 10/2014 Tanaka
8,861,713 B2 10/2014 Xu
8,861,756 B2 10/2014 Zhu
8,873,789 B2 10/2014 Bigeh
D717,272 S 11/2014 Kim
8,886,343 B2 11/2014 Ishibashi
8,893,849 B2 11/2014 Hudson
8,898,633 B2 11/2014 Bryant
D718,731 S 12/2014 Lee
8,903,106 B2 12/2014 Meyer
8,923,529 B2 12/2014 Mccowan
8,929,564 B2 1/2015 Kikkeri
8,942,382 B2 1/2015 Elko
8,965,546 B2 2/2015 Visser
D725,059 S 3/2015 Kim
D725,631 S 3/2015 McNamara
8,976,977 B2 3/2015 De
8,983,089 B1 3/2015 Chu
8,983,834 B2 3/2015 Davis
D726,144 S 4/2015 Kang
D727,968 S 4/2015 Onoue
9,002,028 B2 4/2015 Haulick
D729,767 S 5/2015 Lee
9,038,301 B2 5/2015 Zelbacher
9,088,336 B2 7/2015 Mani
9,094,496 B2 7/2015 Teutsch
D735,717 S 8/2015 Lam
D737,245 S 8/2015 Fan
9,099,094 B2 8/2015 Burnett
9,107,001 B2 8/2015 Diethorn
9,111,543 B2 8/2015 Per

(56) References Cited

U.S. PATENT DOCUMENTS

| | | | |
|---|---|---|---|
| 9,113,242 | B2 | 8/2015 | Hyun |
| 9,113,247 | B2 | 8/2015 | Chatlani |
| 9,126,827 | B2 | 9/2015 | Hsieh |
| 9,129,223 | B1 | 9/2015 | Velusamy |
| 9,140,054 | B2 | 9/2015 | Oberbroeckling |
| D740,279 | S | 10/2015 | Wu |
| 9,172,345 | B2 | 10/2015 | Kok |
| D743,376 | S | 11/2015 | Kim |
| D743,939 | S | 11/2015 | Seong |
| 9,196,261 | B2 | 11/2015 | Burnett |
| 9,197,974 | B1 | 11/2015 | Clark |
| 9,203,494 | B2 | 12/2015 | Tarighat Mehrabani |
| 9,215,327 | B2 | 12/2015 | Bathurst |
| 9,215,543 | B2 | 12/2015 | Sun |
| 9,226,062 | B2 | 12/2015 | Sun |
| 9,226,070 | B2 | 12/2015 | Hyun |
| 9,226,088 | B2 | 12/2015 | Pandey |
| 9,232,185 | B2 | 1/2016 | Graham |
| 9,237,391 | B2 | 1/2016 | Benesty |
| 9,247,367 | B2 | 1/2016 | Nobile |
| 9,253,567 | B2 | 2/2016 | Morcelli |
| 9,257,132 | B2 | 2/2016 | Gowreesunker |
| 9,264,553 | B2 | 2/2016 | Pandey |
| 9,264,805 | B2 | 2/2016 | Buck |
| 9,280,985 | B2 | 3/2016 | Tawada |
| 9,286,908 | B2 | 3/2016 | Zhang |
| 9,294,839 | B2 | 3/2016 | Lambert |
| 9,301,049 | B2 | 3/2016 | Elko |
| D754,103 | S | 4/2016 | Fischer |
| 9,307,326 | B2 | 4/2016 | Elko |
| 9,319,532 | B2 | 4/2016 | Bao |
| 9,319,799 | B2 | 4/2016 | Salmon |
| 9,326,060 | B2 | 4/2016 | Nicholson |
| D756,502 | S | 5/2016 | Lee |
| 9,330,673 | B2 | 5/2016 | Cho |
| 9,338,301 | B2 | 5/2016 | Pocino |
| 9,338,549 | B2 | 5/2016 | Haulick |
| 9,354,310 | B2 | 5/2016 | Visser |
| 9,357,080 | B2 | 5/2016 | Beaucoup |
| 9,403,670 | B2 | 8/2016 | Schelling |
| 9,426,598 | B2 | 8/2016 | Walsh |
| D767,748 | S | 9/2016 | Nakai |
| 9,451,078 | B2 | 9/2016 | Yang |
| D769,239 | S | 10/2016 | Li |
| 9,462,378 | B2 | 10/2016 | Kuech |
| 9,473,868 | B2 | 10/2016 | Huang |
| 9,479,627 | B1 | 10/2016 | Rung |
| 9,479,885 | B1 | 10/2016 | Ivanov |
| 9,489,948 | B1 | 11/2016 | Chu |
| 9,510,090 | B2 | 11/2016 | Lissek |
| 9,514,723 | B2 | 12/2016 | Silfvast |
| 9,516,412 | B2 | 12/2016 | Shigenaga |
| 9,521,057 | B2 | 12/2016 | Klingbeil |
| 9,549,245 | B2 | 1/2017 | Henry |
| 9,560,446 | B1 | 1/2017 | Chang |
| 9,560,451 | B2 | 1/2017 | Eichfeld |
| 9,565,493 | B2 | 2/2017 | Abraham |
| 9,578,413 | B2 | 2/2017 | Sawa |
| 9,578,440 | B2 | 2/2017 | Otto |
| 9,589,556 | B2 | 3/2017 | Gao |
| 9,591,123 | B2 | 3/2017 | Sorensen |
| 9,591,404 | B1 | 3/2017 | Chhetri |
| D784,299 | S | 4/2017 | Cho |
| 9,615,173 | B2 | 4/2017 | Sako |
| 9,628,596 | B1 | 4/2017 | Bullough |
| 9,635,186 | B2 | 4/2017 | Pandey |
| 9,635,474 | B2 | 4/2017 | Kuster |
| D787,481 | S | 5/2017 | Tyssjorunn |
| D788,073 | S | 5/2017 | Silvera |
| 9,640,187 | B2 | 5/2017 | Niemisto |
| 9,641,688 | B2 | 5/2017 | Pandey |
| 9,641,929 | B2 | 5/2017 | Li |
| 9,641,935 | B1 | 5/2017 | Ivanov |
| 9,653,091 | B2 | 5/2017 | Matsuo |
| 9,653,092 | B2 | 5/2017 | Sun |
| 9,655,001 | B2 | 5/2017 | Metzger |
| 9,659,576 | B1 | 5/2017 | Kotvis |
| D789,323 | S | 6/2017 | Mackiewicz |
| 9,674,604 | B2 | 6/2017 | Deroo |
| 9,692,882 | B2 | 6/2017 | Mani |
| 9,706,057 | B2 | 7/2017 | Mani |
| 9,716,944 | B2 | 7/2017 | Yliaho |
| 9,721,582 | B1 | 8/2017 | Huang |
| 9,734,835 | B2 | 8/2017 | Fujieda |
| 9,754,572 | B2 | 9/2017 | Salazar |
| 9,761,243 | B2 | 9/2017 | Taenzer |
| D801,285 | S | 10/2017 | Timmins |
| 9,788,119 | B2 | 10/2017 | Vilermo |
| 9,813,806 | B2 | 11/2017 | Graham |
| 9,818,426 | B2 | 11/2017 | Kotera |
| 9,826,211 | B2 | 11/2017 | Sawa |
| 9,854,101 | B2 | 12/2017 | Pandey |
| 9,854,363 | B2 | 12/2017 | Sladeczek |
| 9,860,439 | B2 | 1/2018 | Sawa |
| 9,866,952 | B2 | 1/2018 | Pandey |
| D811,393 | S | 2/2018 | Ahn |
| 9,894,434 | B2 | 2/2018 | Rollow, IV |
| 9,930,448 | B1 | 3/2018 | Chen |
| 9,936,290 | B2 | 4/2018 | Mohammad |
| 9,966,059 | B1 | 5/2018 | Ayrapetian |
| 9,973,848 | B2 | 5/2018 | Chhetri |
| 9,980,042 | B1 | 5/2018 | Benattar |
| D819,607 | S | 6/2018 | Chui |
| D819,631 | S | 6/2018 | Matsumiya |
| 10,015,589 | B1 | 7/2018 | Ponvarma |
| 10,021,506 | B2 | 7/2018 | Johnson |
| 10,021,515 | B1 | 7/2018 | Mallya |
| 10,034,116 | B2 | 7/2018 | Kadri |
| 10,054,320 | B2 | 8/2018 | Choi |
| 10,153,744 | B1 | 12/2018 | Every |
| 10,165,386 | B2 | 12/2018 | Lehtiniemi |
| D841,589 | S | 2/2019 | Andreas |
| 10,206,030 | B2 | 2/2019 | Matsumoto |
| 10,210,882 | B1 | 2/2019 | McCowan |
| 10,231,062 | B2 | 3/2019 | Pedersen |
| 10,244,121 | B2 | 3/2019 | Mani |
| 10,244,219 | B2 | 3/2019 | Sawa |
| 10,269,343 | B2 | 4/2019 | Wingate |
| 10,367,948 | B2 | 7/2019 | Wells-Rutherford |
| D857,873 | S | 8/2019 | Shimada |
| 10,389,861 | B2 | 8/2019 | Mani |
| 10,389,885 | B2 | 8/2019 | Sun |
| D860,319 | S | 9/2019 | Beruto |
| D860,997 | S | 9/2019 | Jhun |
| D864,136 | S | 10/2019 | Kim |
| 10,440,469 | B2 | 10/2019 | Barnett |
| D865,723 | S | 11/2019 | Cho |
| 10,566,008 | B2 | 2/2020 | Thorpe |
| 10,602,267 | B2 | 3/2020 | Grosche |
| D883,952 | S | 5/2020 | Lucas |
| 10,650,797 | B2 | 5/2020 | Kumar |
| D888,020 | S | 6/2020 | Lyu |
| 10,728,653 | B2 | 7/2020 | Graham |
| D900,070 | S | 10/2020 | Lantz |
| D900,071 | S | 10/2020 | Lantz |
| D900,072 | S | 10/2020 | Lantz |
| D900,073 | S | 10/2020 | Lantz |
| D900,074 | S | 10/2020 | Lantz |
| 10,827,263 | B2 | 11/2020 | Christoph |
| 10,863,270 | B1 | 12/2020 | Cornelius |
| 10,930,297 | B2 | 2/2021 | Christoph |
| 10,959,018 | B1 | 3/2021 | Shi |
| 10,979,805 | B2 | 4/2021 | Chowdhary |
| D924,189 | S | 7/2021 | Park |
| 11,109,133 | B2 | 8/2021 | Lantz |
| D940,116 | S | 1/2022 | Cho |
| 2001/0031058 | A1 | 10/2001 | Anderson |
| 2002/0015500 | A1 | 2/2002 | Belt |
| 2002/0041679 | A1 | 4/2002 | Beaucoup |
| 2002/0048377 | A1 | 4/2002 | Vaudrey |
| 2002/0064158 | A1 | 5/2002 | Yokoyama |
| 2002/0064287 | A1 | 5/2002 | Kawamura |
| 2002/0069054 | A1 | 6/2002 | Arrowood |
| 2002/0110255 | A1 | 8/2002 | Killion |

(56) References Cited

U.S. PATENT DOCUMENTS

2002/0126861 A1 9/2002 Colby
2002/0131580 A1 9/2002 Smith
2002/0140633 A1 10/2002 Abbas
2002/0146282 A1 10/2002 Wilkes
2002/0149070 A1 10/2002 Sheplak
2002/0159603 A1 10/2002 Hirai
2003/0026437 A1 2/2003 Janse
2003/0053639 A1 3/2003 Beaucoup
2003/0059061 A1 3/2003 Tsuji
2003/0063762 A1 4/2003 Tajima
2003/0063768 A1 4/2003 Cornelius
2003/0072461 A1 4/2003 Moorer
2003/0107478 A1 6/2003 Hendricks
2003/0118200 A1 6/2003 Beaucoup
2003/0122777 A1 7/2003 Grover
2003/0138119 A1 7/2003 Pocino
2003/0156725 A1 8/2003 Boone
2003/0161485 A1 8/2003 Smith
2003/0163326 A1 8/2003 Maase
2003/0169888 A1 9/2003 Subotic
2003/0185404 A1 10/2003 Milsap
2003/0198339 A1 10/2003 Roy
2003/0198359 A1 10/2003 Killion
2003/0202107 A1 10/2003 Slattery
2004/0013038 A1 1/2004 Kajala
2004/0013252 A1 1/2004 Craner
2004/0076305 A1 4/2004 Santiago
2004/0105557 A1 6/2004 Matsuo
2004/0125942 A1 7/2004 Beaucoup
2004/0175006 A1 9/2004 Kim
2004/0202345 A1 10/2004 Stenberg
2004/0240664 A1 12/2004 Freed
2005/0005494 A1 1/2005 Way
2005/0041530 A1 2/2005 Goudie
2005/0069156 A1 3/2005 Haapapuro
2005/0094580 A1 5/2005 Kumar
2005/0094795 A1 5/2005 Rambo
2005/0149320 A1 7/2005 Kajala
2005/0157897 A1 7/2005 Saltykov
2005/0175189 A1 8/2005 Lee
2005/0175190 A1 8/2005 Tashev
2005/0213747 A1 9/2005 Popovich
2005/0221867 A1* 10/2005 Zurek ..... H04R 1/323
455/569.1
2005/0238196 A1 10/2005 Furuno
2005/0270906 A1 12/2005 Ramenzoni
2005/0271221 A1 12/2005 Cerwin
2005/0286698 A1 12/2005 Bathurst
2005/0286729 A1 12/2005 Harwood
2006/0083390 A1 4/2006 Kaderavek
2006/0088173 A1 4/2006 Rodman
2006/0093128 A1 5/2006 Oxford
2006/0098403 A1 5/2006 Smith
2006/0104458 A1 5/2006 Kenoyer
2006/0109983 A1 5/2006 Young
2006/0151256 A1 7/2006 Lee
2006/0159293 A1 7/2006 Azima
2006/0161430 A1 7/2006 Schweng
2006/0165242 A1 7/2006 Miki
2006/0192976 A1 8/2006 Hall
2006/0198541 A1 9/2006 Henry
2006/0204022 A1 9/2006 Hooley
2006/0215866 A1 9/2006 Francisco
2006/0222187 A1 10/2006 Jarrett
2006/0233353 A1 10/2006 Beaucoup
2006/0239471 A1 10/2006 Mao
2006/0262942 A1 11/2006 Oxford
2006/0269080 A1 11/2006 Oxford
2006/0269086 A1 11/2006 Page
2007/0006474 A1 1/2007 Taniguchi
2007/0009116 A1 1/2007 Reining
2007/0019828 A1 1/2007 Hughes
2007/0053524 A1 3/2007 Haulick
2007/0093714 A1 4/2007 Beaucoup
2007/0116255 A1 5/2007 Derkx
2007/0120029 A1 5/2007 Keung
2007/0165871 A1 7/2007 Roovers
2007/0230712 A1 10/2007 Belt
2007/0253561 A1 11/2007 Williams
2007/0269066 A1 11/2007 Derleth
2008/0008339 A1 1/2008 Ryan
2008/0033723 A1 2/2008 Jang
2008/0046235 A1 2/2008 Chen
2008/0056517 A1 3/2008 Algazi
2008/0101622 A1 5/2008 Sugiyama
2008/0130907 A1 6/2008 Sudo
2008/0144848 A1 6/2008 Buck
2008/0168283 A1 7/2008 Penning
2008/0188965 A1 8/2008 Bruey
2008/0212805 A1 9/2008 Fincham
2008/0232607 A1 9/2008 Tashev
2008/0247567 A1 10/2008 Kjolerbakken
2008/0253553 A1 10/2008 Li
2008/0253589 A1 10/2008 Trahms
2008/0259731 A1 10/2008 Happonen
2008/0260175 A1 10/2008 Elko
2008/0279400 A1 11/2008 Knoll
2008/0285772 A1 11/2008 Haulick
2009/0003586 A1 1/2009 Lai
2009/0030536 A1 1/2009 Gur
2009/0052684 A1 2/2009 Ishibashi
2009/0086998 A1 4/2009 Jeong
2009/0087000 A1 4/2009 Ko
2009/0087001 A1 4/2009 Jiang
2009/0094817 A1 4/2009 Killion
2009/0129609 A1 5/2009 Oh
2009/0147967 A1 6/2009 Ishibashi
2009/0150149 A1 6/2009 Cutter
2009/0161880 A1 6/2009 Hooley
2009/0169027 A1 7/2009 Ura
2009/0173030 A1 7/2009 Gulbrandsen
2009/0173570 A1 7/2009 Levit
2009/0226004 A1 9/2009 Moeller
2009/0233545 A1 9/2009 Sutskover
2009/0237561 A1 9/2009 Kobayashi
2009/0254340 A1 10/2009 Sun
2009/0274318 A1 11/2009 Ishibashi
2009/0310794 A1 12/2009 Ishibashi
2010/0011644 A1 1/2010 Kramer
2010/0034397 A1 2/2010 Nakadai
2010/0074433 A1* 3/2010 Zhang ..... H04M 9/082
379/406.08
2010/0111323 A1 5/2010 Marton
2010/0111324 A1 5/2010 Yeldener
2010/0119097 A1 5/2010 Ohtsuka
2010/0123785 A1 5/2010 Chen
2010/0128892 A1 5/2010 Chen
2010/0128901 A1 5/2010 Herman
2010/0131749 A1 5/2010 Kim
2010/0142721 A1 6/2010 Wada
2010/0150364 A1 6/2010 Buck
2010/0158268 A1 6/2010 Marton
2010/0165071 A1 7/2010 Ishibashi
2010/0166219 A1 7/2010 Marton
2010/0189275 A1 7/2010 Christoph
2010/0189299 A1 7/2010 Grant
2010/0202628 A1 8/2010 Meyer
2010/0208605 A1 8/2010 Wang
2010/0215184 A1 8/2010 Buck
2010/0215189 A1 8/2010 Marton
2010/0217590 A1 8/2010 Nemer
2010/0245624 A1 9/2010 Beaucoup
2010/0246873 A1 9/2010 Chen
2010/0284185 A1 11/2010 Ngai
2010/0305728 A1 12/2010 Aiso
2010/0314513 A1 12/2010 Evans
2011/0002469 A1 1/2011 Ojala
2011/0007921 A1 1/2011 Stewart
2011/0033063 A1 2/2011 Mcgrath
2011/0038229 A1 2/2011 Beaucoup
2011/0096136 A1 4/2011 Liu
2011/0096631 A1 4/2011 Kondo
2011/0096915 A1 4/2011 Nemer
2011/0164761 A1 7/2011 Mccowan

(56) References Cited

U.S. PATENT DOCUMENTS

2011/0194719 A1 8/2011 Frater
2011/0211706 A1 9/2011 Tanaka
2011/0235821 A1 9/2011 Okita
2011/0268287 A1 11/2011 Ishibashi
2011/0311064 A1 12/2011 Teutsch
2011/0311085 A1 12/2011 Stewart
2011/0317862 A1 12/2011 Hosoe
2012/0002835 A1 1/2012 Stewart
2012/0014049 A1 1/2012 Ogle
2012/0027227 A1 2/2012 Kok
2012/0076316 A1 3/2012 Zhu
2012/0080260 A1 4/2012 Stewart
2012/0093344 A1 4/2012 Sun
2012/0117474 A1 5/2012 Miki
2012/0128160 A1 5/2012 Kim
2012/0128175 A1 5/2012 Visser
2012/0155688 A1 6/2012 Wilson
2012/0155703 A1 6/2012 Hernandez-Abrego
2012/0163625 A1 6/2012 Siotis
2012/0169826 A1 7/2012 Jeong
2012/0177219 A1 7/2012 Mullen
2012/0182429 A1 7/2012 Forutanpour
2012/0207335 A1 8/2012 Spaanderman
2012/0224709 A1 9/2012 Keddem
2012/0243698 A1 9/2012 Elko
2012/0262536 A1 10/2012 Chen
2012/0288079 A1 11/2012 Burnett
2012/0288114 A1 11/2012 Duraiswami
2012/0294472 A1 11/2012 Hudson
2012/0327115 A1 12/2012 Chhetri
2012/0328142 A1 12/2012 Horibe
2013/0002797 A1 1/2013 Thapa
2013/0004013 A1 1/2013 Stewart
2013/0015014 A1 1/2013 Stewart
2013/0016847 A1 1/2013 Steiner
2013/0028451 A1 1/2013 De Roo
2013/0029684 A1 1/2013 Kawaguchi
2013/0034241 A1 2/2013 Pandey
2013/0039504 A1 2/2013 Pandey
2013/0083911 A1 4/2013 Bathurst
2013/0094689 A1 4/2013 Tanaka
2013/0101141 A1 4/2013 McElveen
2013/0136274 A1 5/2013 Per
2013/0142343 A1 6/2013 Matsui
2013/0147835 A1 6/2013 Lee
2013/0156198 A1 6/2013 Kim
2013/0182190 A1* 7/2013 McCartney ..... H04N 7/08
348/730
2013/0206501 A1 8/2013 Yu
2013/0216066 A1 8/2013 Yerrace
2013/0226593 A1 8/2013 Magnusson
2013/0251181 A1 9/2013 Stewart
2013/0264144 A1 10/2013 Hudson
2013/0271559 A1 10/2013 Feng
2013/0294616 A1 11/2013 Hans
2013/0297302 A1 11/2013 Pan
2013/0304476 A1 11/2013 Kim
2013/0304479 A1 11/2013 Teller
2013/0329908 A1 12/2013 Lindahl
2013/0332156 A1 12/2013 Tackin
2013/0336516 A1 12/2013 Stewart
2013/0343549 A1 12/2013 Vemireddy
2014/0003635 A1 1/2014 Mohammad
2014/0010383 A1 1/2014 Mackey
2014/0016794 A1 1/2014 Lu
2014/0029761 A1 1/2014 Maenpaa
2014/0037097 A1 2/2014 Mark
2014/0050332 A1 2/2014 Nielsen
2014/0072151 A1 3/2014 Ochs
2014/0098233 A1 4/2014 Martin
2014/0098964 A1 4/2014 Rosca
2014/0122060 A1 5/2014 Kaszczuk
2014/0177857 A1 6/2014 Kuster
2014/0233777 A1 8/2014 Tseng
2014/0233778 A1 8/2014 Hardiman
2014/0264654 A1 9/2014 Salmon
2014/0265774 A1 9/2014 Stewart
2014/0270271 A1 9/2014 Dehe
2014/0286518 A1 9/2014 Stewart
2014/0295768 A1 10/2014 Wu
2014/0301586 A1 10/2014 Stewart
2014/0307882 A1 10/2014 Leblanc
2014/0314251 A1 10/2014 Rosca
2014/0341392 A1 11/2014 Lambert
2014/0357177 A1 12/2014 Stewart
2014/0363008 A1 12/2014 Chen
2015/0003638 A1 1/2015 Kasai
2015/0025878 A1 1/2015 Gowreesunker
2015/0030172 A1 1/2015 Gaensler
2015/0033042 A1 1/2015 Iwamoto
2015/0050967 A1 2/2015 Bao
2015/0055796 A1 2/2015 Nugent
2015/0055797 A1 2/2015 Nguyen
2015/0063579 A1 3/2015 Bao
2015/0070188 A1 3/2015 Aramburu
2015/0078581 A1 3/2015 Etter
2015/0078582 A1 3/2015 Graham
2015/0097719 A1 4/2015 Balachandreswaran
2015/0104023 A1 4/2015 Bilobrov
2015/0117672 A1 4/2015 Christoph
2015/0118960 A1 4/2015 Petit
2015/0126255 A1 5/2015 Yang
2015/0156578 A1 6/2015 Alexandridis
2015/0163577 A1 6/2015 Benesty
2015/0185825 A1 7/2015 Mullins
2015/0189423 A1 7/2015 Giannuzzi
2015/0208171 A1 7/2015 Funakoshi
2015/0237424 A1 8/2015 Wilker
2015/0281832 A1 10/2015 Kishimoto
2015/0281833 A1 10/2015 Shigenaga
2015/0281834 A1 10/2015 Takano
2015/0312662 A1 10/2015 Kishimoto
2015/0312691 A1 10/2015 Virolainen
2015/0326968 A1 11/2015 Shigenaga
2015/0341734 A1 11/2015 Sherman
2015/0350621 A1 12/2015 Sawa
2015/0358734 A1 12/2015 Butler
2016/0011851 A1 1/2016 Zhang
2016/0021478 A1 1/2016 Katagiri
2016/0029120 A1 1/2016 Nesta
2016/0031700 A1 2/2016 Sparks
2016/0037277 A1 2/2016 Matsumoto
2016/0055859 A1 2/2016 Finlow-Bates
2016/0080867 A1 3/2016 Nugent
2016/0088392 A1 3/2016 Huttunen
2016/0100092 A1 4/2016 Bohac
2016/0105473 A1 4/2016 Klingbeil
2016/0111109 A1 4/2016 Tsujikawa
2016/0127527 A1 5/2016 Mani
2016/0134928 A1 5/2016 Ogle
2016/0142548 A1 5/2016 Pandey
2016/0142814 A1 5/2016 Deroo
2016/0142815 A1 5/2016 Norris
2016/0148057 A1 5/2016 Oh
2016/0150315 A1 5/2016 Tzirkel-Hancock
2016/0150316 A1 5/2016 Kubota
2016/0155455 A1 6/2016 Petteri
2016/0165340 A1 6/2016 Benattar
2016/0173976 A1 6/2016 Podhradsky
2016/0173978 A1 6/2016 Li
2016/0189727 A1 6/2016 Wu
2016/0192068 A1 6/2016 Ng
2016/0196836 A1 7/2016 Yu
2016/0234593 A1 8/2016 Matsumoto
2016/0275961 A1 9/2016 Yu
2016/0295279 A1 10/2016 Srinivasan
2016/0300584 A1 10/2016 Pandey
2016/0302002 A1 10/2016 Lambert
2016/0302006 A1 10/2016 Pandey
2016/0323667 A1 11/2016 Shumard
2016/0323668 A1* 11/2016 Abraham ..... H04R 1/406
2016/0330545 A1 11/2016 Mcelveen
2016/0337523 A1 11/2016 Pandey
2016/0353200 A1 12/2016 Bigeh

(56) References Cited

U.S. PATENT DOCUMENTS

| | | | |
|---|---|---|---|
| 2016/0357508 | A1 | 12/2016 | Moore |
| 2017/0019744 | A1 | 1/2017 | Matsumoto |
| 2017/0064451 | A1 | 3/2017 | Park |
| 2017/0105066 | A1 | 4/2017 | Mclaughlin |
| 2017/0134849 | A1 | 5/2017 | Pandey |
| 2017/0134850 | A1 | 5/2017 | Graham |
| 2017/0164101 | A1 | 6/2017 | Rollow, IV |
| 2017/0180861 | A1 | 6/2017 | Chen |
| 2017/0206064 | A1 | 7/2017 | Breazeal |
| 2017/0230748 | A1 | 8/2017 | Shumard |
| 2017/0264999 | A1 | 9/2017 | Fukuda |
| 2017/0303887 | A1 | 10/2017 | Richmond |
| 2017/0308352 | A1 | 10/2017 | Kessler |
| 2017/0374454 | A1 | 12/2017 | Bernardini |
| 2018/0083848 | A1 | 3/2018 | Siddiqi |
| 2018/0102136 | A1 | 4/2018 | Ebenezer |
| 2018/0109873 | A1 | 4/2018 | Xiang |
| 2018/0115799 | A1 | 4/2018 | Thiele |
| 2018/0160224 | A1 | 6/2018 | Graham |
| 2018/0196585 | A1 | 7/2018 | Densham |
| 2018/0219922 | A1 | 8/2018 | Bryans |
| 2018/0227666 | A1 | 8/2018 | Barnett |
| 2018/0292079 | A1 | 10/2018 | Branham |
| 2018/0310096 | A1 | 10/2018 | Shumard |
| 2018/0313558 | A1 | 11/2018 | Byers |
| 2018/0338205 | A1 | 11/2018 | Abraham |
| 2018/0359565 | A1 | 12/2018 | Kim |
| 2019/0042187 | A1 | 2/2019 | Truong |
| 2019/0166424 | A1 | 5/2019 | Harney |
| 2019/0215540 | A1 | 7/2019 | Nicol |
| 2019/0230436 | A1 | 7/2019 | Tsingos |
| 2019/0259408 | A1 | 8/2019 | Freeman |
| 2019/0268683 | A1 | 8/2019 | Miyahara |
| 2019/0295540 | A1 | 9/2019 | Grima |
| 2019/0295569 | A1 | 9/2019 | Wang |
| 2019/0319677 | A1 | 10/2019 | Hansen |
| 2019/0371354 | A1 | 12/2019 | Lester |
| 2019/0373362 | A1 | 12/2019 | Ansai |
| 2019/0385629 | A1 | 12/2019 | Moravy |
| 2019/0387311 | A1 | 12/2019 | Schultz |
| 2020/0015021 | A1 | 1/2020 | Leppanen |
| 2020/0021910 | A1 | 1/2020 | Rollow, IV |
| 2020/0037068 | A1 | 1/2020 | Barnett |
| 2020/0068297 | A1 | 2/2020 | Rollow, IV |
| 2020/0100009 | A1 | 3/2020 | Lantz |
| 2020/0100025 | A1 | 3/2020 | Shumard |
| 2020/0137485 | A1 | 4/2020 | Yamakawa |
| 2020/0145753 | A1 | 5/2020 | Rollow, IV |
| 2020/0152218 | A1 | 5/2020 | Kikuhara |
| 2020/0162618 | A1 | 5/2020 | Enteshari |
| 2020/0228663 | A1 | 7/2020 | Wells-Rutherford |
| 2020/0251119 | A1 | 8/2020 | Yang |
| 2020/0275204 | A1 | 8/2020 | Labosco |
| 2020/0278043 | A1 | 9/2020 | Cao |
| 2020/0288237 | A1 | 9/2020 | Abraham |
| 2021/0012789 | A1 | 1/2021 | Husain |
| 2021/0021940 | A1 | 1/2021 | Petersen |
| 2021/0044881 | A1 | 2/2021 | Lantz |
| 2021/0051397 | A1 | 2/2021 | Veselinovic |
| 2021/0098014 | A1 | 4/2021 | Tanaka |
| 2021/0098015 | A1 | 4/2021 | Pandey |
| 2021/0120335 | A1 | 4/2021 | Veselinovic |
| 2021/0200504 | A1 | 7/2021 | Park |
| 2021/0375298 | A1 | 12/2021 | Zhang |

FOREIGN PATENT DOCUMENTS

| | | | |
|---|---|---|---|
| CA | 2505496 | | 10/2006 |
| CA | 2838856 | A1 | 12/2012 |
| CA | 2846323 | A1 | 9/2014 |
| CN | 1780495 | | 5/2006 |
| CN | 101217830 | | 7/2008 |
| CN | 101833954 | | 9/2010 |
| CN | 101860776 | | 10/2010 |
| CN | 101894558 | | 11/2010 |
| CN | 102646418 | | 8/2012 |
| CN | 102821336 | | 12/2012 |
| CN | 102833664 | A | 12/2012 |
| CN | 102860039 | | 1/2013 |
| CN | 104036784 | | 9/2014 |
| CN | 104053088 | | 9/2014 |
| CN | 104080289 | A | 10/2014 |
| CN | 104347076 | | 2/2015 |
| CN | 104581463 | | 4/2015 |
| CN | 105355210 | | 2/2016 |
| CN | 105548998 | | 5/2016 |
| CN | 106162427 | | 11/2016 |
| CN | 106251857 | | 12/2016 |
| CN | 106851036 | | 6/2017 |
| CN | 107221336 | | 9/2017 |
| CN | 107534725 | | 1/2018 |
| CN | 108172235 | | 6/2018 |
| CN | 109087664 | | 12/2018 |
| CN | 208190895 | | 12/2018 |
| CN | 109727604 | | 5/2019 |
| CN | 110010147 | | 7/2019 |
| CN | 306391029 | | 3/2021 |
| DE | 2941485 | | 4/1981 |
| EM | 0077546430001 | | 3/2020 |
| EP | 0381498 | | 8/1990 |
| EP | 0594098 | | 4/1994 |
| EP | 0869697 | | 10/1998 |
| EP | 1180914 | | 2/2002 |
| EP | 1184676 | | 3/2002 |
| EP | 0944228 | | 6/2003 |
| EP | 1439526 | | 7/2004 |
| EP | 1651001 | | 4/2006 |
| EP | 1727344 | | 11/2006 |
| EP | 1906707 | | 4/2008 |
| EP | 1952393 | | 8/2008 |
| EP | 1962547 | | 8/2008 |
| EP | 2133867 | | 12/2009 |
| EP | 2159789 | | 3/2010 |
| EP | 2197219 | | 6/2010 |
| EP | 2360940 | | 8/2011 |
| EP | 2710788 | | 3/2014 |
| EP | 2721837 | A1 | 4/2014 |
| EP | 2772910 | | 9/2014 |
| EP | 2778310 | A1 | 9/2014 |
| EP | 2942975 | | 11/2015 |
| EP | 2988527 | | 2/2016 |
| EP | 3131311 | | 2/2017 |
| GB | 2393601 | | 3/2004 |
| GB | 2446620 | | 8/2008 |
| JP | S63144699 | | 6/1988 |
| JP | H01260967 | | 10/1989 |
| JP | H0241099 | | 2/1990 |
| JP | H05260589 | | 10/1993 |
| JP | H07336790 | | 12/1995 |
| JP | 2518823 | | 7/1996 |
| JP | 3175622 | | 6/2001 |
| JP | 2003060530 | | 2/2003 |
| JP | 2003087890 | | 3/2003 |
| JP | 2004349806 | | 12/2004 |
| JP | 2004537232 | | 12/2004 |
| JP | 2005323084 | | 11/2005 |
| JP | 2006094389 | | 4/2006 |
| JP | 2006101499 | | 4/2006 |
| JP | 4120646 | | 8/2006 |
| JP | 4258472 | | 8/2006 |
| JP | 4196956 | | 9/2006 |
| JP | 2006340151 | | 12/2006 |
| JP | 4760160 | | 1/2007 |
| JP | 4752403 | | 3/2007 |
| JP | 2007089058 | | 4/2007 |
| JP | 4867579 | | 6/2007 |
| JP | 2007208503 | | 8/2007 |
| JP | 2007228069 | | 9/2007 |
| JP | 2007228070 | | 9/2007 |
| JP | 2007274131 | | 10/2007 |
| JP | 2007274463 | | 10/2007 |
| JP | 2007288679 | | 11/2007 |
| JP | 2008005347 | | 1/2008 |
| JP | 2008042754 | | 2/2008 |

(56) References Cited

FOREIGN PATENT DOCUMENTS

| | | | | |
|---|---|---|---|---|
| JP | 2008154056 | | 7/2008 | |
| JP | 2008259022 | | 10/2008 | |
| JP | 2008263336 | | 10/2008 | |
| JP | 2008312002 | | 12/2008 | |
| JP | 2009206671 | | 9/2009 | |
| JP | 2010028653 | | 2/2010 | |
| JP | 2010114554 | | 5/2010 | |
| JP | 2010268129 | | 11/2010 | |
| JP | 2011015018 | | 1/2011 | |
| JP | 4779748 | | 9/2011 | |
| JP | 2012165189 | | 8/2012 | |
| JP | 5028944 | | 9/2012 | |
| JP | 5139111 | | 2/2013 | |
| JP | 5306565 | | 10/2013 | |
| JP | 5685173 | | 3/2015 | |
| JP | 2016051038 | | 4/2016 | |
| KR | 100298300 | | 5/2001 | |
| KR | 100901464 | | 6/2009 | |
| KR | 100960781 | | 6/2010 | |
| KR | 1020130033723 | | 4/2013 | |
| KR | 300856915 | | 5/2016 | |
| TW | 201331932 | | 8/2013 | |
| TW | I484478 | | 5/2015 | |
| WO | 1997008896 | | 3/1997 | |
| WO | 1998047291 | | 10/1998 | |
| WO | 2000030402 | | 5/2000 | |
| WO | 2003073786 | | 9/2003 | |
| WO | 2003088429 | | 10/2003 | |
| WO | 2004027754 | | 4/2004 | |
| WO | 2004090865 | | 10/2004 | |
| WO | 2006049260 | | 5/2006 | |
| WO | 2006071119 | | 7/2006 | |
| WO | 2006114015 | | 11/2006 | |
| WO | 2006121896 | | 11/2006 | |
| WO | 2007045971 | | 4/2007 | |
| WO | 2008074249 | | 6/2008 | |
| WO | 2008125523 | | 10/2008 | |
| WO | 2009039783 | | 4/2009 | |
| WO | 2009109069 | | 9/2009 | |
| WO | 2010001508 | | 1/2010 | |
| WO | WO-2010091999 | A1 * | 8/2010 | ..... H04R 1/26 |
| WO | 2010140084 | | 12/2010 | |
| WO | 2010144148 | A2 | 12/2010 | |
| WO | 2011104501 | | 9/2011 | |
| WO | 2012122132 | | 9/2012 | |
| WO | 2012140435 | | 10/2012 | |
| WO | 2012160459 | | 11/2012 | |
| WO | 2012174159 | A1 | 12/2012 | |
| WO | 2013016986 | | 2/2013 | |
| WO | 2013182118 | | 12/2013 | |
| WO | 2014156292 | | 10/2014 | |
| WO | 2016176429 | | 11/2016 | |
| WO | 2016179211 | | 11/2016 | |
| WO | 2017208022 | | 12/2017 | |
| WO | 2018140444 | | 8/2018 | |
| WO | 2018140618 | | 8/2018 | |
| WO | 2018211806 | | 11/2018 | |
| WO | 2019231630 | | 12/2019 | |
| WO | 2020168873 | | 8/2020 | |
| WO | 2020191354 | | 9/2020 | |
| WO | 211843001 | | 11/2020 | |

OTHER PUBLICATIONS

Arnold, et al., "A directional acoustic array using silicon micromachined piezoresistive microphones," Journal of Acoustical Society of America, 113 (1), pp. 289-298, Jan. 2003 (10 pp.).

Chou, "Frequency-Independent Beamformer with Low Response Error," 1995 International Conference on Acoustics, Speech, and Signal Processing, pp. 2995-2998, May 9, 1995, 4 pp.

Fohhn Audio New Generation of Beam Steering Systems Available Now, audioXpress Staff, May 10, 2017, 8 pp.

ICONYX Gen5, Product Overview; Renkus-Heinz, Dec. 24, 2018, 2 pp.

International Search Report and Written Opinion for PCT/US2016/029751 dated Nov. 28, 2016, 21 pp.

M. Kolundžija, C. Faller and M. Vetterii, "Baffled circular loudspeaker array with broadband high directivity," 2010 IEEE International Conference on Acoustics, Speech and Signal Processing, Dallas, TX, 2010, pp. 73-76.

Office Action issued for Japanese Patent Application No. 2015-023781 dated Jun. 20, 2016.

Olszewski, et al., "Steerable Highly Directional Audio Beam Loudspeaker," Interspeech 2005, 4 pp.

Amazon webpage for Metalfab MFLCRFG (last visited Apr. 22, 2020) available at <https://www.amazon.com/RETURN-FILTERGRILLE-Drop-Ceiling/dp/B0064Q9A7l/ref=sr 12? dchild=1&keywords=drop+ceiling+return+air+grille&qid=1585862723&s=hi&sr=1-2>, 11 pp.

Armstrong "Walls" Catalog available at <https://www.armstrongceilings.com/content/dam/armstrongceilings/commercial/north-america/catalogs/armstrong-ceilings-wallsspecifiers-reference.pdf>, 2019, 30 pp.

Armstrong Tectum Ceiling & Wall Panels Catalog available at <https://www.armstrongceilings.com/content/dam/armstrongceilings/commercial/north-america/brochures/tectum-brochure.pdf>, 2019, 16 pp.

Armstrong Woodworks Concealed Catalog available at <https://sweets.construction.com/swts_content_files/3824/442581.pdf>, 2014, 6 pp.

Armstrong Woodworks Walls Catalog available at <https://www.armstrongceilings.com/pdbupimagesclg/220600.pdf/download/datasheet-woodworks-walls.pdf>, 2019, 2 pp.

Armstrong, Acoustical Design: Exposed Structure, available at <https://www.armstrongceilings.com/pdbupimagesclg/217142.pdf/download/acoustical-design-exposed-structurespaces-brochure.pdf>, 2018, 19 pp.

Armstrong, Ceiling Systems, Brochure page for Armstrong Softlook, 1995, 2 pp.

Armstrong, Excerpts from Armstrong 2011-2012 Ceiling Wall Systems Catalog, available at <https://web.archive.org/web/20121116034120/http://www.armst rong.com/commceilingsna/en_us/pdf/ceilings_catalog_screen-2011 .pdf>, as early as 2012, 162 pp.

Armstrong, i-Ceilings, Brochure, 2009, 12 pp.

Benesty, et al., "Microphone Array Signal Processing," Springer, 2010, 20 pp.

BZ-3a Installation Instructions, XEDIT Corporation, Available at <chrome-extension://efaidnbmnnnibpcajpcgiclefindmkaj/viewer.html?pdfurl=https%3A%2F%2Fwww.servo reelers, com %2Fmt-content%2Fuploads%2F2017%2F05%2Fbz-a-3universal-2017c.pdf&clen=189067&chunk=true>, 1 p.

Cao, "Survey on Acoustic Vector Sensor and its Applications in Signal Processing" Proceedings of the 33rd Chinese Control Conference, Jul. 2014, 17 pp.

Circuit Specialists webpage for an aluminum enclosure, available at <https://www.circuitspecialists.com/metal-instrument-enclosure-la7.html? otaid=gpl&gclid=EAIaIQobChMI2JTw-Ynm6AIVgbblCh3F4QKuEAkYBiABEgJZMPD_BwE>, 3 pp.

ClearOne Launches Second Generation of its Groundbreaking Beamforming Microphone Array, Press Release, Acquire Media, Jun. 1, 2016, 2 pp.

ClearOne to Unveil Beamforming Microphone Array with Adaptive Steering and Next Generation Acoustic Echo Cancellation Technology, Press Release, InfoComm, Jun. 4, 2012, 1 p.

CTG Audio, CTG FS-400 and RS-800 with "Beamforming" Technology, Datasheet, As early as 2009, 2 pp.

CTG Audio, CTG User Manual for the FS- 400/800 Beamforming Mixers, Nov. 2008, 26 pp.

CTG Audio, Frequently Asked Questions, As early as 2009, 2 pp.

CTG Audio, Installation Manual and User Guidelines for the Soundman SM 02 System, May 2001, 29 pp.

CTG Audio, Introducing the CTG FS-400 and FS-800 with Beamforming Technology, As early as 2008, 2 pp.

CTG Audio, Meeting the Demand for Ceiling Mics in the Enterprise 5 Best Practices, Brochure, 2012, 9 pp.

(56) References Cited

OTHER PUBLICATIONS

Diethorn, "Audio Signal Processing For Next-Generation Multimedia Communication Systems," Chapter 4, 2004, 9 pp.
Digikey webpage for Converta box (last visited Apr. 22, 2020) <https://www.digikey.com/product-detail/en/bud-industries/CU-452-A/377-1969-ND/439257? utm_adgroup=Boxes&utm_source=google &utm_medium=cpc&utm_campaign=Shopping_Boxes %2C% 20Enclosures%2C%20Racks NEW&utm term=&utm content=Boxes &gclid=EAlalQobC hMI2JTw-Ynm6AIVgbblCh3F4QKuEAkYCSABEgKybPD_BwE>, 3 pp.
Digikey webpage for Pomona Box (last visited Apr. 22, 2020) available at <https://www.digikey.com/product-detail/en/pomonaelectronics/3306/501-2054-ND/736489>, 2 pp.
Digital Wireless Conference System, MCW-D 50, Beyerdynamic Inc., 2009, 18 pp.
Dominguez, et al., "Towards an Environmental Measurement Cloud: Delivering Pollution Awareness to the Public," International Journal of Distributed Sensor Networks, vol. 10, Issue 3, Mar. 31, 2014, 17 pp.
Double Condenser Microphone SM 69, Datasheet, Georg Neumann GmbH, available at <https://ende.neumann.com/product_files/7453/download>, 8 pp.
Eargle, "The Microphone Handbook," Elar Publ. Co., 1st ed., 1981, 4 pp.
Enright, Notes From Logan, June edition of Scanlines, Jun. 2009, 9 pp.
Hald, et al., "A class of optimal broadband phased array geometries designed for easy construction," 2002 Int'l Congress & Expo, on Noise Control Engineering, Aug. 2002, 6 pp.
Invensense, Recommendations for Mounting and Connecting InvenSense MEMS Microphones, Application Note AN-1003, 2013, 11 pp.
Johnson, et al., "Array Signal Processing: Concepts and Techniques," p. 59, Prentice Hall, 1993, 3 pp.
Klegon, "Achieve Invisible Audio with the MXA910 Ceiling Array Microphone," Jun. 27, 2016, 10 pp.
Lai, et al., "Design of Robust Steerable Broadband Beamformers with Spiral Arrays and the Farrow Filter Structure," Proc. Intl. Workshop Acoustic Echo Noise Control, 2010, 4 pp.
Li, "Broadband Beamforming and Direction Finding Using Concentric Ring Array," Ph.D. Dissertation, University of Missouri-Columbia, Jul. 2005, 163 pp.
Liu, et al., "Wideband Beamforming," Wiley Series on Wireless Communications and Mobile Computing, pp. 143-198, 2010, 297 pp.
MFLCRFG Datasheet, Metal_Fab Inc., Sep. 7, 2007, 1 p.
Milanovic, et al., "Design and Realization of FPGA Platform for Real Time Acoustic Signal Acquisition and Data Processing" 22nd Telecommunications Forum TELFOR, 2014, 6 pp.
Pomona, Model 3306, Datasheet, Jun. 9, 1999, 1 p.
Prime, et al., "Beamforming Array Optimisation Averaged Sound Source Mapping on a Model Wind Turbine," ResearchGate, Nov. 2014, 10 pp.
Sessler, et al., "Toroidal Microphones," Journal of Acoustical Society of America, vol. 46, No. 1, 1969, 10 pp.
Shure Debuts Microflex Advance Ceiling and Table Array Microphones, Press Release, Feb. 9, 2016, 4 pp.
Shure Inc., A910-HCM Hard Ceiling Mount, retrieved from website <http://www.shure.com/en-US/products/accessories/a910hcm> on Jan. 16, 2020, 3 pp.
Shure, MXA910 With IntelliMix, Ceiling Array Microphone, available at <https://www.shure.com/en-US/products/microphones/mxa910>, as early as 2020, 12 pp.
Shure, New MXA910 Variant Now Available, Press Release, Dec. 13, 2019, 5 pp.
Shure, Q&A in Response to Recent US Court Ruling on Shure MXA910, Available at <https://www.shure.com/en-US/meta/legal/q-and-a-inresponse-to-recent-us-court-ruling-on-shure-mxa910-response>, As early as 2020, 5 pp.
Shure, RK244G Replacement Screen and Grille, Datasheet, 2013, 1 p.
Shure, The Microflex Advance MXA310 Table Array Microphone, Available at <https://www.shure.com/en-US/products/microphones/mxa310>, As early as 2020, 12 pp.
SM 69 Stereo Microphone, Datasheet, Georg Neumann GmbH, Available at <https://ende.neumann.com/product_files/6552/download>, 1 p.
Vicente, "Adaptive Array Signal Processing Using the Concentric Ring Array and the Spherical Array," Ph.D. Dissertation, University of Missouri, May 2009, 226 pp.
Warsitz, et al., "Blind Acoustic Beamforming Based on Generalized Eigenvalue Decomposition," IEEE Transactions on Audio, Speech and Language Processing, vol. 15, No. 5, 2007, 11 pp.
"Philips Hue Bulbs and Wireless Connected Lighting System," Web page https://www.philips-hue.com/en-in, 8 pp, Sep. 23, 2020, retrieved from Internet Archive Wayback Machine, <https://web.archive.org/web/20200923171037/https://www.philips-hue.com/en-in> on Sep. 27, 2021.
Advanced Network Devices, IPSCM Ceiling Tile IP Speaker, Feb. 2011, 2 pgs.
Advanced Network Devices, IPSCM Standard 2' by 2' Ceiling Tile Speaker, 2 pgs.
Affes, et al., "A Signal Subspace Tracking Algorithm for Microphone Array Processing of Speech," IEEE Trans. On Speech and Audio Processing, vol. 5, No. 5, Sep. 1997, pp. 425-437.
Affes, et al., "A Source Subspace Tracking Array of Microphones for Double Talk Situations," 1996 IEEE International Conference on Acoustics, Speech, and Signal Processing Conference Proceedings, May 1996, pp. 909-912.
Affes, et al., "An Algorithm for Multisource Beamforming and Multitarget Tracking," IEEE Trans. On Signal Processing, vol. 44, No. 6, Jun. 1996, pp. 1512-1522.
Affes, et al., "Robust Adaptive Beamforming via LMS-Like Target Tracking," Proceedings of IEEE International Conference on Acoustics, Speech and Signal Processing, Apr. 1994, pp. IV-269-IV-272.
Ahonen, et al., "Directional Analysis of Sound Field with Linear Microphone Array and Applications in Sound Reproduction," Audio Engineering Socity, Convention Paper 7329, May 2008, 11 pp.
Alarifi, et al., "Ultra Wideband Indoor Positioning Technologies: Analysis and Recent Advances," Sensors 2016, vol. 16, No. 707, 36 pp.
Armstrong World Industries, Inc., I-Ceilings Sound Systems Speaker Panels, 2002, 4 pgs.
Atlas Sound, I128SYSM IP Compliant Loudspeaker System with Microphone Data Sheet, 2009, 2 pgs.
Atlas Sound,1'X2' IP Speaker with Micophone for Suspended Ceiling Systems, https://www.atlasied.com/i128sysm, retrieved Oct. 25, 2017, 5 pgs.
Audio Technica, ES945 Omnidirectional Condenser Boundary Microphones, https://eu.audio-technica.com/resources/ES945%20Specifications.pdf, 2007, 1 pg.
Audix Microphones, Audix Introduces Innovative Ceiling Mies, http://audixusa.com/docs_12/latest_news/EFplFkAAklOtSdolke.shtml, Jun. 2011,6 pgs.
Audix Microphones, M70 Flush Mount Ceiling Mic, May 2016, 2 pgs.
Automixer Gated, Information Sheet, MIT, Nov. 2019, 9 pp.
Avnetwork, "Top Five Conference Room Mic Myths," Feb. 25, 2015, 14 pp.
Beh, et al., "Combining Acoustic Echo Cancellation and Adaptive Beamforming for Achieving Robust Speech Interface in Mobile Robot," 2008 IEEE/RSJ International Conference on Intelligent Robots and Systems, Sep. 2008, pp. 1693-1698.
Benesty, et al., "A New Class of Doubletalk Detectors Based on Cross-Correlation," IEEE Transactions on Speech and Audio Processing, vol. 8, No. 2, Mar. 2000, pp. 168-172.
Benesty, et al., "Adaptive Algorithms for Mimo Acoustic Echo Cancellation," AI2 Allen Institute for Artifical Intelligence, 2003.
Benesty, et al., "Differential Beamforming," Fundamentals of Signal Enhancement and Array Signal Processing, First Edition, 2017, 39 pp.

(56) References Cited

OTHER PUBLICATIONS

Benesty, et al., "Frequency-Domain Adaptive Filtering Revisited, Generalization to the Multi-Channel Case, and Application to Acoustic Echo Cancellation," 2000 IEEE International Conference on Acoustics, Speech, and Signal Processing Proceedings, Jun. 2000, pp. 789-792.
Berkun, et al., "Combined Beamformers for Robust Broadband Regularized Superdirective Beamforming," IEEE/ACM Transactions on Audio, Speech, and Language Processing, vol. 23, No. 5, May 2015, 10 pp.
Beyer Dynamic, Classis BM 32-33-34 DE-EN-FR 2016, 1 pg.
Beyer Dynamic, Classis-BM-33-PZA1, 1 pg.
BNO55, Intelligent 9-axis absolute orientation sensor, Data sheet, Bosch, Nov. 2020, 118 pp.
Boyd, et al., Convex Optimization, Mar. 15, 1999, 216 pgs.
Brandstein, et al., "Microphone Arrays: Signal Processing Techniques and Applications," Digital Signal Processing, Springer-Verlag Berlin Heidelberg, 2001, 401 pgs.
Brooks, et al., "A Quantitative Assessment of Group Delay Methods for Identifying Glottal Closures in Voiced Speech," IEEE Transaction on Audio, Speech, and Language Processing, vol. 14, No. 2, Mar. 2006, 11 pp.
Bruel & Kjaer, by J.J. Christensen and J. Hald, Technical Review: Beamforming, No. 1, 2004, 54 pgs.
BSS Audio, Soundweb London Application Guides, 2010, 120 pgs.
Buchner, et al., "An Acoustic Human-Machine Interface with Multi-Channel Sound Reproduction," IEEE Fourth Workshop on Multimedia Signal Processing, Oct. 2001, pp. 359-364.
Buchner, et al., "An Efficient Combination of Multi-Channel Acoustic Echo Cancellation with a Beamforming Microphone Array," International Workshop on Hands-Free Speech Communication (HSC2001), Apr. 2001, pp. 55-58.
Buchner, et al., "Full-Duplex Communication Systems Using Loudspeaker Arrays and Microphone Arrays," IEEE International Conference on Multimedia and Expo, Aug. 2002, pp. 509-512.
Buchner, et al., "Generalized Multichannel Frequency-Domain Adaptive Filtering: Efficient Realization and Application to Hands-Free Speech Communication," Signal Processing 85, 2005, pp. 549-570.
Buchner, et al., "Multichannel Frequency-Domain Adaptive Filtering with Application to Multichannel Acoustic Echo Cancellation," Adaptive Signal Processing, 2003, pp. 95-128.
Buck, "Aspects of First-Order Differential Microphone Arrays in the Presence of Sensor Imperfections," Transactions on Emerging Telecommunications Technologies, 13.2, 2002, 8 pp.
Buck, et al., "First Order Differential Microphone Arrays for Automotive Applications," 7th International Workshop on Acoustic Echo and Noise Control, Darmstadt University of Technology, Sep. 10-13, 2001, 4 pp.
Buck, et al., "Self-Calibrating Microphone Arrays for Speech Signal Acquisition: A Systematic Approach," Signal Processing, vol. 86, 2006, pp. 1230-1238.
Burton, et al., "A New Structure for Combining Echo Cancellation and Beamforming in Changing Acoustical Environments," IEEE International Conference on Acoustics, Speech and Signal Processing, 2007, pp. 1-77-1-80.
Cabral, et al., Glottal Spectral Separation for Speech Synthesis, IEEE Journal of Selected Topics in Signal Processing, 2013, 15 pp.
Campbell, "Adaptive Beamforming Using a Microphone Array for Hands-Free Telephony," Virginia Polytechnic Institute and State University, Feb. 1999, 154 pgs.
Canetto, et al., "Speech Enhancement Systems Based on Microphone Arrays," VI Conference of the Italian Society for Applied and Industrial Mathematics, May 27, 2002, 9 pp.
Cech, et al., "Active-Speaker Detection and Localization with Microphones and Cameras Embedded into a Robotic Head," IEEE-RAS International Conference on Humanoid Robots, Oct. 2013, pp. 203-210.
Chan, et al., "Uniform Concentric Circular Arrays with Frequency-Invariant Characteristics-Theory, Design, Adaptive Beamforming and DOA Estimation," IEEE Transactions on Signal Processing, vol. 55, No. 1, Jan. 2007, pp. 165-177.
Chau, et al., "A Subband Beamformer on an Ultra Low-Power Miniature DSP Platform," 2002 IEEE International Conference on Acoustics, Speech, and Signal Processing, 4 pp.
Chen, et al., "A General Approach to the Design and Implementation of Linear Differential Microphone Arrays," Signal and Information Processing Association Annual Summit and Conference, 2013 Asia-Pacific, IEEE, 7 pp.
Chen, et al., "Design and Implementation of Small Microphone Arrays," PowerPoint Presentation, Northwestern Polytechnical University and Institut national de la recherche scientifique, Jan. 1, 2014, 56 pp.
Chen, et al., "Design of Robust Broadband Beamformers with Passband Shaping Characteristics using Tikhonov Regularization," IEEE Transactions on Audio, Speech, and Language Processing, vol. 17, No. 4, May 2009, pp. 565-681.
Chu, "Desktop Mic Array for Teleconferencing," 1995 International Conference on Acoustics, Speech, and Signal Processing, May 1995, pp. 2999-3002.
ClearOne Introduces Ceiling Microphone Array With Built-In Dante Interface, Press Release; GlobeNewswire, Jan. 8, 2019, 2 pp.
ClearOne, Clearly Speaking Blog, "Advanced Beamforming Microphone Array Technology for Corporate Conferencing Systems," Nov. 11, 2013, 5 pp., http://www.clearone.com/blog/advanced-beamforming-microphone-array-technology-for-corporate-conferencing-systems/.
ClearOne, Beamforming Microphone Array, Mar. 2012, 6 pgs.
ClearOne, Ceiling Microphone Array Installation Manual, Jan. 9, 2012, 20 pgs.
ClearOne, Converge/Converge Pro, Manual, 2008, 51 pp.
ClearOne, Professional Conferencing Microphones, Brochure, Mar. 2015, 3 pp.
Coleman, "Loudspeaker Array Processing for Personal Sound Zone Reproduction," Centre for Vision, Speech and Signal Processing, 2014, 239 pp.
Cook, et al., An Alternative Approach to Interpolated Array Processing for Uniform Circular Arrays, Asia-Pacific Conference on Circuits and Systems, 2002, pp. 411-414.
Cox, et al., "Robust Adaptive Beamforming," IEEE Trans. Acoust., Speech, and Signal Processing, vol. ASSP-35, No. 10, Oct. 1987, pp. 1365-1376.
CTG Audio, Ceiling Microphone CTG CM-01, Jun. 5, 2008, 2 pgs.
CTG Audio, CM-01 & CM-02 Ceiling Microphones Specifications, 2 pgs.
CTG Audio, CM-01 & CM-02 Ceiling Microphones, 2017, 4 pgs.
CTG Audio, Expand Your IP Teleconferencing to Full Room Audio, Obtained from website htt.)://www ct audio com/exand-, our-i -teleconforencino-to-ful-room-audio-while-conquennc.1 -echo-cancelation-issues Mull, 2014.
CTG Audio, Installation Manual, Nov. 21, 2008, 25 pgs.
CTG Audio, White on White—Introducing the CM-02 Ceiling Microphone, https://ctgaudio.com/white-on-white-introducing-the-cm-02-ceiling-microphone/, Feb. 20, 2014, 3 pgs.
Dahl et al., Acoustic Echo Cancelling with Microphone Arrays, Research Report 3/95, Univ, of Karlskrona/Ronneby, Apr. 1995, 64 pgs.
Decawave, Application Note: APR001, Uwb Regulations, A Summary of Worldwide Telecommunications Regulations governing the use of Ultra-Wideband radio, Version 1.2, 2015, 63 pp.
Desiraju, et al., "Efficient Multi-Channel Acoustic Echo Cancellation Using Constrained Sparse Filter Updates in the Subband Domain," Acoustic Speech Enhancement Research, Sep. 2014, 4 pp.
Dibiase et al., Robust Localization in Reverberent Rooms, in Brandstein, ed., Microphone Arrays: Techniques and Applications, 2001, Springer-Verlag Berlin Heidelberg, pp. 157-180.
Do et al., A Real-Time SRP-PHAT Source Location Implementation using Stochastic Region Contraction (SRC) on a Large-Aperture Microphone Array, 2007 IEEE International Conference on Acoustics, Speech and Signal Processing—ICASSP '07. Apr. 2007, pp. I-121—I-124.

(56) References Cited

OTHER PUBLICATIONS

Dormehl, "HoloLens concept lets you control your smart home via augmented reality," digitaltrends, Jul. 26, 2016, 12 pp.
Fan, et al., "Localization Estimation of Sound Source by Microphones Array," Procedia Engineering 7, 2010, pp. 312-317.
Firoozabadi, et al., "Combination of Nested Microphone Array and Subband Processing for Multiple Simultaneous Speaker Localization," 6th International Symposium on Telecommunications, Nov. 2012, pp. 907-912.
Flanagan et al., Autodirective Microphone Systems, Acustica, vol. 73, 1991, pp. 58-71.
Flanagan, et al., "Computer-Steered Microphone Arrays for Sound Transduction in Large Rooms," J. Acoust. Soc. Am. 78 (5), Nov. 1985, pp. 1508-1518.
Fox, et al., "A Subband Hybrid Beamforming for In-Car Speech Enhancement," 20th European Signal rocessing Conference, Aug. 2012, 5 pp.
Frost, III, An Algorithm for Linearly Constrained Adaptive Array Processing, Proc. IEEE, vol. 60, No. 8, Aug. 1972, pp. 926-935.
Gannot et al., Signal Enhancement using Beamforming and Nonstationarity with Applications to Speech, IEEE Trans. On Signal Processing, vol. 49, No. 8, Aug. 2001, pp. 1614-1626.
Gansler et al., A Double-Talk Detector Based on Coherence, IEEE Transactions on Communications, vol. 44, No. 11, Nov. 1996, pp. 1421-1427.
Gazor et al., Robust Adaptive Beamforming via Target Tracking, IEEE Transactions on Signal Processing, vol. 44, No. 6, Jun. 1996, pp. 1589-1593.
Gazor et al., Wideband Multi-Source Beamforming with Adaptive Array Location Calibration and Direction Finding, 1995 International Conference on Acoustics, Speech, and Signal Processing, May 1995, pp. 1904-1907.
Gentner Communications Corp., AP400 Audio Perfect 400 Audioconferencing System Installation & Operation Manual, Nov. 1998, 80 pgs.
Gentner Communications Corp., XAP 800 Audio Conferencing System Installation & Operation Manual, Oct. 2001, 152 pgs.
Gil-Cacho et al., Multi-Microphone Acoustic Echo Cancellation Using Multi-Channel Warped Linear Prediction of Common Acoustical Poles, 18th European Signal Processing Conference, Aug. 2010, pp. 2121-2125.
Giuliani, et al., "Use of Different Microphone Array Configurations for Hands-Free Speech Recognition in Noisy and Reverberant Environment," IRST-Istituto per la Ricerca Scientifica e Tecnologica, Sep. 22, 1997, 4 pp.
Gritton et al., Echo Cancellation Algorithms, IEEE ASSP Magazine, vol. 1, issue 2, Apr. 1984, pp. 30-38.
Hamalainen, et al., "Acoustic Echo Cancellation for Dynamically Steered Microphone Array Systems," 2007 IEEE Workshop on Applications of Signal Processing to Audio and Acoustics, Oct. 2007, pp. 58-61.
Hayo, Virtual Controls for Real Life, Web page downloaded from https://hayo.io/ on Sep. 18, 2019, 19 pp.
Herbordt et al., A Real-time Acoustic Human-Machine Front-End for Multimedia Applications Integrating Robust Adaptive Beamforrning and Stereophonic Acoustic Echo Cancellation, 7th International Conference on Spoken Language Processing, Sep. 2002, 4 pgs.
Herbordt et al., GSAEC - Acoustic Echo Cancellation embedded into the Generalized Sidelobe Canceller, 10th European Signal Processing Conference, Sep. 2000, 5 pgs.
Herbordt et al., Multichannel Bin-Wise Robust Frequency-Domain Adaptive Filtering and Its Application to Adaptive Beamforming, IEEE Transactions on Audio, Speech, and Language Processing, vol. 15, No. 4, May 2007, pp. 1340-1351.
Herbordt, "Combination of Robust Adaptive Beamforming with Acoustic Echo Cancellation for Acoustic Human/Machine Interfaces," Friedrich-Alexander University, 2003, 293 pgs.
Herbordt, et al., Joint Optimization of LCMV Beamforming and Acoustic Echo Cancellation for Automatic Speech Recognition, IEEE International Conference on Acoustics, Speech, and Signal Processing, Mar. 2005, pp. HI-77 - III-80.
Holm, "Optimizing Microphone Arrays for use in Conference Halls," Norwegian University of Science and Technology, Jun. 2009, 101 pp.
Huang et al., Immersive Audio Schemes: The Evolution of Multiparty Teleconferencing, IEEE Signal Processing Magazine, Jan. 2011, pp. 20-32.
International Search Report and Written Opinion for PCT/US2016/022773 dated Jun. 10, 2016.
International Search Report and Written Opinion for PCT/US2018/013155 dated Jun. 8, 2018.
International Search Report and Written Opinion for PCT/US2019/031833 dated Jul. 24, 2019, 16 pp.
International Search Report and Written Opinion for PCT/US2019/033470 dated Jul. 31, 2019, 12 pp.
International Search Report and Written Opinion for PCT/US2019/051989 dated Jan. 10, 2020, 15 pp.
International Search Report and Written Opinion for PCT/US2020/024063 dated Aug. 31, 2020, 18 pp.
International Search Report and Written Opinion for PCT/US2020/035185 dated Sep. 15, 2020, 11 pp.
International Search Report and Written Opinion for PCT/US2020/058385 dated Mar. 31, 2021,20 pp.
International Search Report and Written Opinion for PCT/US2021/070625 dated Sep. 17, 2021, 17 pp.
International Search Report for PCT/US2020/024005 dated Jun. 12, 2020, 12 pp.
Invensense, "Microphone Array Beamforming," Application Note AN-1140, Dec. 31, 2013, 12 pp.
Ishii et al., Investigation on Sound Localization using Multiple Microphone Arrays, Reflection and Spatial Information, Japanese Society for Artificial Intelligence, JSAI Technical Report, SIG-Challenge-B202-11,2012, pp. 64-69.
Ito et al., Aerodynamic/Aeroacoustic Testing in Anechoic Closed Test Sections of Low-speed Wind Tunnels, 16th AIAA/CEAS Aeroacoustics Conference, 2010,11 pgs.
Johansson et al., Robust Acoustic Direction of Arrival Estimation using Root-SRP-PHAT, a Realtime Implementation, IEEE International Conference on Acoustics, Speech, and Signal Processing, Mar. 2005, 4 pgs.
Johansson, et al., Speaker Localisation using the Far-Field SRP-PHAT in Conference Telephony, 2002 International Symposium on Intelligent Signal Processing and Communication Systems, 5 pgs.
Julstrom et al., Direction-Sensitive Gating: A New Approach to Automatic Mixing, J. Audio Eng. Soc., vol. 32, No. 7/8, Jul./Aug. 1984, pp. 490-506.
Kahrs, Ed., The Past, Present, and Future of Audio Signal Processing, IEEE Signal Processing Magazine, Sep. 1997, pp. 30-57.
Kallinger et al., Multi-Microphone Residual Echo Estimation, 2003 IEEE International Conference on Acoustics, Speech, and Signal Processing, Apr. 2003, 4 pgs.
Kammeyer, et al., New Aspects of Combining Echo Cancellers with Beamformers, IEEE International Conference on Acoustics, Speech, and Signal Processing, Mar. 2005, pp. ill-137 -111-140.
Kellermann, A Self-Steering Digital Microphone Array, 1991 International Conference on Acoustics, Speech, and Signal Processing, Apr. 1991, pp. 3581-3584.
Kellermann, Acoustic Echo Cancellation for Beamforming Microphone Arrays, in Brandstein, ed., Microphone Arrays: Techniques and Applications, 2001, Springer-Verlag Berlin Heidelberg, pp. 281-306.
Kellermann, Integrating Acoustic Echo Cancellation with Adaptive Beamforming Microphone Arrays, Forum Acusticum, Berlin, Mar. 1999, pp. 1-4.
Kellermann, Strategies for Combining Acoustic Echo Cancellation and Adaptive Beamforming Microphone Arrays, 1997 IEEE International Conference on Acoustics, Speech, and Signal Processing, Apr. 1997, 4 pgs.
Knapp, et al., The Generalized Correlation Method for Estimation of Time Delay, IEEE Transactions on Acoustics, Speech, and Signal Processing, vol. ASSP-24, No. 4, Aug. 1976, pp. 320-327.

(56) References Cited

OTHER PUBLICATIONS

Kobayashi et al., A Hands-Free Unit with Noise Reduction by Using Adaptive Beamformer, IEEE Transactions on Consumer Electronics, vol. 54, No. 1, Feb. 2008, pp. 116-122.
Kobayashi et al., A Microphone Array System with Echo Canceller, Electronics and Communications in Japan, Part 3, vol. 89, No. 10, Feb. 2, 2006, pp. 23-32.
Lebret, et al., Antenna Array Pattern Synthesis via Convex Cptimization, IEEE Trans, on Signal Processing, vol. 45, No. 3, Mar. 1997, pp. 526-532.
LecNet2 Sound System Design Guide, Lectrosonics, Jun. 2, 2006.
Lectrosonics, LecNet2 Sound System Design Guide, Jun. 2006, 28 pgs.
Lee et al., Multichannel Teleconferencing System with Multispatial Region Acoustic Echo Cancellation, International Workshop on Acoustic Echo and Noise Control (IWAENC2003), Sep. 2003, pp. 51-54.
Lindstrom et al., An Improvement of the Two-Path Algorithm Transfer Logic for Acoustic Echo Cancellation, IEEE Transactions on Audio, Speech, and Language Processing, vol. 15, No. 4, May 2007, pp. 1320-1326.
Liu et al., Adaptive Beamforming with Sidelobe Control: A Second-Order Cone Programming Approach, IEEE Signal Proc. Letters, vol. 10, No. 11, Nov. 2003, pp. 331-334.
Liu, et al., "Frequency Invariant Beamforming in Subbands," IEEE Conference on Signals, Systems and Computers, 2004, 5 pp.
Lobo, et al., Applications of Second-Order Cone Programming, Linear Algebra and its Applications 284, 1998, pp. 193-228.
Luo et al., Wideband Beamforming with Broad Nulls of Nested Array, Third Int'l Conf, on Info. Science and Tech., Mar. 23-25, 2013, pp. 1645-1648.
Marquardt et al., A Natural Acoustic Front-End for Interactive TV in the EU-Project Dicit, IEEE Pacific Rim Conference on Communications, Computers and Signal Processing, Aug. 2009, pp. 894-899.
Martin, Small Microphone Arrays with Postfilters for Noise and Acoustic Echo Reduction, in Brandstein, ed., Microphone Arrays: Techniques and Applications, 2001, Springer-Verlag Berlin Heidelberg, pp. 255-279.
Maruo et al., On the Optimal Solutions of Beamformer Assisted Acoustic Echo Cancellers, IEEE Statistical Signal Processing Workshop, 2011, pp. 641-644.
McCowan, Microphone Arrays: A Tutorial, Apr. 2001, 36 pgs.
Microphone Array Primer, Shure Question and Answer Page, <https://service.shure.eom/s/article/microphone-array-primer?language=en_US>, Jan. 2019, 5 pp.
Mohammed, A New Adaptive Beamformer for Optimal Acoustic Echo and Noise Cancellation with Less Computational Load, Canadian Conference on Electrical and Computer Engineering, May 2008, p. 000123-000128.
Mohammed, A New Robust Adaptive Beamformer for Enhancing Speech Corrupted with Colored Noise, AICCSA, Apr. 2008, pp. 508-515.
Mohammed, Real-time Implementation of an efficient RLS Algorithm based on HR Filter for Acoustic Echo Cancellation, AICCSA, Apr. 2008, pp. 489-494.
Mohan, et al., "Localization of multiple acoustic sources with small arrays using a coherence test," Journal Acoustic Soc Am., 123(4), Apr. 2008, 12 pp.
Moulines, et al., "Pitch-Synchronous Waveform Processing Techniques for Text-to-Speech Synthesis Using Diphones," Speech Communication 9, 1990, 15 pp.
Multichannel Acoustic Echo Cancellation, Obtained from website http://www.buchner-net.com/mcaec.html, Jun. 2011.
Myllyla et al., Adaptive Beamforming Methods for Dynamically Steered Microphone Array Systems, 2008 IEEE International Conference on Acoustics, Speech and Signal Processing, Mar.-Apr. 2008, pp. 305-308.
New Shure Microflex Advance MXA910 Microphone With Intellimix Audio Processing Provides Greater Simplicity, Flexibility, Clarity, Press Release, Jun. 12, 2019, 4 pp.
Nguyen-Ky, et al., "An Improved Error Estimation Algorithm for Stereophonic Acoustic Echo Cancellation Systems," 1st International Conference on Signal Processing and Communication Systems, Dec. 17-19, 2007, 5 pp.
Office Action for Taiwan Patent Application No. 105109900 dated May 5, 2017.
Oh, et al., "Hands-Free Voice Communication in an Automobile With a Microphone Array," 1992 IEEE International Conference on Acoustics, Speech, and Signal Processing, Mar. 1992, pp. 1-281—I-284.
Omologo, Multi-Microphone Signal Processing for Distant-Speech Interaction, Human Activity and Vision Summer School (HAVSS), INRIA Sophia Antipolis, Oct. 3, 2012, 79 pgs.
Order, Conduct of the Proceeding, *Clearone, Inc.*v. *Shure Acquisition Holdings, Inc.*, Nov. 2, 2020, 10 pp.
Pados et al., An Iterative Algorithm for the Computation of the MVDR Filter, IEEE Trans. On Signal Processing, vol. 49, No. 2, Feb. 2001, pp. 290-300.
Palladino, "This App Lets You Control Your Smarthome Lights via Augmented Reality," Next Reality Mobile AR News, Jul. 2, 2018, 5 pp.
Parikh, et al., "Methods for Mitigating IP Network Packet Loss in Real Time Audio Streaming Applications," GatesAir, 2014, 6 pp.
Pasha, et al., "Clustered Multi-channel Dereverberation for Ad-hoc Microphone Arrays," Proceedings of APSIPA Annual Summit and Conference, Dec. 2015, pp. 274-278.
Petitioner's Motion for Sanctions, *Clearone, Inc.* v. *Shure Acquisition Holdings, Inc.*, Aug. 24, 2020, 20 pp.
Pettersen, "Broadcast Applications for Voice-Activated Microphones," db, Jul./Aug. 1985, 6 pgs.
Pfeifenberger, et al., "Nonlinear Residual Echo Suppression using a Recurrent Neural Network," Interspeech 2020, 5 pp.
Phoenix Audio Technologies, "Beamforming and Microphone Arrays—Common Myths", Apr. 2016, http://info.phnxaudio.com/blog/microphone-arrays-beamforming-myths-1, 19 pp.
Plascore, PCGA-XR1 3003 Aluminum Honeycomb Data Sheet, 2008, 2 pgs.
Polycom Inc., Vortex EF2211/EF2210 Reference Manual, 2003, 66 pgs.
Polycom, Inc., Polycom Soundstructure C16, C12, C8, and SR12 Design Guide, Nov. 2013, 743 pgs.
Polycom, Inc., Setting Up the Polycom HDX Ceiling Microphone Array Series, https://support.polycom.com/content/dam/polycom-support/products/Telepresence-and-Video/HDX %20Series/setup-maintenance/en/hdx_ceiling_microphone_array_setting_up.pdf, 2010, 16 pgs.
Polycom, Inc., Vortex EF2241 Reference Manual, 2002, 68 pgs.
Polycom, Inc., Vortex EF2280 Reference Manual, 2001, 60 pp.
Powers, et al., "Proving Adaptive Directional Technology Works: A Review of Studies," The Hearing Review, Apr. 6, 2004, 5 pp.
Rabinkin et al., Estimation of Wavefront Arrival Delay Using the Cross-Power Spectrum Phase Technique, 132nd Meeting of the Acoustical Society of America, Dec. 1996, pp. 1-10.
Rane Corp., Halogen Acoustic Echo Cancellation Guide, AEC Guide Version 2, Nov. 2013, 16 pgs.
Rao, et al., "Fast LMS/Newton Algorithms for Stereophonic Acoustic Echo Cancelation," IEEE Transactions on Signal Processing, vol. 57, No. 8, Aug. 2009.
Reuven et al., Joint Acoustic Echo Cancellation and Transfer Function GSC in the Frequency Domain, 23rd IEEE Convention of Electrical and Electronics Engineers in Israel, Sep. 2004, pp. 412-415.
Reuven et al., Joint Noise Reduction and Acoustic Echo Cancellation Using the Transfer-Function Generalized Sidelobe Canceller, Speech Communication, vol. 49, 2007, pp. 623-635.
Reuven, et al., "Multichannel Acoustic Echo Cancellation and Noise Reduction in Reverberant Environments Using the Transfer-Function GSC," 2007 IEEE International Conference on Acoustics, Speech and Signal Processing, Apr. 2007, 4 pp.

(56) References Cited

OTHER PUBLICATIONS

Ristimaki, Distributed Microphone Array System for Two-Way Audio Communication, Helsinki Univ, of Technology, Master's Thesis, Jun. 15, 2009, 73 pgs.
Rombouts et al., An Integrated Approach to Acoustic Noise and Echo Cancellation, Signal Processing 85, 2005, pp. 849-871.
Sallberg, "Faster Subband Signal Processing," IEEE Signal Processing Magazine, vol. 30, No. 5, Sep. 2013, 6 pp.
Sasaki et al., A Predefined Command Recognition System Using a Ceiling Microphone Array in Noisy Housing Environments, 2008 IEEE/RSJ International Conference on Intelligent Robots and Systems, Sep. 2008, pp. 2178-2184.
Sennheiser, New microphone solutions for ceiling and desk installation, https://en-US.sennheiser.com/news-new-microphone-solutions-for-ceiling-and-desk-installation, Feb. 2011, 2 pgs.
Sennheiser, TeamConnect Ceiling, https://en-US.sennheiser.com/conference-meeting-rooms-teamconnect-ceiling, 7 pgs.
Serdes, Wikipedia article, last edited on Jun. 25, 2018: retrieved on Jun. 27, 2018, 3 pp., https://en.wikipedia.org/wiki/SerDes.
Sessler, et al., "Directional Transducers," IEEE Transactions on Audio and Electroacoustics, vol. AU-19, No. 1, Mar. 1971, pp. 19-23.
Shure AMS Update, vol. 1, No. 1, 1983, 2 pgs.
Shure AMS Update, vol. 1, No. 2, 1983, 2 pgs.
Shure AMS Update, vol. 4, No. 4, 1997, 8 pgs.
Shure Inc., Microflex Advance, http://www.shure.com/americas/microflex-advance, 12 pgs.
Shure Inc., MX395 Low Profile Boundary Microphones, 2007, 2 pgs.
Shure Inc., MXA910 Ceiling Array Microphone, http://www.shure.com/americas/products/microphones/microflex-advance/mxa910-ceiling-array-microphone, 7 pgs.
Signal Processor MRX7-D Product Specifications, Yamaha Corporation, 2016.
Silverman et al., Performance of Real-Time Source-Location Estimators for a Large-Aperture Microphone Array, IEEE Transactions on Speech and Audio Processing, vol. 13, No. 4, Jul. 2005, pp. 593-606.
Sinha, Ch. 9: Noise and Echo Cancellation, in Speech Processing in Embedded Systems, Springer, 2010, pp. 127-142.
Soda et al., Introducing Multiple Microphone Arrays for Enhancing Smart Home Voice Control, The Institute of Electronics, Information and Communication Engineers, Technical Report of IEICE, Jan. 2013, 6 pgs.
Soundweb London Application Guides, BSS Audio, 2010.
Symetrix, Inc., SymNet Network Audio Solutions Brochure, 2008, 32 pgs.
SymNet Network Audio Solutions Brochure, Symetrix, Inc., 2008.
Tan, et al., "Pitch Detection Algorithm: Autocorrelation Method and AMDF," Department of Computer Engineering, Prince of Songkhla University, Jan. 2003, 6 pp.
Tandon, et al., "An Efficient, Low-Complexity, Normalized LMS Algorithm for Echo Cancellation," 2nd Annual IEEE Northeast Workshop on Circuits and Systems, Jun. 2004, pp. 161-164.
Tetelbaum et al., Design and Implementation of a Conference Phone Based on Microphone Array Technology, Proc. Global Signal Processing Conference and Expo (GSPx), Sep. 2004, 6 pgs.
Tiete et al., SoundCompass: A Distributed MEMS Microphone Array-Based Sensor for Sound Source Localization, SENSORS, Jan. 23, 2014, pp. 1918-1949.
TOACorp., Ceiling Mount Microphone AN-9001 Operating Instructions, http://www.toaelectronics.com/media/an9001_mt1e.pdf, 1 pg.
Togami, et al., "Subband Beamformer Combined with Time-Frequency ICAfor Extraction of Target Source Under Reverberant Environments," 17th European Signal Processing Conference, Aug. 2009, 5 pp.
U.S. Appl. No. 16/598,918, filed Oct. 10, 2019, 50 pp.
Van Compernolle, Switching Adaptive Filters for Enhancing Noisy and Reverberant Speech from Microphone Array Recordings, Proc. IEEE Inf. Conf, on Acoustics, Speech, and Signal Processing, Apr. 1990, pp. 833-836.
Van Trees, Optimum Array Processing: Part IV of Detection, Estimation, and Modulation Theory, 2002, 54 pgs., pp. i-xxv, 90-95, 201-230.
Van Veen et al., Beamforming: A Versatile Approach to Spatial Filtering, IEEE Assp Magazine, vol. 5, issue 2, Apr. 1988, pp. 4-24.
Wang et al., Combining Superdirective Beamforming and Frequency-Domain Blind Source Separation for Highly Reverberant Signals, EURASIP Journal on Audio, Speech, and Music Processing, vol. 2010, pp. 1-13.
Weinstein, et al., "Loud: A 1020-Node Microphone Array and Acoustic Beamformer," 14th International Congress on Sound & Vibration, Jul. 2007, 8 pgs.
Weinstein, et al., "LOUD: A1020-Node Modular Microphone Array and Beamformer for Intelligent Computing Spaces," MIT Computer Science and Artifical Intelligence Laboratory, 2004, 18 pp.
Wung, "A System Approach to Multi-Channel Acoustic Echo Cancellation and Residual Echo Suppression for Robust Hands-Free Teleconferencing," Georgia Institute of Technology, May 2015, 167 pp.
XAP Audio Conferencing Brochure, ClearOne Communications, Inc., 2002.
Yamaha Corp., MRX7-D Signal Processor Product Specifications, 2016, 12 pgs.
Yamaha Corp., PJP-100H IP Audio Conference System Owner's Manual, Sep. 2006, 59 pgs.
Yamaha Corp., PJP-EC200 Conference Echo Canceller Brochure, Oct. 2009, 2 pgs.
Yan et al., Convex Optimization Based Time-Domain Broadband Beamforming with Sidelobe Control, Journal of the Acoustical Society of America, vol. 121, No. 1, Jan. 2007, pp. 46-49.
Yensen et al., Synthetic Stereo Acoustic Echo Cancellation Structure with Microphone Array Beamforming for VOIP Conferences, 2000 IEEE International Conference on Acoustics, Speech, and Signal Processing, Jun. 2000, pp. 817-820.
Yermeche, et al., "Real-Time DSP Implementation of a Subband Beamforming Algorithm for Dual Microphone Speech Enhancement," 2007 IEEE International Symposium on Circuits and Systems, 4 pp.
Zavarehei, et al., "Interpolation of Lost Speech Segments Using LP-HNM Model with Codebook Post-Processing," IEEE Transactions on Multimedia, vol. 10, No. 3, Apr. 2008, 10 pp.
Zhang, et al., "F-T-LSTM based Complex Network for Joint Acoustic Echo Cancellation and Speech Enhancement," Audio, Speech and Language Processing Group, Jun. 2021,5 pp.
Zhang, et al., "Multichannel Acoustic Echo Cancelation in Multiparty Spatial Audio Conferencing with Constrained Kalman Filtering," 11th International Workshop on Acoustic Echo and Noise Control, Sep. 14, 2008, 4 pp.
Zhang, et al., "Selective Frequency Invariant Uniform Circular Broadband Beamformer," EURASIP Journal on Advances in Signal Processing, vol. 2010, pp. 1-11.
Zheng, et al., "Experimental Evaluation of a Nested Microphone Array With Adaptive Noise Cancellers," IEEE Transactions on Instrumentation and Measurement, vol. 53, No. 3, Jun. 2004,10 PP-.

* cited by examiner

Measured Polar Responses (2 Meters)
Steered 30 degrees Right

STEERABLE SPEAKER ARRAY, SYSTEM, AND METHOD FOR THE SAME

CROSS-REFERENCE

This application claims priority to U.S. Provisional Patent Application No. 62/960,502, filed on Jan. 13, 2020, and U.S. Provisional Patent Application No. 62/851,819, filed on May 23, 2019, both of which are fully incorporated herein by reference.

TECHNICAL FIELD

This application generally relates to a speaker system. In particular, this application relates to a speaker system comprising at least one steerable speaker array and methods for implementing and controlling the same.

BACKGROUND

Loudspeaker, or sound reproduction, systems comprising a plurality of speakers are commonly found in office spaces or conferencing environments, public spaces, including theaters, entertainment venues, and transportation hubs, homes, automobiles, and other listening environments. The number, size, quality, arrangement, and type of the speakers can affect sound quality and listening experience. However, most listening environments can only accommodate a certain number, size, type, and/or arrangement of speakers due to spatial and/or aesthetic limitations, limits on expense and/or computational complexity, and other constraints. For example, massive speaker systems with larger cone sizes may be suitable for concert halls and other music applications requiring a high fidelity, full-range response, e.g., 20 Hz to 20 kHz, but typically, are not preferred for office spaces and conferencing environments. Rather, such environments often include speakers that are aesthetically designed to minimize the visual impact of the speaker system and acoustically designed to provide increased intelligibility and other preferred characteristics for voice applications.

One existing type of loudspeaker system is the line array comprising a linear arrangement of transducers with predetermined spacing or distances between the transducers. Typically, the transducers are arranged in a planar array and located on a front plate of a single housing or mounting frame with all of the transducers facing forward, or away from the front plate. A common line array is the "column speaker," which consists of a long line of closely spaced identical transducers or drivers placed in an upright, forward-facing position. Line arrays provide the ability to steer the sound beams output by the individual speakers towards a given listener using appropriate beamforming techniques (e.g., signal processing). For example, the transducers of an upright column speaker can provide a controlled degree of directionality in the vertical plane. The directivity of a line array depends on several, somewhat conflicting properties. Longer lines of drivers permit greater directional control at lower frequencies, while closer spacing between drivers permits greater directional control at higher frequencies. Also, as frequency decreases, beam width increases, causing beam focus to decrease. A two-dimensional speaker array comprised of several individual line arrays arranged in rows and columns may be capable of providing control in all directions. However, such systems are difficult to design and expensive to implement due at least in part to the large number of drivers required to provide directivity across all frequencies.

Accordingly, there is an opportunity for systems that address these concerns. More particularly, there is an opportunity for systems including a speaker array that is unobtrusive, easy to install into an existing environment, and allows for adjustment of the speaker array, including steering discrete lobes to desired listeners or other locations.

SUMMARY

The invention is intended to solve the above-noted problems by providing systems and methods that are designed to, among other things, provide: (1) a steerable speaker array comprising a concentric, nested configuration of transducers that achieves improved directivity over the voice frequency range and an optimal main to side lobe ratio over a prescribed steering angle range; and (2) enhanced audio features by utilizing the steerable speaker array in combination with a steerable microphone or microphone array, such as, for example, acoustic echo cancellation, crosstalk minimization, voice-lift, dynamic noise masking, and spatialized audio streams.

According to one aspect, a speaker array is provided. The speaker array comprises a plurality of drivers arranged in a concentric, nested configuration formed by arranging the drivers in a plurality of concentric groups and placing the groups at different radial distances from a central point of the configuration. Each group is formed by a subset of the plurality of drivers being positioned at predetermined intervals from each other along a perimeter of the group. The groups are rotationally offset from each other relative to a central axis of the array that passes through the central point. The different radial distances are configured such that the concentric groups are harmonically nested.

According to another aspect, a method, performed by one or more processors to generate a beamformed audio output using an audio system comprising a speaker array having a plurality of drivers, is provided. The method comprises receiving one or more input audio signals from an audio source coupled to the audio system; generating a separate audio output signal for each driver of the speaker array based on at least one of the input audio signals, the drivers being arranged in a plurality of concentric groups positioned at different radial distances relative to a central point to form a concentric, nested configuration; and providing the audio output signals to the corresponding drivers to produce a beamformed audio output. The generating comprises, for each driver: obtaining one or more filter values and at least one delay value associated with the driver, at least one of the one or more filter values being assigned to the driver based on the concentric group in which the driver is located, applying the at least one filter value to one or more filters to produce a filtered output signal for the driver, providing the filtered output signal to a delay element associated with the driver, applying the at least one delay value to the delay element to produce a delayed output signal for the driver, and providing the delayed output signal to a power amplifier in order to amplify the signal by a predetermined gain amount.

According to another aspect, an audio system is provided. The audio system comprises a first speaker array comprising a plurality of drivers arranged in a plurality of concentric groups positioned at different radial distances from a central point to form a concentric, nested configuration, each group being formed by a subset of the plurality of drivers being positioned at predetermined intervals from each other along a perimeter of the group. The audio system further comprises a beamforming system coupled to the first speaker array and configured to: receive one or more input audio signals from an audio source, generate a separate audio output signal for each driver of the first speaker array based on at least one of the input audio signal, and provide the audio output signals to the corresponding drivers to produce a beamformed audio output.

According to yet another aspect, a speaker system is provided. The speaker system comprises a planar speaker array disposed in a substantially flat housing and comprising a plurality of drivers arranged in a two-dimensional configuration, the speaker array having an aperture size of less than 60 centimeters and being configured to simultaneously form a plurality of dynamically steerable lobes directed towards multiple locations. The speaker system further comprises a beamforming system coupled to the speaker array and configured to digitally process one or more input audio signals, generate a corresponding audio output signal for each driver, and direct each output signal towards a designated one of the multiple locations.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
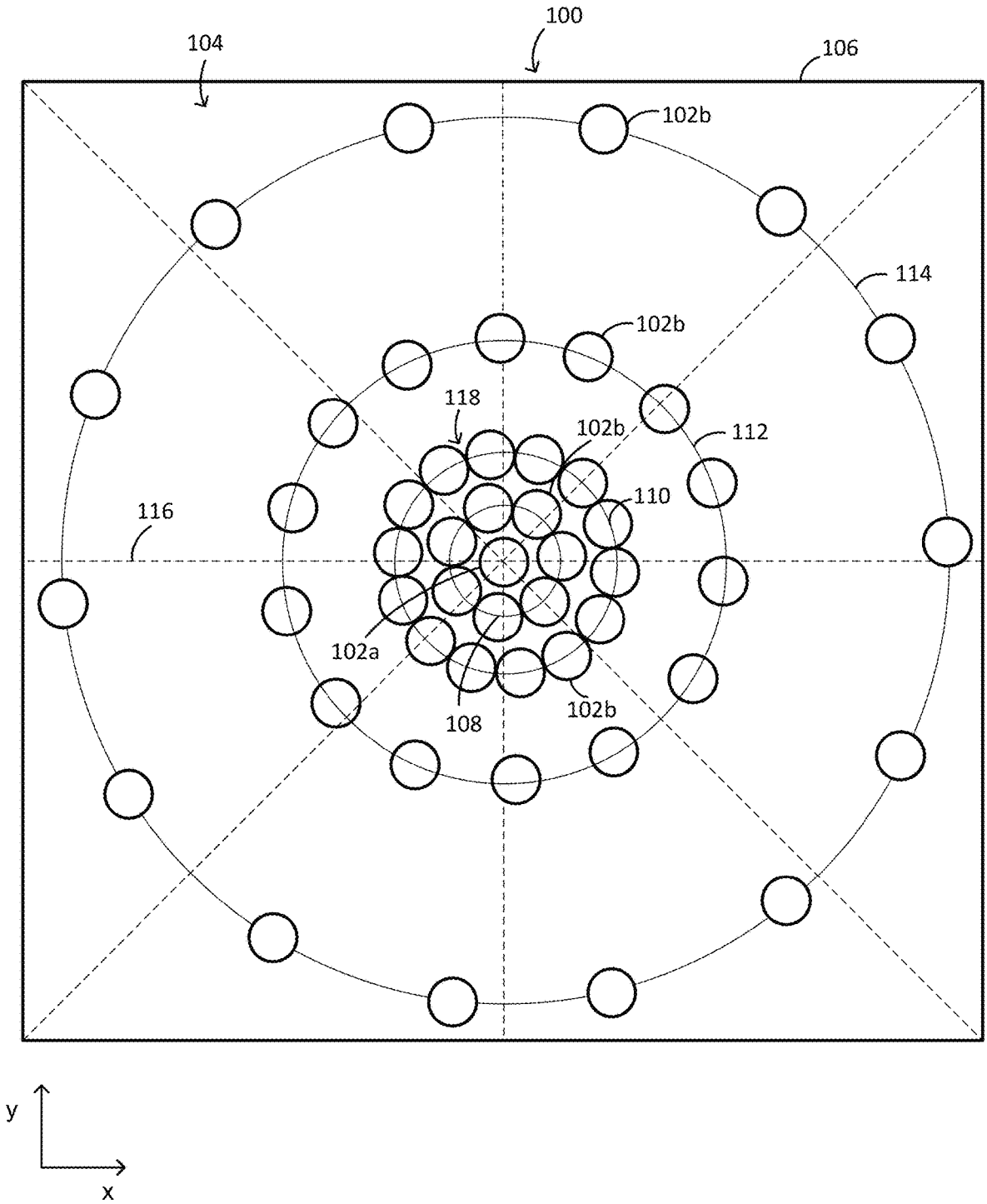
FIG. 1 is a schematic diagram illustrating an exemplary speaker array in accordance with certain embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

Systems and methods are provided herein for a speaker system that includes a plurality of electroacoustic transducers or drivers selectively arranged to form a high-performing planar array capable of presenting audio source material in a narrowly directed, dynamically steerable sound beam and simultaneously presenting different source materials to different locations using individually steerable beams. The drivers are arranged in a harmonically nested and geometrically optimized configuration to allow for polar pattern formation capable of generating highly spatially-controlled and steerable beams with an optimal directivity index.

In embodiments, the array configuration is achieved by arranging the drivers in a plurality of concentrically-positioned groups (e.g., rings or other formations), which enables the speaker array to have equivalent beam width performance for any given look angle in a three-dimensional (e.g., X-Y-Z) space. As a result, the speaker array described herein can provide a more consistent output and improved directivity than existing arrays with linear, rectangular, or square constellations. Further, each concentric group within the configuration of drivers is rotationally offset from every other group in order to avoid radial and axial symmetry. This enables the speaker array described herein to minimize side lobe growth or provide a maximal main-to-side-lobe ratio, unlike existing speaker arrays with co-linearly positioned speaker elements. The offset configuration can also tolerate further beam steering, which allows the speaker array to cover a wider listening area. Moreover, the speaker array configuration described herein can be harmonically nested to optimize beam width over a given set of distinct frequency bands (e.g., across the voice frequency range).

Figure 3:
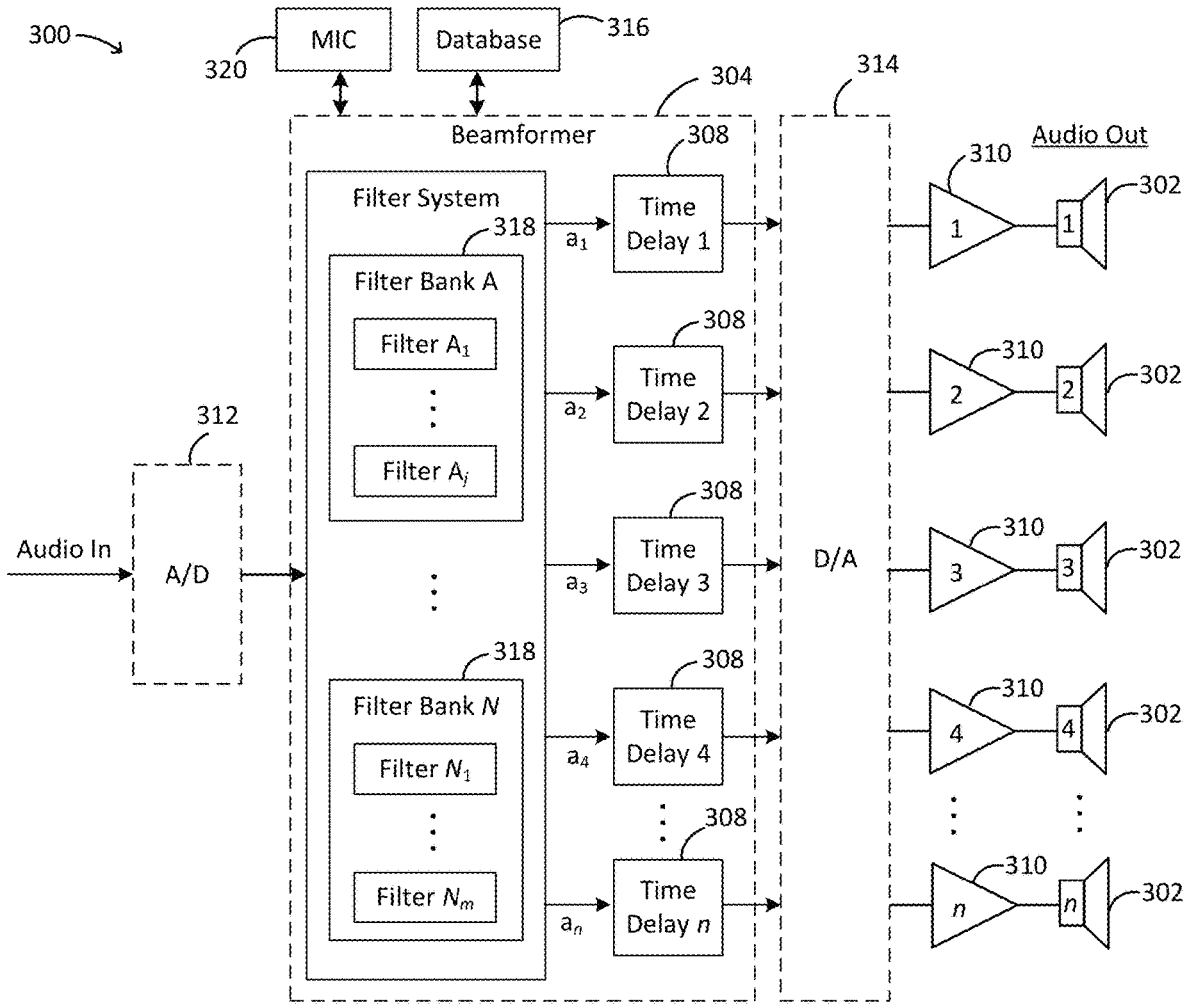
FIG. 3 is a block diagram depicting an exemplary audio processing system of the speaker system shown in FIG. 2, in accordance with certain embodiments.

FIG. 1 illustrates an exemplary speaker array 100 comprising a plurality of individually steerable speakers 102 (also referred to herein as "drivers") arranged in a two-dimensional configuration, in accordance with embodiments. Each of the speakers 102 may be an electroacoustic transducer or any other type of driver configured to convert an electrical audio signal into a corresponding sound including, for example, dynamic drivers, piezoelectric transducers, planar magnetic drivers, electrostatic transducers, MEMS drivers, compression drivers, etc. The sound output by the speaker array 100 may represent any type of input audio signal including, for example, live or real-time audio spoken by human speakers, pre-recorded audio files reproduced by an audio player, streaming audio received from a remote audio source using a network connection, etc. In some cases, the input audio signal can be a digital audio signal, and the digital audio signals may conform to the Dante standard for transmitting audio over Ethernet or another standard. In other cases, the input audio signal may be an analog audio signal, and the speaker array 100 may be coupled to components, such as analog to digital converters, processors, and/or other components, to process the analog audio signals and ultimately generate one or more digital audio output signals (e.g., as shown in FIG. 3).

The sounds produced by the speaker array 100 can be directed towards one or more listeners (e.g., human listeners) within a room (e.g., conference room), or other location, using beamforming techniques, as described herein. In some embodiments, the speaker array 100 may be configured to simultaneously produce multiple audio outputs based on different audio signals received from a plurality of audio sources, with each audio output being directed to a different location or listener.

As shown in FIG. 1, the drivers 102 are all arranged in a single plane and are forward-facing, or have a front face pointed towards the room or environment in which the speaker array 100 is installed. Each of the drivers 102 has a separate enclosed volume extending away from the front face of the driver 102. The enclosed volume forms a cylindrical cavity that, at least in part, determines a depth of the operating space required for the speaker array 100. For example, in one embodiment, each of the drivers 102 has an enclosure volume of 25 cubic centimeter (cc), which forms a cylindrical cavity of a known height behind the driver 102. This height may define a minimum depth for the speaker array 100, or a housing comprising the speaker array 100. In some embodiments, a back or rear face of the speaker array 100 may look like a honeycomb due to the independent cavities of the drivers 102 extending up and away from the front face of the array 100 and being arranged in close proximity to each other.

As shown, the drivers 102 can be coupled to, or included on, a support 104 for securing and supporting the drivers 102. The drivers 102 may be embedded into the support 104 or otherwise mechanically attached thereto (e.g., suspended from wires attached to the support 104). In the illustrated embodiment, all of the drivers 102 are positioned on the same surface or side of the support 104 (e.g., a front or top face). In other embodiments, at least some of the drivers 102 may be arranged on a first side or surface of the support 104, while the rest of the drivers 102 are arranged on the opposite side or surface of the support 104. In some embodiments, the drivers 102 may be distributed across multiple supports or surfaces.

The support 104 may be any suitable planar surface, including, for example, a flat plate, a frame, a printed circuit board, a substrate, etc., and may have any suitable size or shape, including, for example a square, as shown in FIG. 1, a rectangle, a circle, a hexagon, etc. In other embodiments, the support 104 may be a curved or domed surface having, for example, a concave or convex shape. In still other embodiments, each of the drivers 102 may be individually positioned, or suspended, in the environment without connection to a common support or housing. In such cases, the drivers 102 may be wirelessly connected to an audio processing system to receive audio output signals and may form a distributed network of speakers.

In the illustrated embodiment, the speaker array 100 is encased in a housing 106 configured to protect and structurally support the drivers 102 and support 104. The housing 106 may include a sound-permeable front face made of fabric, film, wire mesh, or other suitable material, and an enclosed rear face made of metal, plastic, or other suitable material. A depth of the housing 106 may be selected to accommodate the acoustical cavity required by each of the drivers 102, as described herein. While the illustrated embodiment shows a substantially flat, square housing 106 and support 104, other sizes and shapes are also contemplated, including, for example, domed shapes, spherical shapes, parabolic shapes, oval or circular shapes, or other types of polygons (e.g., rectangle, triangle, pentagon, etc.).

In some embodiments, the housing 106 is configured for attachment to a ceiling so that the speaker array 100 faces down towards or over the listeners in a room or other environment. For example, the speaker array 100 may be placed over a conference table and may be used to reproduce an audio signal representing speech or spoken words received from a remote audio source associated with the conferencing environment. As another example, the speaker array 100 may be placed in an open office environment, above a cluster of cubicles or other suitable location. In a preferred embodiment, the housing 106 may be flush mounted to the ceiling or other surface to gain certain acoustic benefits, such for example, infinite baffling.

In one embodiment, a size and shape of the housing 106 may be configured to substantially match that of a standard ceiling tile, so that the speaker array 100 can be attached to a drop ceiling (or a secondary ceiling hung below a main, structural ceiling) in place of, or adjacent to, one of the ceiling tiles that make up the drop ceiling. For example, the housing 106 may be square-shaped, and each side of the housing 106 may have a length of about 60 cm, or about 24 inches, depending on whether the drop ceiling is according to European specifications or U.S. specifications. In one embodiment, an overall aperture size of the speaker array 100 may be less than 60 centimeters (or less than 24 inches), in order to fit within the housing 106.

The speaker array 100 can be further configured for optimal performance at a certain height, or range of heights, above a floor of the environment, for example, in accordance with standard ceiling heights (e.g., eight to ten feet high), or any other appropriate height range (e.g., ceiling to table height). In other embodiments, the speaker array 100 is configured for attachment to a vertical wall for directing audio towards the listeners from one side of the environment.

As shown in FIG. 1, the plurality of drivers 102 includes a central driver 102*a* positioned at a central point (0,0) of the support 104 and a remaining set of the drivers 102*b* arranged in a concentric, nested configuration surrounding the central driver 102*a*, thus forming a two-dimensional array. Due, at least in part, to the geometry of this concentric, nested configuration, the speaker array 100 can achieve a constant beam width over a preset audio frequency range (e.g., the voice frequencies), improved directional sensitivity across the preset range, and maximal main-to-side-lobe ratio over a prescribed steering angle range, enabling the speaker array 100 to more precisely direct sound towards selected locations or listeners. Moreover, as compared to a linear array, the two-dimensional design of the speaker array 100 described herein requires fewer drivers 102 to achieve the same directional performance, thus reducing the overall size and weight of the array 100.

In embodiments, the central driver 102*a* can be used as a reference point for creating axial symmetry in the array 100, and the concentric, nested configuration can be formed by arranging the remaining drivers 102*b* in concentric groups 108, 110, 112, 114 around the central driver 102*a*. Each group contains a different subset or collection of the drivers 102*b*. During operation, two or more groups of drivers 102*b* and/or the central driver 102*a* may be selected to work together and form a "sub-nest" configured to produce a desired speaker output, such as, for example, high directivity and steerability in a given frequency band. The number of sub-nests that may be formed using the drivers 102 can vary depending on the beamforming techniques used, the covered frequency bands, the total number of drivers 102 in the array 100, the total number of groups of drivers 102, etc.

As shown, the groups 108, 110, 112, 114 are positioned at progressively larger radial distances from the central point (0,0) of the array 100 in order to cover progressively lower frequency octaves and create a harmonically nested configuration. For example, as shown in FIG. 1, the first group 108 is immediately adjacent to the central driver 102*a* and is nested within the second group 110, while the second group 110 is nested within the third group 112, and the third group 112 is nested within the fourth group 114. In addition, the radial distances of the groups 108-114 may double in size with each nesting in accordance with harmonic nesting techniques. For example, the radial distance of the second group 110 is double the radial distance of the first group 108, the radial distance of the third group 112 is double that of the second group 110, etc. As shown, in some embodiments, the concentric groups 108-114 may be circular in shape and may form rings of different sizes. For example, in FIG. 1, a circle has been drawn through each group of drivers 102*b* for ease of explanation and illustration. Other shapes for the groups of drivers 102*b* are also contemplated, including, for example, oval or other oblong shapes, rectangular or square shapes, triangles or other polygon shapes, etc.

Within each of the groups 108-114, the individual drivers 102*b* may be evenly spaced apart, or positioned at predetermined intervals, along a circumference, or perimeter, of the group. The exact distance between neighboring drivers 102*b* (e.g., center to center) within a given group may vary depending on an overall size (e.g., radius) of the group, the size of each driver 102, the shape of the groups, and the number of drivers 102*b* included in the group, as will be appreciated. For example, in FIG. 1, the drivers 102*b* in groups 108 and 110 are adjacent or nearly adjacent to each other because those two groups have smaller diameters, while groups 112 and 114 have larger diameters and therefore, larger spaces between their respective drivers 102*b*.

In the illustrated example, the speaker array 100 comprises a total of fifty identical drivers 102, each driver 102 having a 20 millimeter (mm) diameter. The first driver 102*a* is placed in the central reference point, while the remaining forty-nine drivers 102*b* are arranged in the four concentric groups 108, 110, 112, 114 with progressively increasing radial distances to create the nested configuration. The increased driver density created by concentrically grouping or clustering the drivers 102 in this manner can minimize side lobes and improve directivity, thereby enabling the speaker array 100 to accommodate a wider range of audio frequencies with varying beam width control. The exact number of drivers 102*b* included in each group 108-114 and the total number of drivers 102 included in the speaker array 100 may depend on a number of considerations, including, for example, a size of the individual drivers 102, the configuration of the harmonic nests, a desired density for the drivers in the array, a preset operating frequency range of the array 100 and other desired performance standards, and constraints on physical space (e.g., due to a limit on the overall dimensions of the housing 106) and/or processing power (e.g., number of processors, number of outputs per processor, processing speeds, etc.). For example, in one embodiment, only forty-eight of the fifty drivers 102 are active because of hardware limitations. In other embodiments, the speaker array 100 may include more than fifty drivers 102, for example, by adding a fifth concentric group outside outermost group 114 to better accommodate lower frequencies.

In some embodiments, the geometry and harmonic nesting of the drivers 102 included in the center of the array 100, namely cluster 118 formed by central driver 102*a* and the drivers 102*b* of groups 108 and 110, may be configured to further extend a low frequency output of the speaker array 100 (or operate in low frequency bands) without requiring a larger overall size for the array. For example, as shown in FIG. 1, the drivers 102*b* of the first group 108 are adjacent to each other and in close proximity to the central microphone 102*a*. Likewise, the drivers 102*b* of the second group 110 are also adjacent to each other and in close proximity to the first group 108. During operation, the drivers 102 forming the cluster 118 may effectively operate as one larger speaker with an aperture size roughly equivalent to a total width of the cluster 118. In embodiments, the speaker array 100 can combine the cluster 118 of drivers 102 with the drivers 102*b* in the outer groups 112 and/or 114 to provide better low frequency sensitivity (or operation) than that of each individual driver 102. For example, in embodiments where each driver 102 has a 20 mm aperture size, an effective aperture size of the central cluster 118 may be about four inches. In such cases, the speaker array 100 can be configured to provide a low frequency sensitivity of about 100 Hz, which is much lower than that of a single driver 102 (e.g., 400 Hz).

In some embodiments, the number of drivers 102*b* in each group can be configured to maximize a main-to-side-lobe ratio of the speaker array 100 and thereby, produce an improved beam width with a near constant frequency response across all frequencies within the preset range. For example, the main-to-side-lobe ratio may be maximized by including an odd number of drivers 102*b* in the first group 108 and by including a multiple of the odd number in each of the other groups 110, 112, and 114. In one embodiment, the odd number is selected from a group of prime numbers in order to further avoid axial alignment between the drivers 102 and mitigate the side lobe effects across different octaves within the overall operating range of the speaker array (for example and without limitation, 100 Hz to 10 KHz). For example, in FIG. 1, the number of drivers 102*b* included in the first group 108 is seven, and the number of drivers 102*b* in each of the other groups 110, 112, 114 is a multiple of seven, or fourteen. In some embodiments, the number of drivers 102*b* included in each group may be selected to create a repeating pattern that can be easily extended to cover more audio frequencies by adding one or more concentric groups, or easily reduced to cover fewer frequencies by removing one or more groups. In other embodiments, the number of drivers 102*b* in the first group 108 may be any integer greater than one and the number of drivers 102*b* in each of the other groups 110, 112, 114 may be a multiple of that number.

The exact diameter or circumference of each group 108, 110, 112, 114, and/or the radial distance between each group and the central point (0,0), can vary depending on the desired frequency range of the speaker array 100 and a desired sensitivity or overall sound pressure for the drivers 102*b* in that group, as well as a size of each individual driver 102. In some embodiments, a diameter or size of each group may define the lowest frequency at which the drivers 102*b* within that group can optimally operate without interference or other negative effects (e.g., due to grating lobes). For example, a radial distance of the outermost group 114 may be selected to enable optimal operation at the lowest frequencies in the predetermined operating range, while a radial distance of the innermost group 108 may be selected to enable optimal operation at the highest frequencies in the predetermined range, and the remaining ring diameters or radial distances can be determined by subdividing the remaining frequency range.

In embodiments, the total number of driver groups included in the speaker array 100 can also determine the optimal frequency or operating range of the array 100. For example, the speaker array 100 may be configured to operate in a wider range of frequencies by increasing the number of groups to more than four. In other embodiments, the speaker array 100 may have fewer than the four groups shown in FIG. 1 (e.g., three groups).

In a preferred embodiment, the radial distance of each group 108, 110, 112, 114 is twice the radial distance of the smaller group nested immediately inside that group in accordance with the harmonic nesting approach. For example, in FIG. 1, the first group 108 is positioned on a radial centerline of 25.5 millimeters (mm) from the central point (0,0), the second group 110 is positioned on a radial centerline of 51 mm from the central point (i.e. twice the radial distance of the first group 108), the third group 112 is positioned on a radial centerline of 102 mm from the central point (i.e. twice the radial distance of the second group 110), and the fourth group 114 is positioned on a radial centerline of 204 mm from the central point (i.e. twice the radial distance of the third group 112).

In embodiments, each of the groups 108-114 may be at least slightly rotated relative to central axis 116 (e.g., the x-axis), which passes through the center point (0,0) of the array (e.g., the central speaker 102*a*), in order to optimize the directivity of the speaker array 100. For example, the rotational offset can be configured to eliminate undesired interference that can occur when more than two drivers 102 are aligned. In some embodiments, the groups 108-114 can be rotationally offset from each other, for example, by rotating each group a different number of degrees relative to the central axis 116, so that no more than two of the drivers 102 are axially aligned, or co-linear. In some embodiments, the number of degrees for the offset is an integer greater than one, or a multiple of that integer, and is selected to further avoid alignment and minimize co-linearity. For example, in the illustrated embodiment, each of the groups are rotationally offset from the x-axis 116 by 17 degrees or a multiple thereof. In particular, the first group 108 is offset by 17 degrees, the second group 110 is offset by 34 degrees, the third group 112 is offset by 51 degrees, and the fourth group 114 is offset by 68 degrees. In other embodiments, the rotational offset may be more arbitrarily implemented, if at all, and/or other methods may be utilized to optimize the overall directivity of the microphone array. Regardless of the method, rotationally offsetting the drivers 102 can configure the speaker array 100 to constrain sensitivity to the main lobes, thereby maximizing main lobe response and reducing side lobe response.

As will be appreciated, FIG. 1 only shows an exemplary embodiment of the speaker array 100 and other configurations are contemplated in accordance with the principles disclosed herein. For example, while a specific number of drivers 102 and groups 108-114 are shown in the illustrated embodiment, other numbers and combinations of speaker elements are also contemplated, including adding more drivers and/or groups to help accommodate a wider frequency range (e.g., lower and/or higher frequencies). For example, by increasing the number of drivers 102*b* in each ring and/or the number of rings, a driver density across the array is also increased, which can help further minimize grating lobes and thereby, produce an improved beam width with a near constant frequency response across all frequencies within the preset range.

In some embodiments, the plurality of drivers 102 may be arranged in concentric rings around a central point, but without a driver positioned at the central point (e.g., without the central driver 102*a*). In other embodiments, only a portion of the drivers 102 may be arranged in concentric rings, and the remaining portion of the drivers 102 may be positioned at various points outside of, or in between, the discrete rings, at random locations on the support 104, in line arrays at the top, bottom and/or sides of the concentric rings, or in any other suitable arrangement. In some embodiments, the drivers 102 may be non-identical transducers. For example, some of the drivers 102 may be smaller (e.g., tweeters), while others may be larger (e.g., woofers), to help accommodate a wider range of frequencies.

Figure 2:
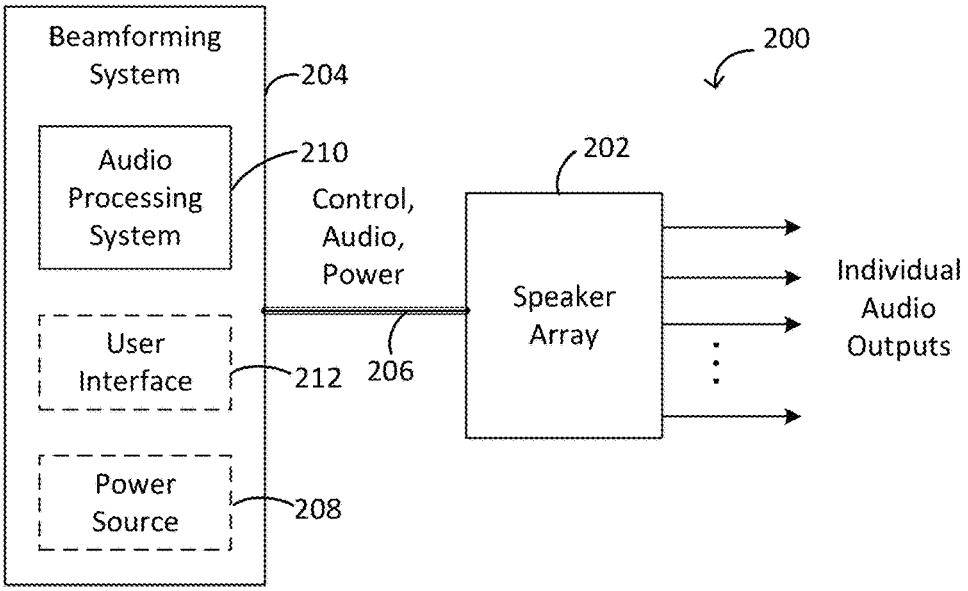
FIG. 2 is a block diagram depicting an exemplary speaker system in accordance with certain embodiments.

FIG. 2 illustrates an exemplary speaker system 200 comprising a speaker array 202 and a beamforming system 204 electrically coupled to the speaker array 202 using a single cable 206, in accordance with embodiments. The speaker system 200 (also referred to herein as an "audio system") can be configured to direct audio source material (e.g., input audio signal(s)) in a narrow, directed beam that is dynamically steerable and highly spatially controlled. In some embodiments, the speaker system 200 is configured to simultaneously output multiple streams, corresponding to different audio source materials, to multiple locations or listeners. The speaker system 200 may be used in open office environments, conference rooms, or other environments. In some embodiments, the speaker system 200 further includes one or more microphones to provide improved performance, including minimization of crosstalk and acoustic echo cancellation (AEC) through higher source receiver isolation, as well as spatialized and multi-lingual content streams, and for use in voice-lift applications.

The speaker array 202 can be comprised of a plurality of speaker elements or drivers arranged in a harmonically nested, concentric configuration, or other geometrically optimized configuration in accordance with the techniques described herein. In embodiments, the speaker array 202 may be substantially similar to the speaker array 100 shown in FIG. 1. The beamforming system 204 can be in communication with the individual speaker elements of the speaker array 202 and can be configured to beamform or otherwise process input audio signals and generate a corresponding audio output signal for each speaker element of the speaker array 202. In embodiments, the speaker array 202 can be configured to simultaneously produce a plurality of individual audio outputs using various speakers, or combinations of speakers, and direct each audio output towards a designated location or listener, as described with respect to FIG. 3.

Various components of the speaker system 200 may be implemented using software executable by one or more computers, such as a computing device with a processor and memory, and/or by hardware (e.g., discrete logic circuits, application specific integrated circuits (ASIC), programmable gate arrays (PGA), field programmable gate arrays (FPGA), digital signal processors (DSP), microprocessor, etc.). For example, some or all components of the beamforming system 204 may be implemented using discrete circuitry devices and/or using one or more processors (e.g., audio processor and/or digital signal processor) (not shown) executing program code stored in a memory (not shown), the program code being configured to carry out one or more processes or operations described herein, such as, for example, method 400 shown in FIG. 4. Thus, in embodiments, the system 200 may include one or more processors, memory devices, computing devices, and/or other hardware components not shown in FIG. 2. In one embodiment, the system 200 includes at least two separate processors, one for consolidating and formatting all of the speaker elements and another for implementing digital signal processing (DSP) functionality. In other embodiments, the system 200 may perform all functionality using one processor.

The single cable 206 can be configured to transport audio signals, data signals, and power between the beamforming system 204 and the speaker array 202. Though not shown, each of the beamforming system 204 and the speaker array 202 may include an external port for receiving either end of the cable 206. In embodiments, the external ports may be Ethernet ports configured to provide power, control, and audio connectivity to the components of the speaker system 200. In such embodiments, the single cable 206 may be an Ethernet cable (e.g., CATS, CAT6, etc.) configured to be electrically coupled to the Ethernet port. In other embodiments, the speaker system 200 includes one or more other types of external ports (e.g., Universal Serial Bus (USB), mini-USB, PS/2, HDMI, VGA, serial, etc.), and the single cable 206 is configured for coupling to said other port.

The content transported via the cable 206 to and/or from the speaker array 202 may be provided by various components of the beamforming system 204. For example, electrical power may be supplied by a power source 208 (e.g., battery, wall outlet, etc.) configured to send power to the speaker array 202. The power source 208 may be an external power supply that is electrically coupled to the beamforming system 204, or an internal power source included in the beamforming system 204 and/or speaker system 200. In a preferred embodiment, the power signal is delivered through the cable 206 using Power Over Ethernet (PoE) technology (e.g., PoE++). As an example, the power source 208 may be configured to supply up to 100 watts of power (e.g., Level 4 PoE), and the cable 206 may be configured (e.g., by including at least four twisted pairs of wires) to deliver at least 75 watts to the speaker array 202.

The audio data may be provided by an audio processing system 210 of the beamforming system 204 for transmission to the speaker array 202 over the cable 206. The audio processing system 210 can be configured to receive audio signals from one or more audio sources (not shown) coupled to the speaker system 200 and perform prescribed beamforming techniques to steer and focus sound beams to be output by the speaker array 202, for example, as described with respect to FIG. 3. The audio processing system 210 may include one or more audio recorders, audio mixers, amplifiers, audio processors, bridge devices, and/or other audio components for processing electrical audio signals. In some embodiments, the audio processing system 210 can be configured to receive audio over multiple input channels and combine the received audios into one or more output channels. In some embodiments, the audio processing system 210 can be configured to direct different audio sources to different listeners of the speaker array 202. For example, in a conference room with listeners that speak different languages, the audio processing system 210 can be configured to provide each listener with a separate sound beam containing audio in the respective language of that listener.

The data signals transported over the cable 206 may include control information received from a user interface 212 of the beamforming system 204 for transmission to the speaker array 202, information provided by the audio processing system 210 for transmission to the speaker array 202, and/or information transmitted by the speaker array 202 to the beamforming system 204. As an example, the control information may include adjustments to parameters of the speaker array 202, such as, e.g., directionality, steering, gain, noise suppression, pattern forming, muting, frequency response, etc. In some embodiments, a user of the speaker system 200 may use the user interface 212 to enter control information designed to steer discrete lobes of the speaker array 202 to a particular angle, direction or location (e.g., using point and steer techniques) and/or change a shape and/or size of the lobes (e.g., using magnitude shading, lobe stretching, and/or other lobe shaping techniques).

In some cases, the user interface 212 includes a control panel coupled to a control device or processor of the beamforming system 204, the control panel including one or more switches, dimmer knobs, buttons, and the like. In other cases, the user interface 212 may be implemented using a software application executed by a processor of the beamforming system 204 and/or a mobile or web application executed by a processor of a remote device communicatively coupled to the beamforming system 204 via a wired or wireless communication network. In such cases, the user interface 212 may include a graphical layout for enabling the user to change filter values, delay values, beam width, and other controllable parameters of the audio processing system 210 using graphical sliders and buttons and/or other types of graphical inputs. The remote device may be a smartphone or other mobile phone, laptop computer, tablet computer, desktop computer, or other computing device configured to enable remote user control of the audio processing system 210 and/or speaker array 202. In some embodiments, the beamforming system 204 includes a wireless communication device (not shown) (e.g., a radio frequency (RF) transmitter and/or receiver) for facilitating wireless communication with the remote device (e.g., by transmitting and/or receiving RF signals).

Figure 11:
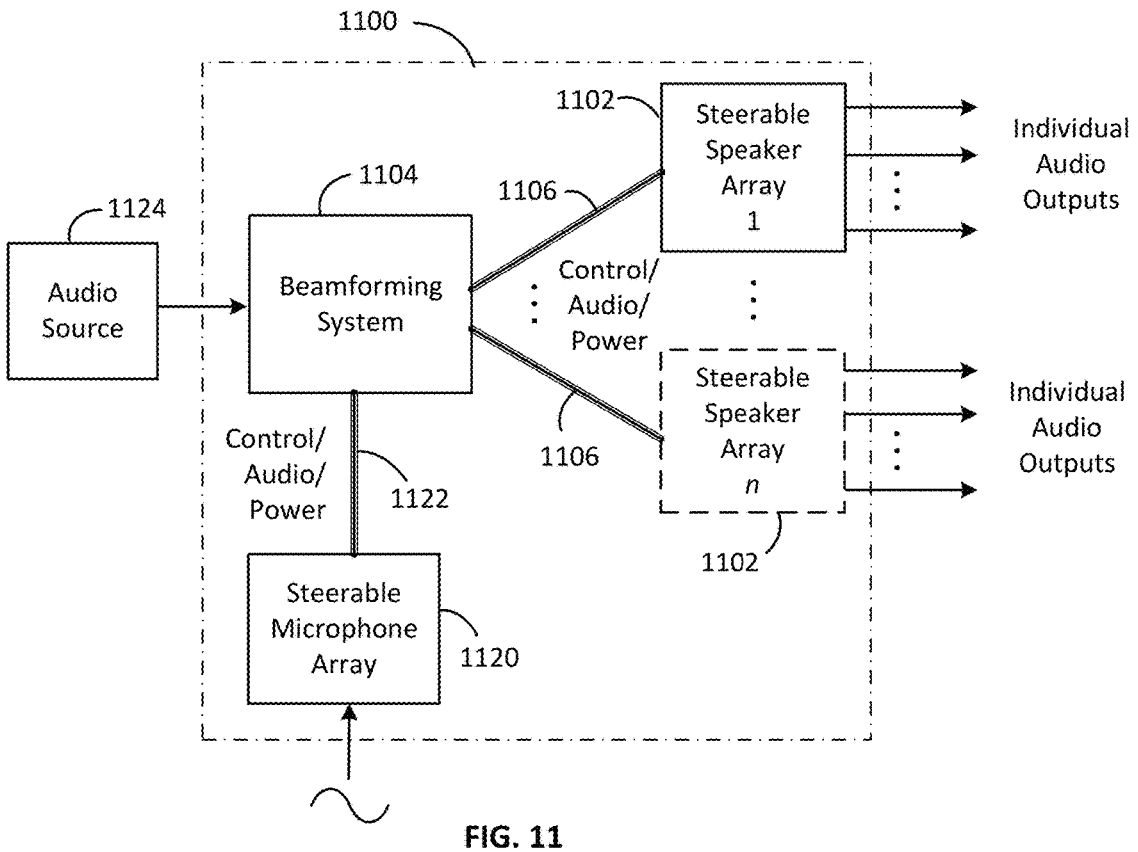
FIG. 11 is a block diagram depicting an exemplary audio system in accordance with certain embodiments.

Though FIG. 2 shows one speaker array 202, other embodiments may include multiple speaker arrays 202, or an array of the speaker arrays 202. In such cases, a separate cable 206 may be used to couple each array 202 to the beamforming system 204 (for example, as shown in FIG. 11 and described herein). And the audio processing system 210 may be configured to handle beamforming and other audio processing for all of the arrays 202. As an example, in some cases, two speaker arrays 202 may be placed side-by-side within one area or room. In other cases, four speaker arrays 202 may be placed respectively in the four corners of a space or room.

FIG. 3 illustrates an exemplary audio processing system 300 for processing input audio signals to generate individual beamformed audio outputs for each of a plurality of highly steerable, highly controllable speaker elements 302, in accordance with embodiments. In particular, the audio processing system 300 includes a beamformer 304 configured to receive one or more audio input signals and generate a separate beamformed audio signal, $a_n$, for each of n speaker elements 302. In embodiments, the audio processing system 300 may be the same as, or similar to, the audio processing system 210 shown in FIG. 2, and the speaker elements 302 may be the same as, or similar to, the speaker elements of the speaker array 202 in FIG. 2 and/or the drivers 102 shown in FIG. 1. For example, the audio processing system 300 may be configured to individually control and/or steer each of the fifty drivers 102 included in the speaker array 100 shown in FIG. 1.

In embodiments, beamformer 304 comprises a filter system 306 and a plurality of delay elements 308 configured to apply pattern forming, steering, and/or other beamforming techniques to individually control the output of each speaker element 302. To help streamline these processes, sub-nests can be formed among the speaker elements 302 so as to cover specific frequency bands. For example, each sub-nest may include a collection of two or more concentric groups of speaker elements 302, a concentric group of elements plus the speaker element positioned at the center of the speaker array, a concentric group by itself, or a combination thereof. In some cases, a given speaker element 302 or group of elements may be used in more than one sub-nest. The exact number of speaker elements 302 or groups included in a given sub-nest may depend on the frequency band assigned to that sub-nest and/or an expected performance for that sub-nest.

In embodiments, beamformer 304 is implemented using one or more audio processors configured to process the input audio signal(s), for example, using filter system 306 and delay elements 308. Each processor (not shown) may comprise a digital signal processor and/or other suitable hardware (e.g., microprocessor, dedicated integrated circuit, field programmable gate array (FPGA), etc.) In one embodiment, beamformer 304 is implemented using two audio processors having 24 outputs each. In such cases, beamformer 304 can be configured to provide up to 48 outputs and therefore, can be connected to up to 48 speaker elements or drivers 302. As will be appreciated, more or fewer processors may be used so that beamformer 304 can accommodate a larger or smaller number of drivers in the speaker array.

Various components of beamformer 304, and/or the overall audio processing system 300, may be implemented using software executable by one or more computers, such as a computing device with a processor and memory, and/or by hardware (e.g., discrete logic circuits, application specific integrated circuits (ASIC), programmable gate arrays (PGA), field programmable gate arrays (FPGA), digital signal processors (DSP), microprocessors, etc.). For example, filter systems 306 and/or delay elements 308 may be implemented using discrete circuitry devices and/or using one or more data processors executing program code stored in a memory, the program code being configured to carry out one or more processes or operations described herein, such as, for example, all or portions of method 400 shown in FIG. 4. In some embodiments, audio processing system 300 may include additional processors, memory devices, computing devices, and/or other hardware components not shown in FIG. 3.

As shown, audio processing system 300 also includes a plurality of amplifiers 310 coupled between the beamformer 304 and the plurality of speaker elements 302, such that each output of the beamformer 304 is coupled to a respective one of the amplifiers 310, and each amplifier 310 is coupled to a respective one of the speaker elements 302. During operation, a magnitude of each individual audio signal, $a_n$, generated by the beamformer 304 for a given speaker element n is amplified by a predetermined amount of gain, or gain factor (e.g., 0.5, 1, 2, etc.), before being provided to the corresponding speaker element n. In some embodiments, the gain factor for each amplifier 310 may be selected to ensure a uniform output from the speaker elements 302, i.e. matching in magnitude. As will be appreciated, the exact number of amplifiers 310 included in the audio processing system 300 can depend on the number of speaker elements 302 included in the speaker array. In embodiments, the amplifiers 310 may be class D amplifiers or switching amplifiers, another type of electric amplifier, or any other suitable amplifier.

If the input audio signals are analog signals, the audio processing system 300 may further include an analog-to-digital converter 312 for converting the analog audio signal into a digital audio signal before it reaches the beamformer 304 for digital signal processing. In such cases, the individual audio signals $a_n$ may be digital audio signals that, for example, conform to the Dante standard or another digital audio standard. The audio processing system 300 may also include a digital-to-analog converter 314 for converting each individual audio signal $a_n$ back into an analog audio signal prior to amplification by the respective amplifier 310.

In some embodiments, the audio processing system 300 can further include a database 316 configured to store information used by the beamformer 304 to generate individual audio signals $a_1$ through $a_n$. The information may include filter coefficients and/or weights for configuring the filter system 306 and/or specific time delay values or coefficients (e.g., $z^{-k}$) for configuring the delay elements 308. The database 316 may store this information in a look up table or other suitable format. As an example, the table may list different filter coefficients and/or weights, as well as time delay values, for each of the speaker elements 302 and/or for each sub-nest or group of speaker elements (e.g., groups 108-114 in FIG. 1). In other embodiments, such information is programmatically generated by a processor of the audio processing system 300 and provided to the beamformer 304 as needed, to generate the individual audio signals $a_1$ through $a_n$.

In embodiments, the filter system 306 may be configured to apply crossover filtering to the input audio signal to generate an appropriate audio output signal for each speaker element 302. The crossover filtering may include applying various filters to the input audio signal in order to isolate the signal into different or discrete frequency bands. For example, referring back to FIG. 1, there is an inverse relationship between the radial distance of each group 108-114 of drivers in the speaker array 100 and the frequency band(s) that can be optimally covered by that group. Specifically, larger apertures have a narrower low frequency beam width, and smaller apertures have more control at high frequencies. In embodiments, crossover filtering can be applied to stitch together an ideal frequency response for the speaker array 100 across a full range of operating frequencies, with better performance than that of a line array or other speaker array configurations.

As shown, the filter system 306 includes a plurality of filter banks 318, each filter bank 318 comprising a preselected combination of filters for implementing crossover filtering to generate a desired audio output. In embodiments, the filter banks 318 may be configured to set a constant beam width for the audio output of the speaker array across a wide range of frequencies. The individual filters may be configured as bandpass filters, low pass filters, high pass filters, or any other suitable type of filter for optimally isolating a particular frequency band of the input audio signal. The cutoff frequencies for each individual filter may be selected based on the specific frequency response characteristics of the corresponding sub-nest and/or speaker element, including, for example, location of frequency nulls, a desired frequency response for the speaker array, etc. The filter system 306 may include digital filters and/or analog filters. In some embodiments, the filter system 306 includes one or more finite impulse response (FIR) filters and/or infinite impulse response (HR) filters.

In some embodiments, the filter system 306 includes a separate filter bank 318 for each sub-nest of the speaker array, with N being the total number of sub-nests, and each filter bank 318 includes a separate filter for each speaker element 302 included in the corresponding sub-nest. In such cases, the exact number of filter banks 318, and the number of filters included therein, can depend on the number of sub-nests, as well as the number of speaker elements 302 included in each sub-nest. For example, in one embodiment, the speaker elements 302 may be configured as, or collected into, three different sub-nests to cover three different frequency bands and so, the filter system 306 may include three filter banks 318, one for each sub-nest. In another example embodiment, the speaker elements 302 may be configured to operate in four different sub-nests, so the filter system 306 includes at least four filter banks 318.

In still other embodiments, the filter system 306 can include a separate filter bank 318 for each of the speaker elements 302 or a separate filter bank 318 for each group of elements (e.g., groups 108, 110, 112, 114 in FIG. 1). In the latter case, for example, referring back to the speaker array 100 shown in FIG. 1, each of the groups 108, 110, 112, and 114 may be assigned a separate filter bank A, B, C, and D, respectively, from the filter system 306. Filter bank A may include at least seven individual filters, $A_1$ through $A_7$, one for each of the seven drivers 102*b* included in group 108, filter bank B may include at least fourteen individual filters, $B_1$ through $B_{14}$, one for each of the fourteen drivers included in group 110, and so on. In some embodiments, filter bank A may also include an eighth filter $A_8$ for covering the central driver 102*a*.

The filter system 306 may further include additional elements not shown in FIG. 3, such as, for example, one or more summation elements for combining two or more filtered outputs in order to generate the individual audio signal $a_n$ for speaker element n. In some embodiments, the filtered outputs for select speaker elements 302, groups, and/or sub-nests may be combined or summed together to create a desired polar pattern, or to steer a main lobe of the speaker array towards a desired angular direction, or azimuth and elevation, such as, e.g., 30 degrees, 45 degrees, etc. In some embodiments, appropriate filter coefficients or weights may be retrieved from database 316 and applied to the audio signals generated for each sub-nest and/or speaker element 302 to create different polar patterns and/or steer the lobes to a desired direction.

As shown, each individual audio signal $a_n$ output by the filter system 306 is provided to a respective one of the delay elements 308 before exiting the beamformer 304. Each delay element 308 can be individually associated with a respective one of the speaker elements 302 and can be configured to apply an appropriate amount of time delay (e.g., $z^{-1}$) to the filtered output $a_n$ received at its input. In embodiments, the delay value for a given speaker element 302 can be retrieved from the database 316 or programmatically generated (e.g., using software instructions executed by a processor), similar to the filter coefficients and/or weights used for the filter system 306. For example, each speaker element 302 may be assigned a respective amount of delay (or delay value), and such pairings may be stored in the database 316. The exact amount of delay applied in association with each speaker element 302 can vary depending on, for example, a desired polar pattern, a desired steering angle and/or shape of the main lobe, and/or other beamforming aspects.

Figure 12:
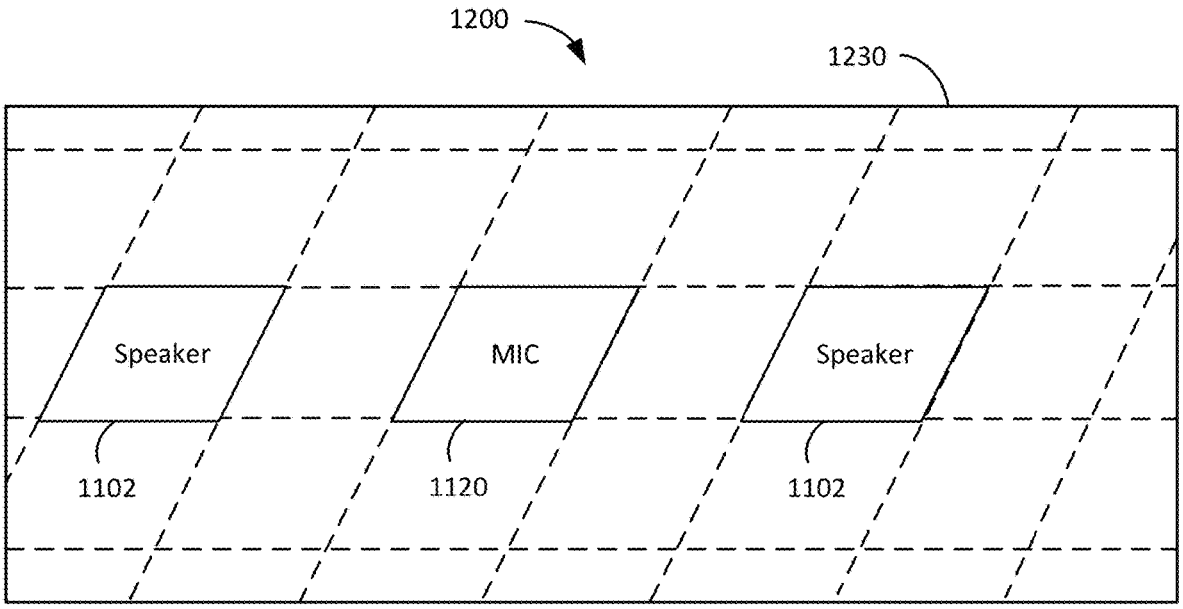
FIG. 12 is a schematic diagram illustrating an exemplary implementation of the audio system of FIG. 11 in a drop ceiling, in accordance with certain embodiments.

In some embodiments, the audio processing system 300 also includes one or more microphones 320 for detecting sound in a given environment and converting the sound into an audio signal for the purpose of implementing acoustic echo cancellation (AEC), voice lift, and other audio processing techniques designed to improve the performance of the speaker array 300. In some embodiments, the one or more microphones 320 may be arranged inside the speaker enclosure (such as, e.g., housing 106 of FIG. 1). In other embodiments, the one or more microphones 320 may be physically separate from the speaker array 302, but communicatively coupled to the audio processing system 300 and positioned in the same room or location. The microphone(s) 320 may include any suitable type of microphone element, such as, e.g., a micro-electrical mechanical system (MEMS) transducer, condenser microphone, dynamic transducer, piezoelectric microphone, etc. In some embodiments, the microphone 320 is a standalone microphone array, for example, as shown in FIG. 12 and described below.

Figure 4:
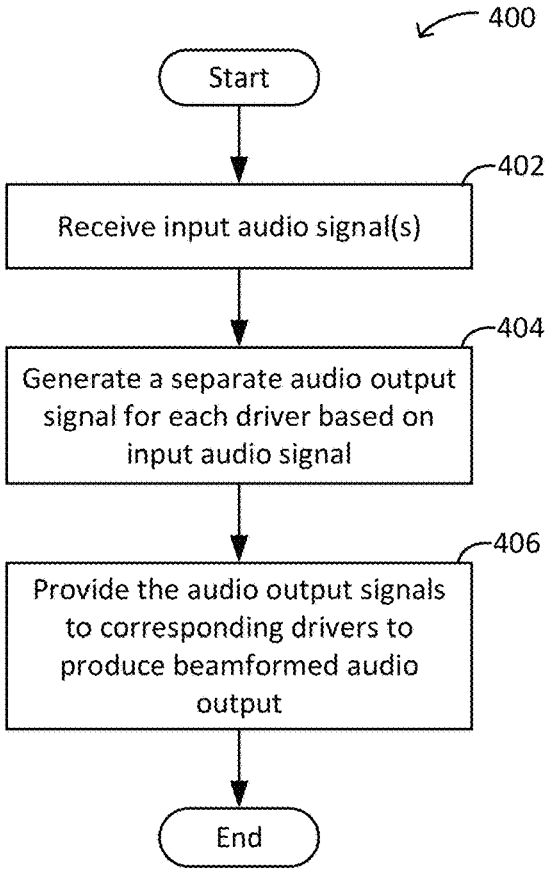
FIG. 4 is a flowchart illustrating an exemplary method of generating a beamformed audio output using the speaker system of FIG. 2, in accordance with one or more embodiments.

FIG. 4 illustrates an exemplary method 400 of generating a beamformed audio output for a speaker array comprising a plurality of speaker elements or drivers arranged in a concentric, nested configuration (e.g., as shown in FIG. 1), in accordance with embodiments. All or portions of the method 400 may be performed by one or more processors and/or other processing devices (e.g., analog to digital converters, encryption chips, etc.) within or external to the speaker array (such as, e.g., speaker array 202 shown in FIG. 2). In addition, one or more other types of components (e.g., memory, input and/or output devices, transmitters, receivers, buffers, drivers, discrete components, logic circuits, etc.) may also be utilized in conjunction with the processors and/or other processing components to perform any, some, or all of the steps of the method 400. For example, program code stored in a memory of the audio processing system 300 shown in FIG. 3 may be executed by the beamformer 304 to carry out one or more operations of the method 400. Each audio output signal generated by the audio processing system 300 may be provided to a respective one of the drivers included in the speaker array (e.g., speaker elements 302 shown in FIG. 3 or drivers 102 shown in FIG. 1). The drivers can be arranged in a plurality of concentric groups positioned at different radial distances to form a nested configuration (e.g., groups 108-114 in FIG. 1).

The method 400 begins at step 402 with receiving one or more input audio signals from an audio source. The input audio signals may be received at one or more processors, such as, e.g., beamformer 304 shown in FIG. 3. In some embodiments, step 402 may include receiving at least two different input audio signals over at least two different channels. In such cases, the method 400 may be configured to simultaneously process or beamform the at least two signals and generate at least two audio outputs directed to at least two different locations or listeners using the same speaker array. For example, certain steps of the method 400 may be performed multiple times, in parallel, in order to generate the two or more outputs. In other embodiments, step 402 may include combining input audio signals received over different channels to create one input audio signal for the beamformer 304.

At step 404, the one or more processors generate a separate audio output signal for each driver included in the speaker array based on at least one of the one or more input audio signals, as well as a desired beamforming result and characteristics related to the driver's position in the speaker array, including, for example, the particular group in which the driver located. The audio output may be generated using crossover filtering, delay and sum processing, weigh and sum processing, and/or other beamforming techniques for manipulating magnitude, phase, and delay values for each individual driver in order to steer the main lobe towards a desired location or listener and maintain a constant beam width across a wide range of frequencies. In embodiments, generating an audio output signal for each driver at step 404 can include obtaining one or more filter values and at least one delay value associated with the driver. At least one of the one or more filter values may be assigned to the driver based on the concentric group in which the driver is located. For example, in some embodiments, the groups of drivers may be combined to form two or more sub-nests for audio processing purposes, and all drivers belonging to a particular sub-nest can be assigned at least one common filter value. On the other hand, the time delay value may be specific to each driver. The filter values and delay values may be retrieved from a database (e.g., database 316 in FIG. 3) or generated by the one or more processors, as described herein.

The generating process at step 404 can also include applying the at least one filter value to one or more filters (e.g., filter bank 306 in FIG. 3) to produce a filtered output signal for the respective driver, providing the filtered output signal to a delay element (e.g., delay element 308 in FIG. 3) associated with the driver, and applying the at least one delay value to the delay element to produce a delayed output signal for that driver. In some embodiments, the generating step can further include providing the delayed output signal to a power amplifier (e.g., amplifier 310 in FIG. 3) in order to amplify the signal by a predetermined gain amount. In some cases, the predetermined gain amount may be selected based on the driver coupled to the amplifier. In other cases, the gain amount can be determined or set by the processer during step 404 in order to ensure uniform outputs across all speaker elements.

Step 406 involves providing the generated audio output signals to the corresponding drivers of the speaker array in order to produce a beamformed audio output. In embodiments, the audio output signals are transmitted to the speaker array over a single cable configured to transport audio, data, and power. The method 400 may end after completion of step 406.

Figure 5:
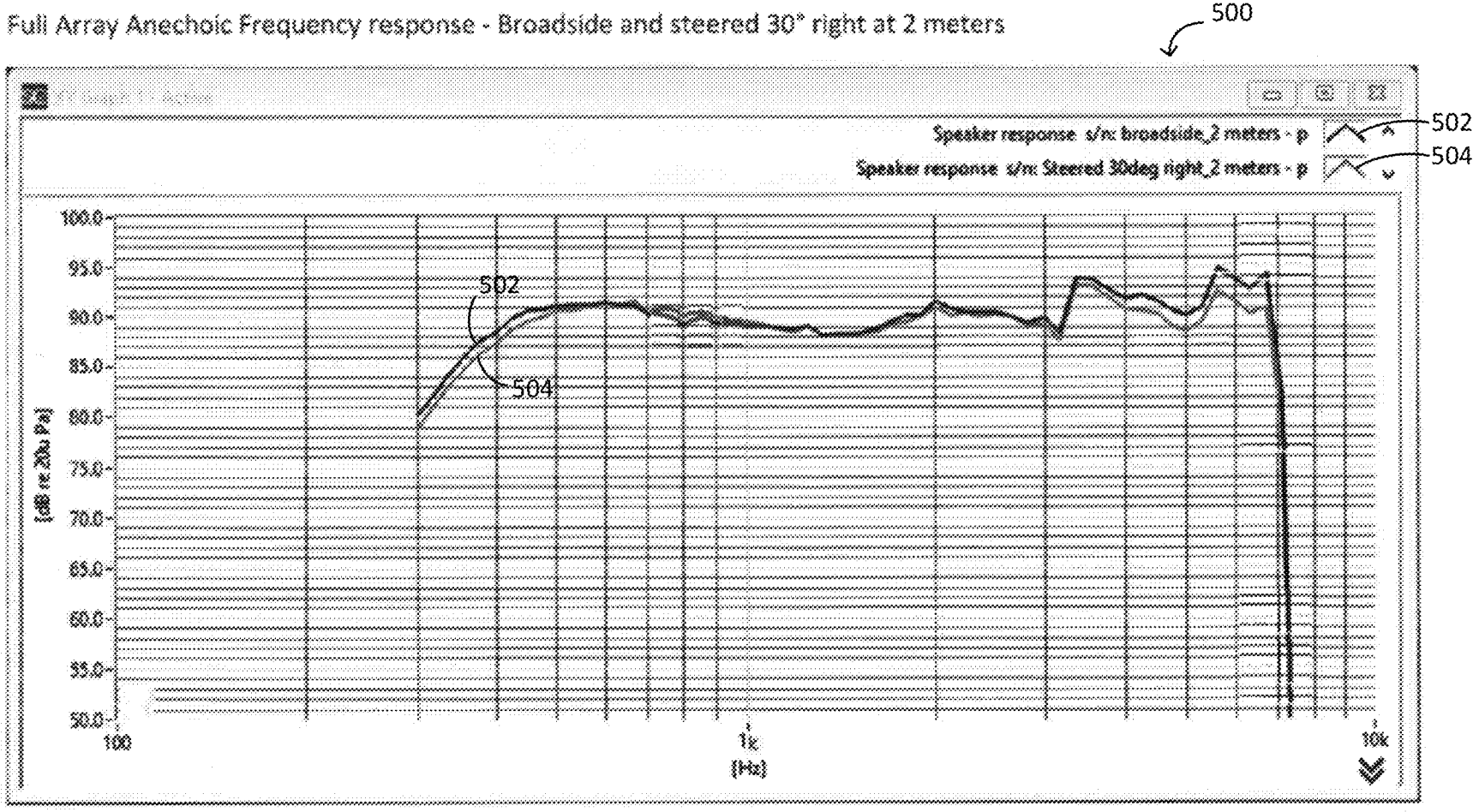
FIG. 5 is a response plot showing select frequency responses of the speaker array of FIG. 1 in accordance with certain embodiments.

FIG. 5 is a diagram 500 of exemplary anechoic frequency responses of the full speaker array 100 shown in FIG. 1, measured at a distance of two meters from the speaker array in accordance with embodiments. A first response plot 502 corresponds to the frequency response of the full speaker array 100 from a broadside direction, or without any lobe steering. As shown, the response plot 502 is substantially flat for most of the voice frequency range (e.g., 300 Hz to 3.4 kHz), with the frequency response dropping off at very low frequencies (e.g., a 3 decibel (dB) down point around 400 Hz) and very high frequencies (e.g., above 7000 Hz). A second response plot 504 corresponds to the frequency response of the full speaker array 100 when the main lobe is steered thirty degrees to the right relative to a plane of the array, and still at a distance of 2 meters. As shown, the second response plot 504 is substantially consistent with or similar to the first response plot 502. That is, like plot 502, the second response plot 504 is substantially flat for most of the voice frequency range, except for drop offs at the same very low and very high frequencies. Thus, FIG. 5 illustrates that the speaker array 100 is capable of maintaining a constant frequency response across a wide range of frequencies even after steering.

FIGS. 6A and 6B and FIGS. 7A and 7B are diagrams of exemplary polar responses of the speaker array 100 shown in FIG. 1, measured at a distance of two meters from the speaker array, in accordance with embodiments. Each polar response or pattern represents the directionality of the speaker array 100 for a given frequency at different angles about a central axis of the array. As will be appreciated, while the polar plots in FIGS. 6-7 show the polar responses of a single lobe at selected frequencies, the speaker array 100 is capable of creating multiple simultaneous lobes in multiple directions, each with equivalent, or at least substantially similar, polar response.

Figure 6A:
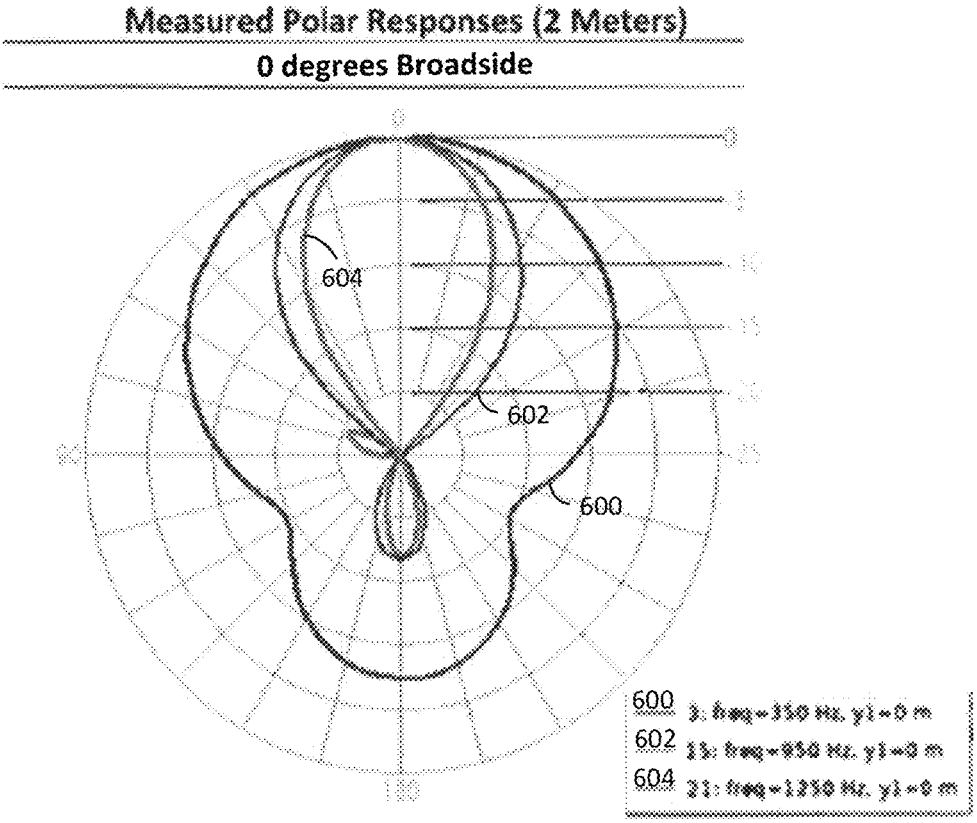
FIGS. 6A and 6B and FIGS. 7A and 7B are polar plots showing select polar responses of the speaker array of FIG. 1 in accordance with certain embodiments.
Figure 6B:
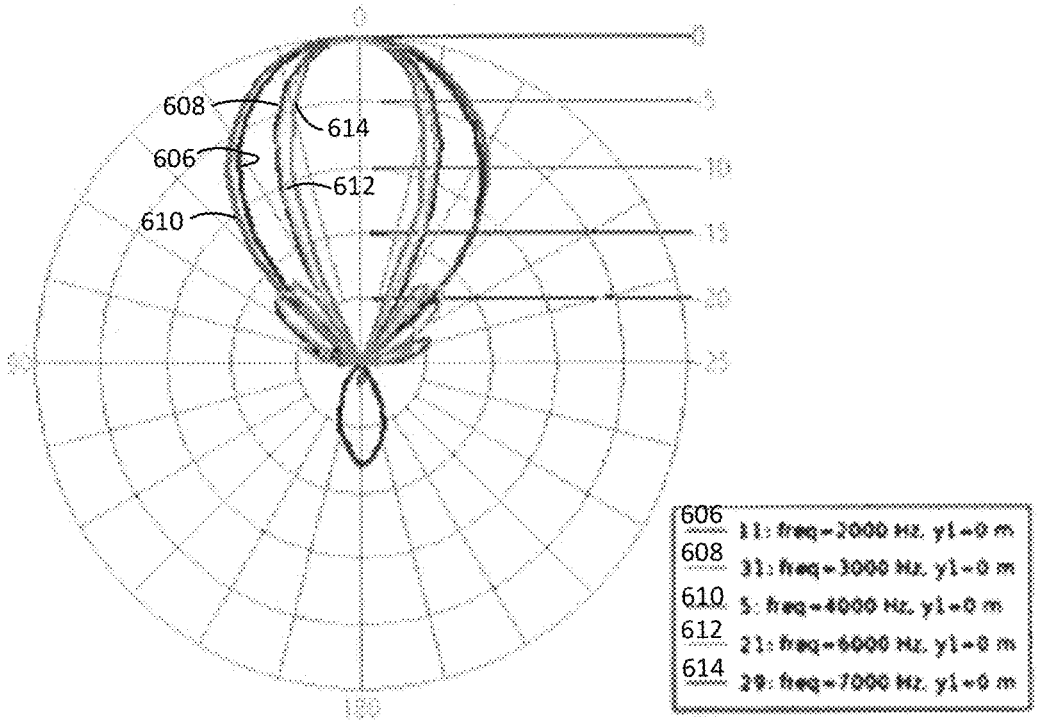
Figure 7A:
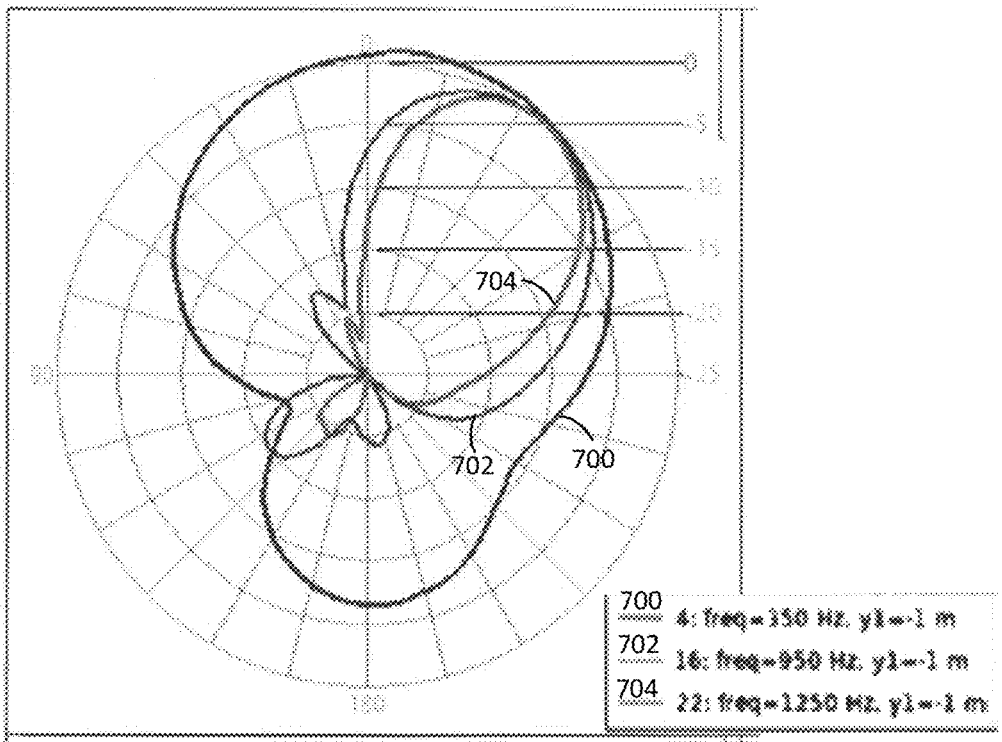
Figure 7B:
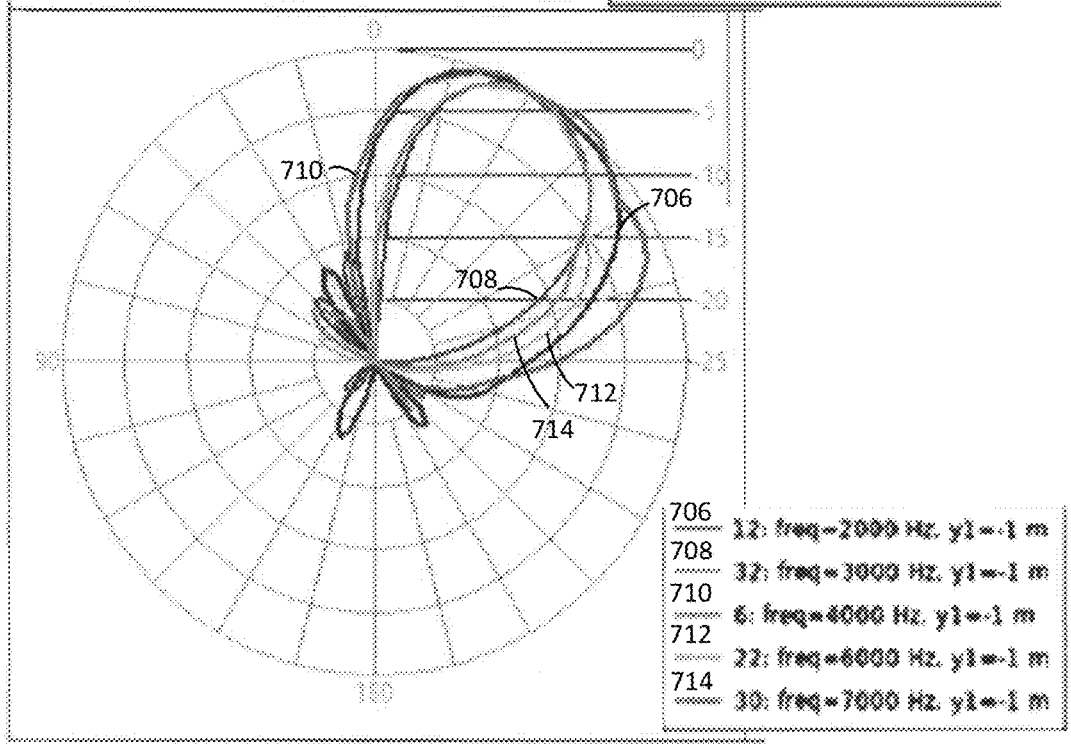

Polar plots 700-714 shown in FIGS. 6A and 6B provide the polar responses of the speaker array 100 from a broadside direction at frequencies of 350 Hz, 950 Hz, 1250 Hz, 2000 Hz, 3000 Hz, 4000 Hz, 6000 Hz, and 7000 Hz, respectively. Polar plots 700-714 shown in FIGS. 7A and 7B provide the polar responses of the speaker array 100 when steered thirty degrees to the right relative to a plane of the array 100, for the same set of frequencies, respectively. As demonstrated by the polar patterns in FIGS. 6A and 6B, the speaker array 100 can form a main lobe, or directional sound beam, with minimal side lobes at each of the indicated frequencies, when broadside or without any steering. And as demonstrated by the polar patterns in FIGS. 7A and 7B, when steered 30 degrees to the right, the speaker array 100 still forms a main lobe with minimal side lobes at each of the indicated frequencies. Thus, FIGS. 6-7 show that the speaker array 100 is capable of being steered at least 30 degrees to the right without sacrificing the main to side lobe ratio across a wide range of frequencies.

FIGS. 6-7 also show that the speaker array 100 exhibits higher directivity, or narrower beam widths, at higher frequencies, for example, as shown by polar plots 612 and 614 representing 6000 and 7000 Hz, respectively, and somewhat lower directivity at the lower frequencies, with the lowest frequency, 350 Hz, having the largest beam width, as shown by polar plots 600 and 700. Still, FIGS. 6-7 show that the side lobes are formed at no more than 12 decibels (dB) below the main lobe. Thus, the speaker array 100 provides a high overall directivity index across the voice frequency range with a high level of side lobe rejection and an optimal main-to-side-lobe ratio (e.g., 12 dB) over a prescribed steering angle range.

Figure 8:
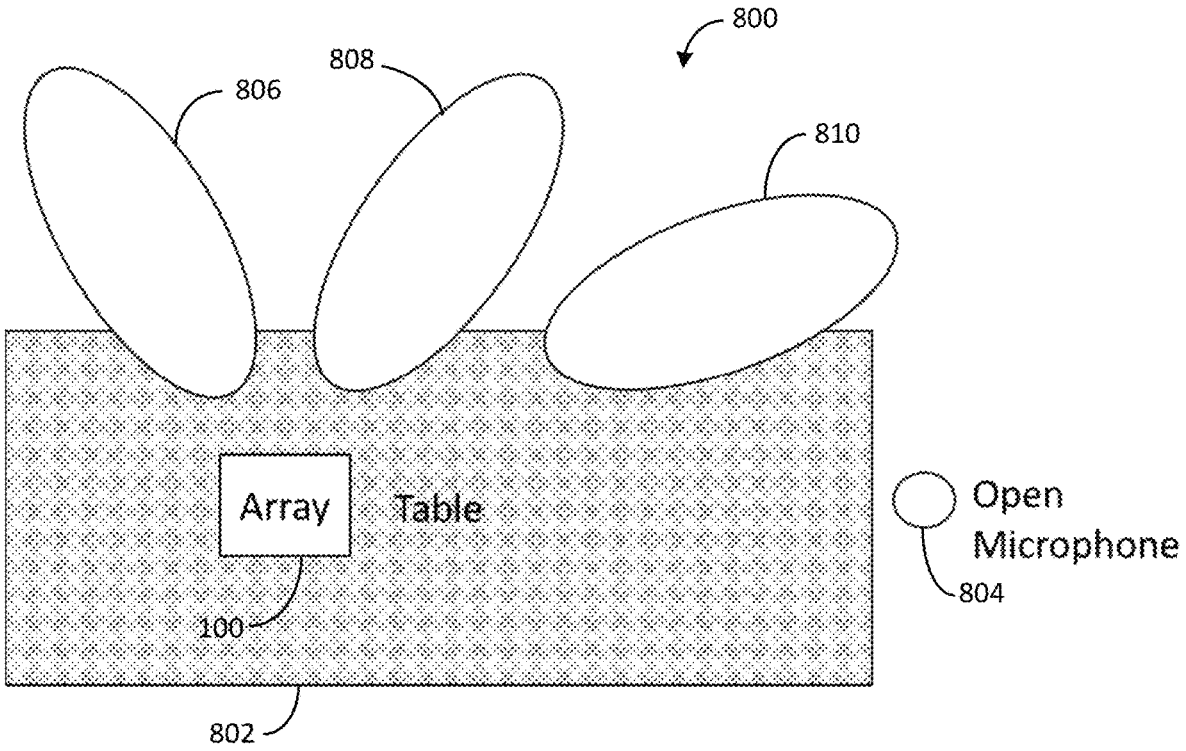
FIGS. 8-10 are diagrams of exemplary use cases for the speaker array of FIG. 1, in accordance with embodiments.
Figure 9:
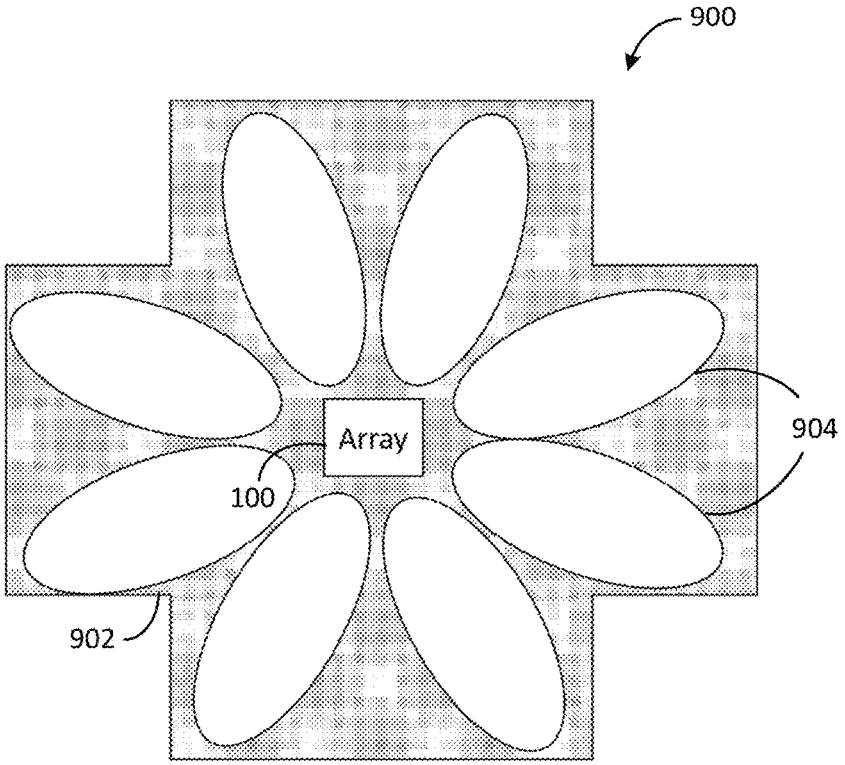
Figure 10:
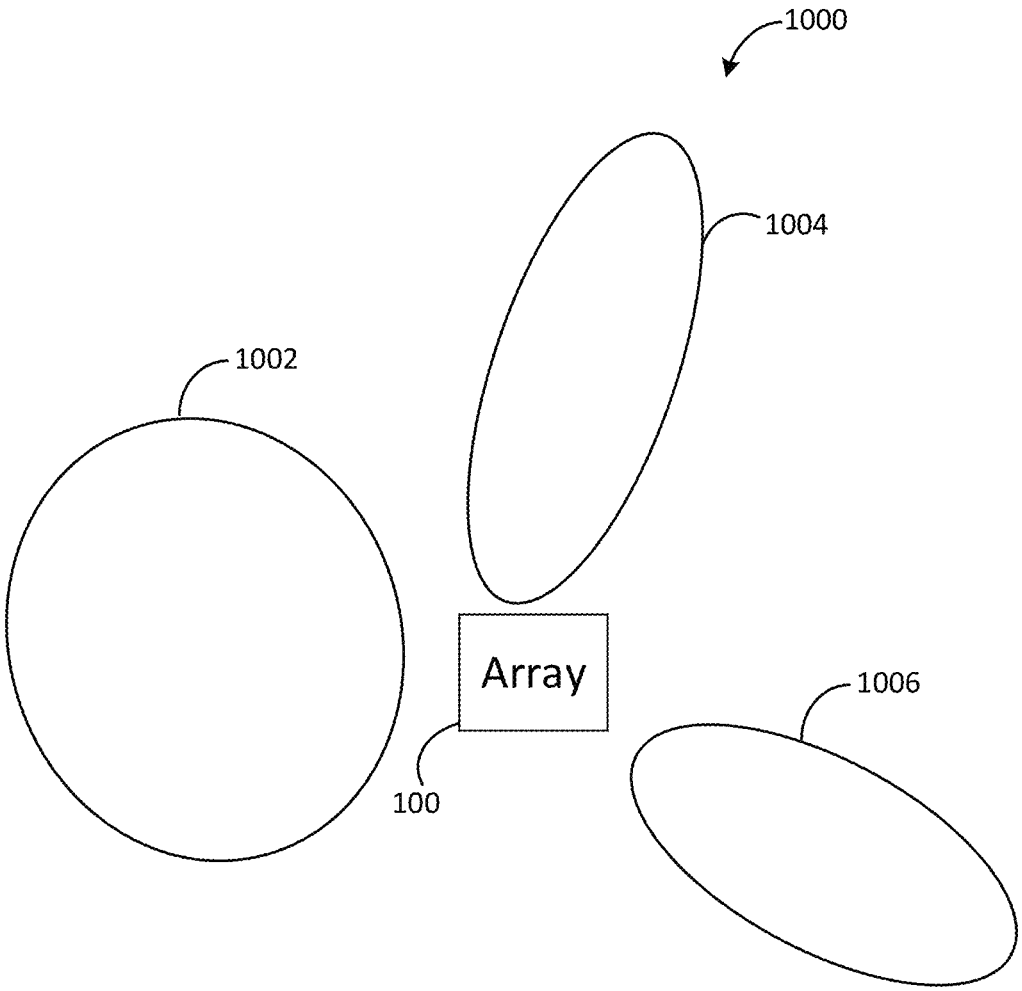

FIGS. 8-10 illustrate various exemplary applications or use cases of the speaker array 100 shown in FIG. 1 being used to dynamically steer localized sound and create spatialized audio, in accordance with embodiments. In each example, the speaker array 100 is configured to generate multiple lobes (or localized sound beams) with specific sizes, shapes, and/or steering directions based on audio output signals received from, for example, beamforming system 204 shown in FIG. 2. The beamforming system 204 may generate the audio output signal(s) by applying beamforming techniques to one or more input audio signals, as described herein. For example, the beamforming techniques can be configured to manipulate magnitude, phase, and/or delay characteristics of the input audio signal(s) to dynamically direct or steer each sound beam towards a specific location. The beamforming techniques can also be configured to apply a shaping function (e.g., using magnitude shading) for stretching the beam along a selected axis.

More specifically, FIG. 8 depicts an exemplary environment 800 in which the speaker array 100 is disposed above a table 802 having a number of human listeners (not shown) situated around or adjacent to the table 802. The environment 800 also includes an open microphone 804 positioned at one end of the table 802 to implement acoustic echo cancellation (AEC) and/or voice lift applications. In the illustrated example, the speaker array 100 has been configured to direct audio outputs, demonstrated by lobes 806, 808, and 810, towards three discrete listeners or locations positioned adjacent to each other along one side of the table 802, while also steering the lobes 806, 808, 810 away from the open microphone 804 to improve AEC functionality. In the case of voice-lift applications, for example, in a conferencing environment, the microphone 804 may be used to capture sound produced by one or more human speakers positioned adjacent to or near the microphone 804, and the steerable lobes of the speaker array 100 may be used to direct the captured sound towards listeners that are outside of an audible range of the human speaker(s) and/or are further away from the microphone 804.

FIG. 9 depicts an exemplary environment 900 in which the speaker array 100 is disposed in an oddly or irregularly shaped room 902. In such cases, the speaker array 100 can be configured to direct multiple sound beams or lobes towards the various segments or corners of the room 902 so as to minimize room reflections. For example, as shown in FIG. 9, a first set of lobes 904 may be generally directed towards a first irregularly shaped segment or alcove of the room 902, but the lobes 904 themselves may be steered away from each other to minimize reflections. This lobe configuration may be repeated for each segment of the room 902, so that each lobe 904 is steered away from the other lobes 904 and towards a unique or different direction, as shown in FIG. 9.

FIG. 10 depicts an exemplary environment 1000 in which the speaker array 100 is configured to produce various lobe shapes to accommodate different scenarios. In the illustrated example, lobe 1002 has a rounded, nearly circular shape that provides a wider beam, while lobes 1004 and 1006 have elongated, oval shapes that provide a narrower, more directed beam. Other shapes are also contemplated. Lobe shaping may be managed using magnitude shading and/or other beamforming techniques, including, for example, through selection of appropriate filter weights for the filter system 306 shown in FIG. 3 and appropriate delay coefficients for the delay elements 308, also shown in FIG. 3.

FIG. 11 illustrates an exemplary audio system 1100 (or "eco-system") comprising one or more planar speaker arrays 1102, a beamforming system 1104, and at least one microphone 1120, in accordance with embodiments. The audio system 1100 can be configured to output audio signals received from an audio source 1124 in one or more narrow, directed beams that are dynamically steerable and highly spatially controlled, similar to the steerable speaker system 200 shown in FIG. 2 and described herein. Through the use of microphone(s) 1120 and appropriate audio processing techniques, the audio system 1100 can also provide improved audio performance, such as, for example, crosstalk minimization and acoustic echo cancellation (AEC) through higher source receiver isolation, spatialized audio streams, and voice-lift applications. In some embodiments, the audio system 1100 can be configured to simultaneously output multiple streams corresponding to different audio source materials (e.g., multi-lingual content steams) to multiple locations or listeners. The audio system 1100 may be used in open office environments, conference rooms, museums, performance stages, airports, and other large-scale environments with multiple potential listeners.

Each speaker array 1102 can include a plurality of speaker elements or drivers arranged in a planar configuration. For example, the speaker elements may be arranged in a harmonically nested, concentric configuration (e.g., as shown in FIG. 1) or other geometrically optimized configuration in accordance with the techniques described herein. In embodiments, each planar speaker array 1102 may be substantially similar to the steerable speaker array 202, as shown in FIG. 2 and described herein, and/or the microphone array 100, as shown in FIG. 1 and described herein.

The beamforming system 1104 can be in communication with the individual speaker elements of each speaker array 1102 and can be configured to beamform or otherwise process input audio signals and generate a corresponding audio output signal for each speaker element of each speaker array 1102. In this manner, the speaker array(s) 1102 can be configured to simultaneously produce a plurality of individual audio outputs using various speaker elements, or combinations of speaker elements, and direct each audio output towards a designated location or listener. In embodiments, the beamforming system 1104 may be substantially similar to the beamforming system 204, as shown in FIG. 2 and described herein, and may include an audio processing system that is substantially similar to the audio processing system 300, as shown in FIG. 3 and described herein.

As shown in FIG. 11, the audio system 1100 may include any number of speaker arrays 1102, and each speaker array 1102 may be coupled to the beamforming system 1104 via a single cable 1106. The cable 1106 can be configured to transport one or more of data signals, audio signals, and power between the beamforming system 1104 and the speaker array 1102 coupled thereto, with a preferred embodiment transporting all three (i.e. data (or control), audio, and power). In embodiments, each single cable 1106 can be substantially similar to the cable 206, as shown in FIG. 2 and described herein. For example, like the cable 206, the cables 1106 may be Ethernet cables (e.g., CAT5, CAT6, etc.) configured to be electrically coupled to respective Ethernet ports included in each of the speaker arrays 1102 and in the beamforming system 1104. In such cases, the power signal may be delivered through the cables 1106 using Power over Ethernet (PoE) technology, as described herein. Other types of cables and corresponding external ports are also contemplated, as also described herein. The power source supplying the power signal may be housed in the beamforming system 1104 (e.g., as shown in FIG. 2) or may be coupled to the beamforming system 1104 to provide power thereto.

The microphone 1120 can include any suitable type of microphone transducer or element capable of detecting sound in a given environment and converting the sound into an audio signal for implementing acoustic echo cancellation (AEC), voice lift, crosstalk minimization, dynamic lobe steering, and other audio processing techniques designed to improve performance of the speaker array(s) 1102. In embodiments, the microphone 1120 can be substantially similar to the microphone 320 shown in FIG. 3. The microphone 1120 can be communicatively coupled to the beamforming system 1104 using a single cable 1122 that is similar to the single cable 1106. For example, the cable 1122 may be configured to transport power, data signals, and/or audio signals between the beamforming system 1104 and the microphone array 1120. The audio signal output generated by the microphone 1120 may be digital or analog. If analog, the microphone 1120 may include one or more components, such as, e.g., analog to digital converters, processors, etc., for processing the analog audio signals and converting them into digital audio signals. The digital audio signals may conform to the Dante standard for transmitting audio over Ethernet, for example, or other network standard.

As shown in FIG. 11, the microphone 1120 can be a standalone microphone array. According to embodiments, the microphone array 1120 can include a plurality of microphone elements arranged in a planar configuration. In a preferred embodiment, the microphone elements of the microphone array 1120 are MEMS (micro-electrical mechanical system) transducers, though other types of microphone transducers are also contemplated. The beamforming system 1104 can be configured to combine the audio signals captured by each of the microphone elements in the microphone array 1120 and generate an audio output signal for the microphone array 1120 with a desired directional polar pattern. In some embodiments, the beamforming system 1104 can be configured to steer the output of the microphone array 1120 towards a desired angle or location, similar to the speaker array 1102. Non-limiting examples of beamforming or audio processing techniques that can be used to steer or direct the output of the microphone array in a desired direction may be found in, for example, the following commonly-owned U.S. patent applications: U.S. Patent Application No. 62/855,187, entitled "Auto Focus, Auto Focus within Regions, and Auto Placement of Beamformed Microphone Lobes;" U.S. Patent Application No. 62/821,800, entitled "Auto Focus and Placement of Beamformed Microphone Lobes;" and U.S. patent application Ser. No. 16/409,239, entitled "Pattern-Forming Microphone Array," the entire contents of each being incorporated by reference herein.

In embodiments, the audio system 1100 can be configured to provide adaptive or dynamic steering control for each speaker array 1102 and each microphone array 1120. For example, the steerable speaker array 1102 may be capable of individually steering each audio output or beam towards a desired location. Likewise, the microphone array 1120 may be capable of individually steering each audio pick-up lobe or beam towards a desired target. The adaptive steering control may be achieved using appropriate beamforming techniques performed by the beamforming system 1104 for each of the microphones and speakers.

In some embodiments, the audio system 1100 can be configured to apply the dynamic steering capabilities of the at least one microphone 1120 and one or more speaker arrays 1102 towards functionalities or aspects that are in addition to delivering audio outputs to specific listeners, or configured to enhance the same. In particular, the audio system 1100 may be configured to allow each component of the system 1100 (e.g., each microphone and speaker) to be mutually aware of the physical location and steering status of all other components in the system 1100 relative to each other. This mutual awareness, as well as other information related to the human source/receivers in the room, allow the audio system 1100 to make active decisions related to steering locations, as well as magnitude variability and signal delay, which allows for source reinforcement and coherence, for example. Additional details and examples are provided below.

Room Response

In some embodiments, the audio system 1100 may be used to determine room behavior, or measure the room impulse response, by using the microphone array 1120 to calculate an impulse response for the speaker arrays 1102. Appropriate audio processing techniques may be used to measure the impulse response of each speaker array 1102 and may include a frequency-dependent response or an audible response. According to some techniques, an adaptive filter may be assigned to each speaker array 1102, and the filtered outputs may be combined to obtain the overall room response.

As an example, the microphone array 1120 of the audio system 1100 may be used to calculate specific room characteristics, namely RT60, speaker to microphone transfer function, and impulse response. In some embodiments, each of these values may be determined using well-known techniques. The ability to automatically measure these metrics and use them to condition the response of both the microphone array 1120 and the speaker arrays 1102, as well as the accompanying additional functionalities outlined herein, can provide information about the room or environment, and the audio system's interaction with that environment, that may better inform the technologies described below.

Time of Flight

In some embodiments, the microphone array 1120 of the audio system 1100 may be used to calculate each speaker array's time of flight (TOF), or the time it takes audio output by a given speaker array 1102 to propagate through air over a known distance (e.g., the distance between the speaker array 1102 and the microphone array 1120). The time of flight calculations can be used to control gain parameters for the speaker arrays 1102, for example, in order to avoid feedback. As an example, this measurement can be made by sending a predetermined test signal to the speaker array 1102 using any synchronous digital communication technique, while simultaneously initiating detection of the test signal audio at the microphone array 1120 also under test, using any synchronous digital communication technique (such as, for example, but not limited to, Dante). Once the signal is detected, an appropriately processed time difference between when the speaker array 1102 issued the signal and when it was detected by the microphone array 1120 will indicate the time of flight and thus, can be used to calculate the actual distance separating the two devices.

AEC

In some embodiments, the audio system 1100 may be used to optimize acoustic echo cancellation and minimize crosstalk by taking advantage of the fact that the microphone array 1120 and the speaker arrays 1102 are aware of each other. For example, an appropriate test signal may be applied to a given speaker array 1102 to excite the acoustic response of the room. The audio system 1100 can use the response detected from said test signal to initially tune echo cancelation algorithms for one or more microphones to minimize echoes generated by the room in response to the speaker array output. The audio system 1100 can also use the detected information to tune a response of the microphone array 1120 to minimize pickup from the spatial coordinates of the speaker array 1102 relative to the microphone array 1120.

Voice-Lift

In some embodiments, the steerable microphone array 1120 and steerable speaker array 1102 of the audio system 1100 may be used for adaptive voice-lift optimization. For example, null-steering techniques may be used to mutually exclude the output of one speaker array 1102 from that of another speaker array 1102. Also, null generation techniques may be used to mask non-speech audio detected by the microphone array 1120.

Voice lift is a technique for increasing speech intelligibility in large meeting rooms through subtle audio reinforcement. Incorporating voice lift techniques into the beamforming microphone array 1120 and speaker arrays 1102 of the audio system 1100 can provide a number of benefits. For example, the gain before feedback can be optimized by including the position of the active microphone in the steering decisions being made by the active speakers. When the system 1100 is aware of where the sound is coming from (i.e. the location of the talker or other audio source), the rest of the system 1100 can react intelligently by reinforcing the areas that far from the audio source, while limiting reinforcement near the audio source. As another example, when the speakers and microphones are aware of each other (e.g., via time of flight), intelligent delays can be applied to the speaker outputs relative to the audio source for voice lift purposes, so as to synchronize the direct transmission with the reinforced transmission. This would limit the amount of phase or time of flight errors in the reinforcement, which leads to a more natural and transparent experience.

Localization

In some embodiments, the audio system 1100 may also be used for acoustic localization of multiple audio sources. For example, as people speak, their locations may change, thus requiring the audio system 1100 to redirect speaker audio to optimize system performance. The presence of a set of microphones with known inter-microphone distances allows for the calculation of talker location estimation relative to the microphones. Using that information and its knowledge of the location of the microphone array 1120 relative to the speaker array 1102, the audio system 1100 can simultaneously optimize speaker playback and microphone pickup directions. In some cases, the audio system 1100 may further include one or more technologies for tracking audio sources as they move about the room or environment, such as, for example, one or more infrared devices, a camera, and/or thermal imaging technology.

Wall Mapping

Another exemplary use for the audio system 1100 may be wall mapping to determine an audio envelope of the room or other environment and generate spatial awareness of the audio sources therein. For example, the audio system 1100 may determine intra-system awareness (e.g., where the speaker arrays 1102 are located in the room) by using the microphone array 1120 to calculate time of arrival (TOA), distance between two points, and other information pertinent to establishing the spatial relationship between a given pair of speaker arrays 1102. The audio system 1100 may combine the wall mapping knowledge with this intra-system awareness to automatically control certain parameters or features of the speaker arrays 1102. For example, the audio system 1100 may use the information to automatically adjust gain parameters, lobe characteristics, and/or other features of the speaker arrays 1102 in order to avoid feedback and other undesirable effects.

In some embodiments, wall mapping can be performed by issuing a pulse to a single speaker array 1102 and processing the response by a set of microphones of known geometry, such as, e.g., microphone array 1120. Room reflections can be estimated, and in most cases, a basic room geometry can be estimated based thereon. Knowing the room geometry allows the audio system 1100 to accommodate an estimated room response. The inter-system awareness can be accomplished via any digital communication technique, whether wired or wireless (such as, e.g., Dante). Alternatively, audio steganography may be used to embed the information in an audio signal output by the speaker array 1102 and received by a given microphone, or inserted into the audio signal detected by a given microphone. Additionally, AES3 digital audio signal technology or ultrasound technology may be used to perform the information exchange between a given pair of microphones.

Privacy Index

When used in an open-office environment, or other large, open area, the audio system 1100 may be used to increase or improve a privacy index of the individuals in the environment 1200 through dynamic noise-masking. For example, a person occupying one cubicle may be able to mask a private conversation from the occupants of surrounding cubicles by configuring the speaker array 1102 to direct frequency-tuned noise towards each of the other occupants (e.g., as an individual audio output steered towards each occupant).

Privacy index (PI) is outlined as part of ASTM E1130 and is determined by the ability of nearby listeners to discern and intelligibly understand the content of a conversation. An alternate metric that is used in the architectural acoustics community is Speech Intelligibility Index (SII) outlined in ANSI S3.5. According to some embodiments, the audio system 1100 may have the following capabilities in an open office environment. The speaker array 1102 may be capable of directing masking noise to areas of the environment that are not being used for a given teleconference. This masking noise can hinder the intelligibility of the teleconference audio or speech for outside listeners. Such functionality may be initiated as part of each teleconference, or may be a persistent feature of a well-defined area, wherein the audio system 1100 is configured to ensure minimal interference to that area from talkers detected in other areas, or limit transmission of audio from those other areas to the well-defined area. The dynamic steering ability of the microphone array 1120 and speaker arrays 1102 may also be used to actively mask surrounding sounds that are naturally transmitted to a given area, for example, using active noise suppression technique.

Wireless Signals

In some embodiments, the audio system 1100 can be configured to share information between its components using ultrasonic or steganographic-type techniques that embed data or control information within the wireless audio signal. For example, information about gain levels, equalization levels, talker identification, filter coefficients, system level warnings (e.g., low battery), and other functional tasks or tests could be conveyed between components of the audio system 1100 using such wireless techniques, instead of using the network, as is conventional. This may reduce bandwidth consumption on the network and increase the speed with which information can be conveyed. Also, by embedding the data into the audio signal, the audio signal can be sent in real-time. That is, the audio signal need not be delayed to accommodate data signals, as is conventional.

FIG. 12 illustrates an exemplary implementation of the audio system 1100 as a distributed system in an environment 1200. The environment 1200 may be a conference room, a meeting hall, an open-office environment, or other large space with a ceiling 1230. As shown, the audio system 1100 may include multiple speaker arrays 1102 and at least one microphone array 1120 positioned at various locations throughout the environment 1200 in order to provide appropriate coverage and audio performance. Though FIG. 12 shows two speaker arrays 1102 and one microphone array 1120, it should be appreciated that additional speaker arrays and/or additional microphone arrays may be included in the audio system 1100, for example, to cover a larger listening area.

In some embodiments, the speaker arrays 1102 may be distributed around the environment 1200 so that each speaker array 1102 covers a predetermined portion of the environment 1200. In addition, the placement of each speaker 1102 and microphone 1120 may be selected relative to each other, or so that there is sufficient distance between adjoining devices. In some cases, the microphone 1120 may be directed away from the speaker arrays 1102 to avoid unwanted acoustic interference. The locations of the speaker arrays 1102 and microphone array(s) 1120 may also be selected depending on expected positioning of the listeners in the environment 1200 and/or the type of environment 1200. For example, in a conference room, the speaker arrays 1102 may be centered above a large conference table and may be used during a conference call to reproduce an audio signal representing speech or spoken words received from a remote audio source associated with the conference call. As another example, in an open office environment, the speaker arrays 1102 may be positioned above the clusters of cubicles, so that each cubicle receives audio from at least one of the speaker arrays 1102.

In some embodiments, the speaker arrays 1102 and the microphone array 1120 can be configured for attachment to a vertical wall or horizontal surface, such as, e.g., a tabletop. In other embodiments, the speaker arrays 1102 and microphone array 1120 can be configured for attachment to the ceiling 1230, with a front face of each device facing down towards the environment 1200. For example, each speaker array 1102 and/or microphone array 1120 may include a housing with a back surface that is configured for flush-mount attachment to the ceiling 1230, similar to the housing 106 shown in FIG. 1 and described herein.

In some embodiments, the ceiling 1230 can be a suspended ceiling, or drop-ceiling, comprising a plurality of ceiling tiles arranged in a grid-like fashion, as shown in FIG. 12. In such cases, the speaker arrays 1102 and the microphone array(s) 1120 can be configured (e.g., sized and shaped) for attachment to the drop-ceiling 1230, either in place of a given ceiling tile or to the ceiling tile itself. For example, a size and shape of a housing for each speaker array 1102 and microphone array 1120 may be selected to substantially match the size and shape of a standard ceiling tile (e.g., 60 cm by 60 cm, or 24 in by 24 in), and such housings may be configured for attachment to a frame of the drop-ceiling 1230 in the place of a standard ceiling tile. A non-limiting example of a ceiling array microphone may be found in commonly-owned U.S. Pat. No. 9,565,493, the entire contents of which are incorporated by reference herein.

Wireless/Distributed System

As shown in FIG. 11, the components of the audio system 1100 may be coupled to the beamforming system 1104 via one or more cables 1106 or 1122. In some embodiments, the audio system 1100 may be configured as a distributed system. For example, the microphone array 1120 and speaker arrays 1102 may be in wireless communication with the beamforming system 1104, for example, using a Near Field Communication (NFC) network, or other types of wireless technology (e.g., conductive, inductive, magnetic, etc.). In such cases, power may still be delivered over the cables 1106 and 1122, but audio and/or data signals may be delivered wirelessly from one device to the other using any suitable communication protocol.

In embodiments, the ability to wirelessly link the components of the audio system 1100 through a distributed network that enables metadata transfer among said components, allows for full transparency of the audio, DSP, and control parameters that are developed and exchanged through the use of the audio system 1100. Moreover, the ability to manage this metadata sharing through protocols, such as, for example, DECT, encrypted Wi-Fi, RF, NFC, Bluetooth, or any number of other wireless or wired protocols, allows for each piece of the system 1100 to be equally aware of the system 1100 as a whole. This awareness, in turn, allows the individual system components to behave in a system-wide consistent manner, as each component uses the same dataset for decision-making purposes.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiments) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A speaker array comprising:

a plurality of drivers arranged in a concentric, nested configuration formed by arranging the drivers in a plurality of concentric groups and placing the groups at different radial distances from a central point of the configuration, each group being formed by a subset of the plurality of drivers being positioned at predetermined intervals from each other along a perimeter of the group, wherein the concentric groups are rotationally offset from each other relative to a central axis of the array that passes through the central point, and wherein the different radial distances are configured such that the concentric groups are harmonically nested, wherein the plurality of drivers are configured to receive corresponding audio output signals for producing a beamformed audio output, the audio output signal corresponding to each driver being generated by applying cross-over filtering to an input audio signal using one or more filter values, the one or more filter values being assigned to that driver based on the concentric group in which the driver is located.

2. The speaker array of claim 1, wherein each group of drivers is rotationally offset relative to the central axis by a different number of degrees.

3. The speaker array of claim 1, further comprising at least one driver arranged at the central point of the concentric, nested configuration.

4. The speaker array of claim 3, wherein the at least one driver and the drivers situated in the two groups that are closest to the central point form a cluster configured to operate in low frequency bands.

5. The speaker array of claim 1, wherein each group forms a circular shape with a diameter that is selected based on a desired operating frequency for the drivers included in that group.

6. The speaker array of claim 1, wherein each group comprises a predetermined number of drivers, the predetermined number being selected from a group consisting of an odd number and multiples of the odd number.

7. The speaker array of claim 1, wherein the plurality of drivers includes at least 48 drivers.

8. The speaker array of claim 1, wherein the number of concentric groups is at least three.

9. The speaker array of claim 1, wherein each of the plurality of drivers has a uniform aperture size.

10. The speaker array of claim 1, wherein each driver has an enclosed volume extending away from a front face of the driver and forming a cylindrical cavity behind the driver, a height of the cylindrical cavity determining a depth of the speaker array.

11. A method performed by one or more processors to generate a beamformed audio output using an audio system comprising a speaker array having a plurality of drivers, the method comprising:

receiving one or more input audio signals from an audio source coupled to the audio system;

generating a separate audio output signal for each driver of the speaker array based on at least one of the input audio signals, the drivers being arranged in a plurality of concentric groups positioned at different radial distances relative to a central point to form a concentric, nested configuration, the generating comprising, for each driver:

obtaining one or more filter values and at least one delay value associated with the driver, at least one of the one or more filter values being assigned to the driver based on the concentric group in which the driver is located, applying the at least one filter value to one or more filters;

applying cross-over filtering to the at least one of the input audio signals using the one or more filters to produce a filtered output signal for the driver, providing the filtered output signal to a delay element associated with the driver, applying the at least one delay value to the delay element to produce a delayed output signal for the driver, and providing the delayed output signal to a power amplifier in order to amplify the signal by a predetermined gain amount; and providing the audio output signals to the corresponding drivers to produce a beamformed audio output.

12. The method of claim 11, further comprising receiving one or more microphone signals captured by at least one microphone included in the audio system, and optimizing an acoustic echo cancellation parameter of the speaker array based on the one or more microphone signals.

13. An audio system, comprising:

a first speaker array comprising a plurality of drivers arranged in a plurality of concentric groups positioned at different radial distances from a central point to form a concentric, nested configuration, each group being formed by a subset of the plurality of drivers being positioned at predetermined intervals from each other along a perimeter of the group; and a beamforming system coupled to the first speaker array and configured to:

receive one or more input audio signals from an audio source, generate a separate audio output signal for each driver of the first speaker array based on at least one of the input audio signals, and provide the audio output signals to the corresponding drivers to produce a beamformed audio output, wherein the beamforming system comprises a filter system including one or more filters, the beamforming system using the filter system to generate separate audio output signals, and wherein for each driver, the filter system is configured to apply cross-over filtering to the at least one of the input audio signals using one or more filter values, and generate a separate filtered audio output signal for said driver, the one or more filter values being assigned to that driver based on the concentric group in which the driver is located.

14. The audio system of claim 13, further comprising: a first single cable coupling the first speaker array to the beamforming system, and configured to transport audio, data, and power.

15. The audio system of claim 13, further comprising at least one microphone coupled to the beamforming system, wherein the beamforming system is configured to generate the separate audio output signal for each driver based further on one or more microphone signals captured by the at least one microphone.

16. The audio system of claim 15, wherein the beamforming system is configured to use the one or more microphone signals to optimize an acoustic echo cancellation parameter of the speaker array.

17. The audio system of claim 15, wherein the at least one microphone is a standalone microphone array comprising a plurality of microphones arranged in a planar configuration.

18. The audio system of claim 17, further comprising a second single cable coupling the microphone array to the beamforming system, and configured to transport audio, data, and power.

19. The audio system of claim 13, further comprising a second speaker array coupled to the beamforming system, the second speaker array comprising a second plurality of drivers arranged in a second plurality of concentric groups positioned at different radial distances from a central point to form a second concentric, nested configuration, wherein the beamforming system is further configured to:

generate a separate audio output signal for each driver of the second speaker array based on at least one of the input audio signals received from the audio source, and provide said audio output signals to the corresponding drivers of the second speaker array to produce a second beamformed audio output.

20. The audio system of claim 19, further comprising a third single cable coupling the second speaker array to the beamforming system, and configured to transport audio, data, and power.

21. The audio system of claim 13, wherein the beamforming system further comprises a plurality of delay elements, the beamforming system being configured to generate the separate audio output signals using said delay elements.

22. The audio system of claim 21, wherein each delay element is associated with a respective one of the drivers in the first speaker array, each driver is assigned a respective amount of delay, and the delay element associated with each driver is configured to receive the corresponding filtered output signal from the filter system and add the respective amount of delay to said filtered output signal to produce a delayed output signal for the driver.

23. The audio system of claim 22, wherein the beamforming system further comprises a plurality of power amplifiers, each amplifier coupled to a respective one of delay elements and to the driver associated with said delay element, wherein each amplifier is configured to apply a respective gain amount to the delayed output signal received from the corresponding delay element.

24. A speaker system, comprising:

a planar speaker array disposed in a substantially flat housing and comprising a plurality of drivers arranged in a two-dimensional configuration, the speaker array having an aperture size of less than 60 centimeters and being configured to simultaneously form a plurality of dynamically steerable lobes directed towards multiple locations; and a beamforming system coupled to the speaker array and configured to digitally process one or more input audio signals, generate a corresponding audio output signal for each driver, and direct each output signal towards a designated one of the multiple locations, wherein the plurality of drivers are arranged in the two-dimensional configuration by arranging the drivers in a plurality of concentric groups and placing the groups at a different radial distances from a central point of the configuration, and wherein the beamforming system comprises a filter system including one or more filters, the beamforming system being configured to generate the corresponding audio output signal for each driver using the filter system, and the filter system being configured to apply cross-over filtering to the one or more input audio signals using one or more filter values, the one or more filter values being assigned to that driver based on the concentric group in which the driver is located.

25. The speaker system of claim 24, wherein the beamforming system further comprises a plurality of delay elements, the beamforming system being configured to generate the corresponding audio output signal for each driver using said delay elements.

26. The speaker system of claim 24, further comprising a single cable coupling the speaker array to the beamforming system, the cable configured to transport audio, data, and power.

27. The speaker system of claim 24, wherein the plurality of drivers includes at least 48 drivers.

* * * * *